US011920861B2

(12) United States Patent
Kieling et al.

(10) Patent No.: US 11,920,861 B2
(45) Date of Patent: Mar. 5, 2024

(54) FREEZABLE INSULATED CRATE LINER

(71) Applicant: PackIt, LLC, Agoura Hills, CA (US)

(72) Inventors: Melissa Kieling, Agoura Hills, CA (US); Roland Ecarma, Northridge, CA (US); Kenneth Arthur Gross, Porter Ranch, CA (US)

(73) Assignee: PackIt, LLC, Agoura Hills, CA (US)

( * ) Notice: Subject to any disclaimer, the term of this patent is extended or adjusted under 35 U.S.C. 154(b) by 212 days.

(21) Appl. No.: 17/078,741

(22) Filed: Oct. 23, 2020

(65) Prior Publication Data

US 2021/0123653 A1 Apr. 29, 2021

Related U.S. Application Data

(60) Provisional application No. 63/072,994, filed on Sep. 1, 2020, provisional application No. 63/073,004, filed on Sep. 1, 2020, provisional application No. 62/948,901, filed on Dec. 17, 2019, provisional application No. 62/926,259, filed on Oct. 25, 2019.

(51) Int. Cl.
*F25D 3/08* (2006.01)
*B65D 6/18* (2006.01)

(52) U.S. Cl.
CPC ..... *F25D 3/08* (2013.01); *B65D 11/1826* (2013.01); *F25D 2303/083* (2013.01)

(58) Field of Classification Search
CPC . F25D 3/08; F25D 2303/083; B65D 11/1826; B65D 25/16; B65D 81/3825; B65D 1/22; B65D 81/3858
See application file for complete search history.

(56) References Cited

U.S. PATENT DOCUMENTS 5,490,396 A * 2/1996 Morris ..... F25D 3/08 62/457.2
5,562,228 A 10/1996 Ericson
10,507,968 B2 * 12/2019 Sollie et al. ..... B65D 5/46072
2007/0157653 A1 7/2007 Sasaki et al.
2017/0320653 A1 * 11/2017 Mogil et al. ..... B65D 81/3897

FOREIGN PATENT DOCUMENTS

JP 2006-027625 A 2/2006
JP 2006027625 A * 2/2006 ..... B65D 81/38
JP 2009090063 A * 4/2009 ..... A45C 7/00

OTHER PUBLICATIONS

JP 2006027625 A Translation (Year: 2006).*
JP 2009090063 A Translation (Year: 2009).*
International Search Report issued in PCT/US2020/057102; dated Jan. 29, 2021; 3 pages.
Written Opinion of the International Searching Authority issued in PCT/US2020/057102; dated Jan. 29, 2021; 6 pages.

* cited by examiner

*Primary Examiner* — Elizabeth J Martin
*Assistant Examiner* — Dario Antonio Deleon
(74) *Attorney, Agent, or Firm* — Vedder Price P.C.

(57) ABSTRACT

A device and method for transporting items, and more specifically a crate liner for use in delivering temperature-controlled items such as perishable food. The crate liner being insulated to maintain a temperature-controlled environment within the liner. The crate liner being collapsible to minimize the space required for storing the crate liner when not in use.

13 Claims, 43 Drawing Sheets

1500
1502
1504
1506
1508
110
124a
1510a
1512a
1514a
154a,154b
132
134
136
138

1500
1510a
1510b
1512a
124a
1514a
1514a 132
134
136
138

FREEZABLE INSULATED CRATE LINER

CROSS-REFERENCE TO RELATED APPLICATIONS

This application claims the benefit and priority from U.S. Provisional Patent Application Ser. No. 62/926,259, filed on Oct. 25, 2019, U.S. Provisional Patent Application Ser. No. 62/948,901, filed on Dec. 17, 2019, U.S. Provisional Patent Application Ser. No. 63/072,994, filed on Sep. 1, 2020, and U.S. Provisional Patent Application Ser. No. 63/073,004, filed on Sep. 1, 2020, the contents of which are hereby incorporated herein by reference in their entirety.

FIELD OF THE INVENTION

The present invention generally relates to devices and methods for transporting items, and it more specifically relates to freezable insulated liners of rigid and semi-rigid containers for use in delivering temperature-controlled items such as perishable food.

BACKGROUND

Multipurpose rigid and semi-rigid containers and coverings are commonly used for packing, storing, transporting, and insulating items, particularly those such as food, beverages, and other items that need to be kept warm or cool for a significant period of time during storage or transport. Existing products suffer from a number of drawbacks. Existing rigid and semi-rigid containers offer the benefit of efficiently stacking the containers when in use, but these existing products often rely on cooling media that are not suitable for use for longer periods of time while transporting or storing items, particularly within the delivery context. By way of example, larger picnic-style coolers with rigid walls are generally filled with ice, which melts and can make the contents of coolers wet. This renders the coolers unsuitable for use with certain types of items, such as food. The ice is also bulky and takes up a significant amount of space in the cooler in order to provide adequate cooling. Alternatively, some containers place a cooling media (such as gel packs) in the lining of the container walls. However, such existing containers are typically bulky and take up a relatively large amount of space in a freezer when cooling and when stacked in a nested formation when not in use. Other containers are known which contain gel material in the walls for cooling or heating purposes, but these are also bulky and difficult or impossible to fold into a compact condition, and they may be difficult to heat. The drawbacks of these containers are compounded when the containers are scaled to a larger size. For example, in the context of delivery, where there is a need for containers of various sizes and an efficient means of storage and transport, containers that are large enough to accommodate larger loads are particularly bulky and difficult to store and transport. Further, existing crate liners either suffer from a lack of structure that allows the liners to stand in the open configuration when not inserted into the crate or they sacrifice the convenience of foldable and compact storage for a more rigid structure.

SUMMARY

A need exists for improved devices for storing and transporting items, particularly those that must be maintained in a temperature-controlled environment. The devices and related methods described in the present disclosure address the drawbacks of existing designs.

Embodiments disclosed in the present application provide such improved liners for rigid or semi-rigid containers that may be collapsed so as to allow for the efficient storage and transport of the liner while empty. In particular, the disclosed embodiments provide liners that may be stored in a freezer or other temperature-controlled environment without taking up significant space, and require no modification to the rigid or semi-rigid containers already known in the art.

In an embodiment, a collapsible liner comprises: a base panel with one or more horizontal creases; a front wall extending from the base panel; a rear wall extending from the base panel opposite the front wall; a pair of opposing side walls extending from the base panel between the front wall and the rear wall, the front wall and the rear wall comprising one or more vertical creases that are orthogonal to the base panel; wherein the base panel, the front wall, the rear wall, and the pair of opposite side walls define a cavity therebetween; wherein the liner is configured to fold into a collapsed configuration by folding the base panel and the front wall and the rear wall into the cavity along the one or more horizontal creases and the multiple vertical creases; and wherein the base panel, the front wall, the rear wall, and the pair of opposing side walls each comprise an interior layer proximate the cavity, an exterior layer, and a layer therebetween of a material for maintaining the temperature of the cavity of the liner and any items located therein (e.g., by either cooling or heating).

An embodiment provides a method of collapsing a liner comprising a base panel with one or more horizontal creases and a peripheral wall comprising a front wall and a rear wall; each with one or more vertical creases, the peripheral wall extending from the base panel to form a cavity, the method comprising the steps of: folding the base panel into the cavity along the one or more horizontal creases; and folding the front wall and the rear wall into the cavity along the one or more vertical creases.

In yet another embodiment, a collapsible liner comprises: a base panel; a front wall extending from the base panel; a rear wall extending from the base panel opposite the front wall; each of the front wall and the rear wall comprising one or more horizontal creases that are parallel to the base panel and one or more angled creases that extend from proximate the base panel to proximate the one or more horizontal creases and one or more angled creases that extend from proximate the opening of the liner to the one or more horizontal creases, a pair of opposing side walls extending from the base panel between the front wall and the rear wall, each of the pair of opposing side walls comprising one or more horizontal creases that are parallel to the base panel; wherein the base panel, the front wall, the rear wall, and the pair of opposite side walls define a cavity therebetween; wherein the liner is configured to fold into a collapsed configuration by folding the front wall, rear wall, and each of the side walls into the cavity along the one or more diagonal creases and the multiple horizontal creases; and wherein the base panel, the front wall, the rear wall, and the pair of opposing side walls each comprise an interior layer proximate the cavity, an exterior layer, and a layer therebetween of a material for maintaining the temperature of the cavity of the liner and any items located therein (e.g., by either cooling or heating).

An embodiment provides a method of collapsing a liner comprising a peripheral wall comprising a front wall, a rear wall, and a pair of opposing side walls; each with one or more creases, the peripheral wall extending from a base panel to form a cavity, the method comprising the steps of: folding the front wall, the rear wall, and the side walls into the cavity along the one or more creases.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION

Figure 1:
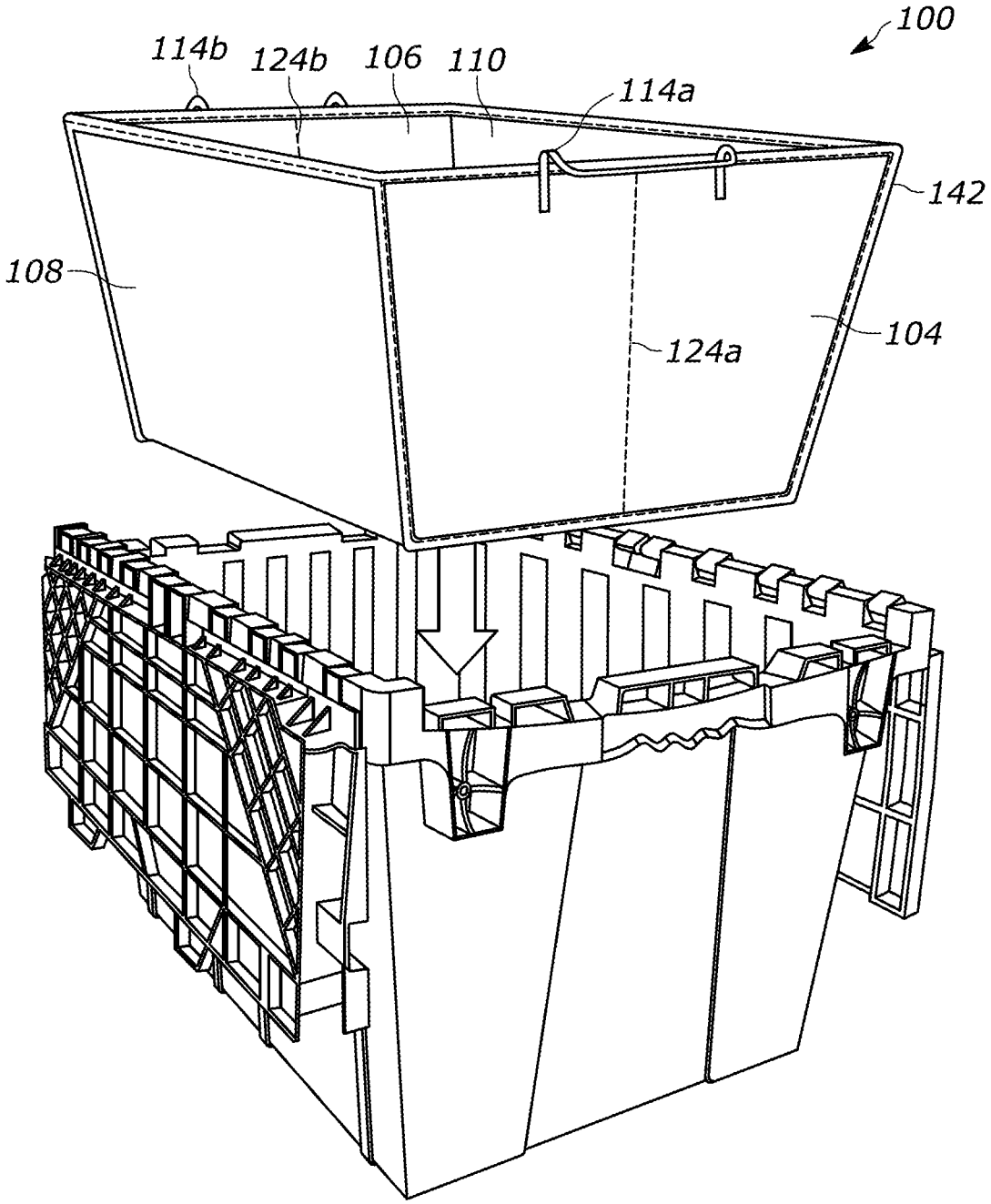
FIG. 1 is a perspective view of a first embodiment of a crate liner.
Figure 2:
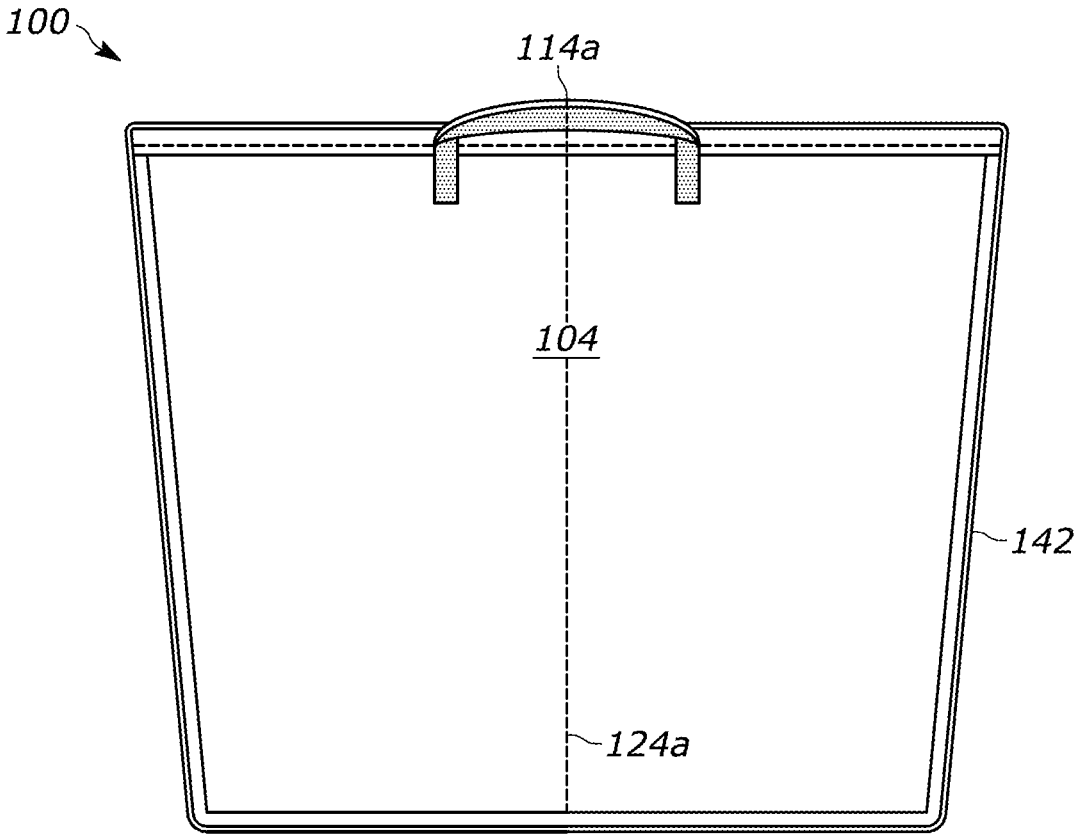
FIG. 2 is a front view of the liner of FIG. 1.
Figure 3:
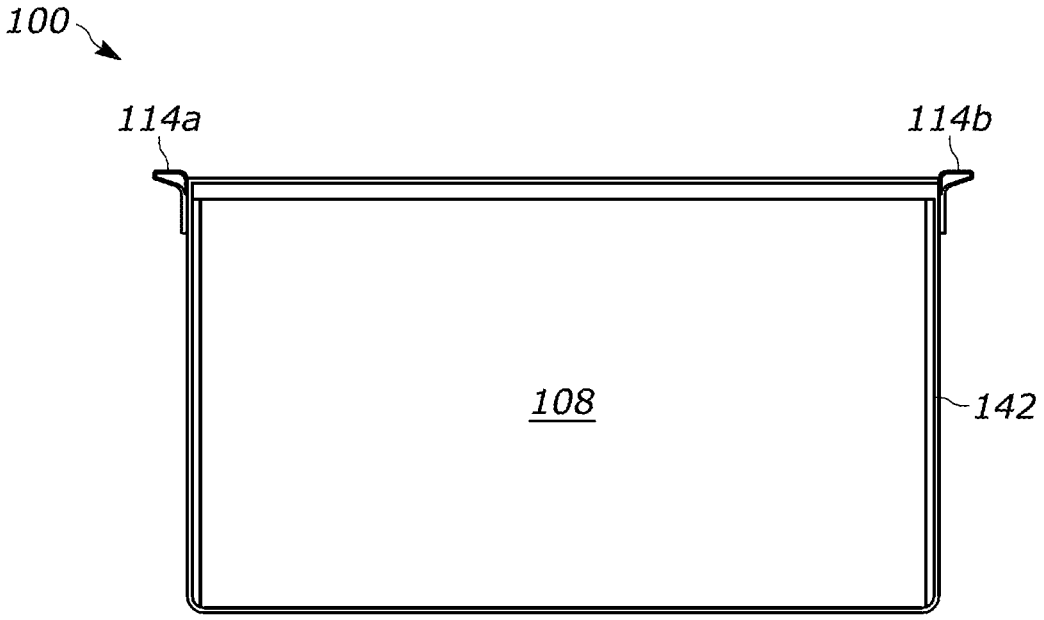
FIG. 3 is a side view of the liner of FIG. 1.

For the purposes of promoting and understanding the principles disclosed herein, reference is now made to the preferred embodiments illustrated in the drawings, and specific language is used to describe the same. It is nevertheless understood that no limitation of the scope of the invention is hereby intended. Such alterations and further modifications in the illustrated devices and such further applications of the principles disclosed and illustrated herein are contemplated as would normally occur to one of skill in the art to which this disclosure relates.

Freezable Crate Liner with Gel Pack Base

FIGS. 1 through 6 illustrate a first embodiment of a freezable crate liner 100. In the depicted embodiment, the liner 100 generally comprises a rectangular structure having a base panel 102, a front wall 104, a rear wall 106, opposite side walls 108, 110, and a lid 112, which together define a cavity which receives items to be transported or stored in the liner 100 (such as, but not limited to, articles of food, beverages, and the like). In other embodiments (not shown), the liner 100 may take other shapes. By way of example and not of limitation, in other embodiments, the liner 100 may have a greater or lesser number of walls (e.g., being cylindrical in shape and having only a single side wall, or being polyhedral and having additional walls). In some embodiments, the portion of the walls 104, 106, 108, 110 proximate to the base panel 102 is narrower than the portion proximate to the opening of the liner 100 such that the liner 100 fits securely and efficiently in the crate upon insertion.

Figure 5:
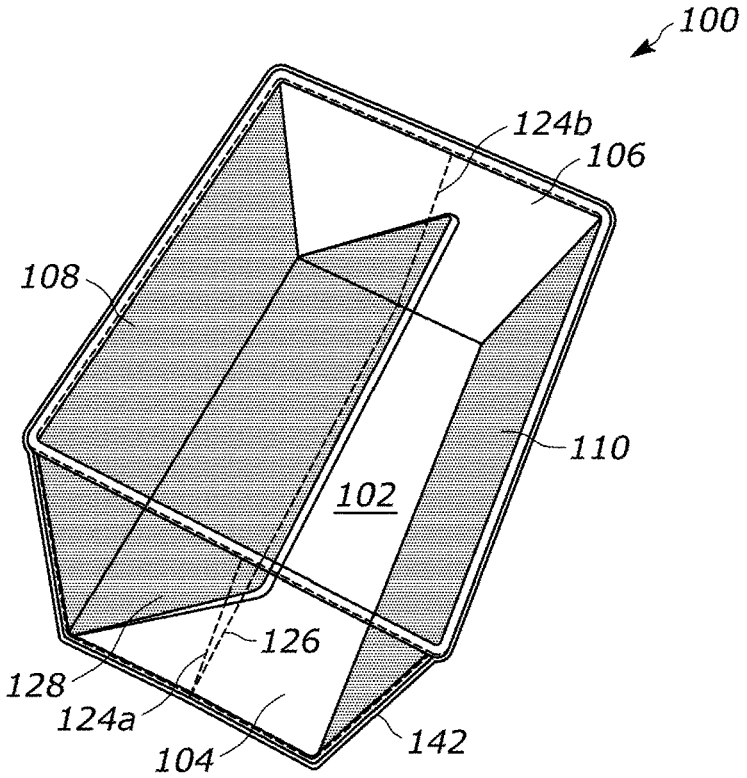
FIG. 5 is a top perspective view of the liner of FIG. 1 with the interior flap partially raised.

As shown in FIG. 5, in embodiments the liner 100 is collapsible to permit the liner 100 to be easily transported or stored while empty. As shown, vertical creases 124*a*, 124*b* extend along the front wall 104 and the rear wall 106 from proximate the base panel 102 to proximate the opening of the cavity to facilitate folding of the front wall 104 and the rear wall 106 when the liner 100 is collapsed. The base panel 102 also includes one or more creases 126 to facilitate folding the base panel 102. To collapse the liner 100, the base panel 102 folds into the liner 100 along the creases 126 while the front wall 104 and the rear wall 106 fold into the liner 100 along creases 124*a*, 124*b* such that the side walls 108, 110 move toward each other. In some embodiments (not shown), the liner 100 is secured in the collapsed configuration by using clips or other attachment means (such as hook-and-loop fasteners).

Figure 4:
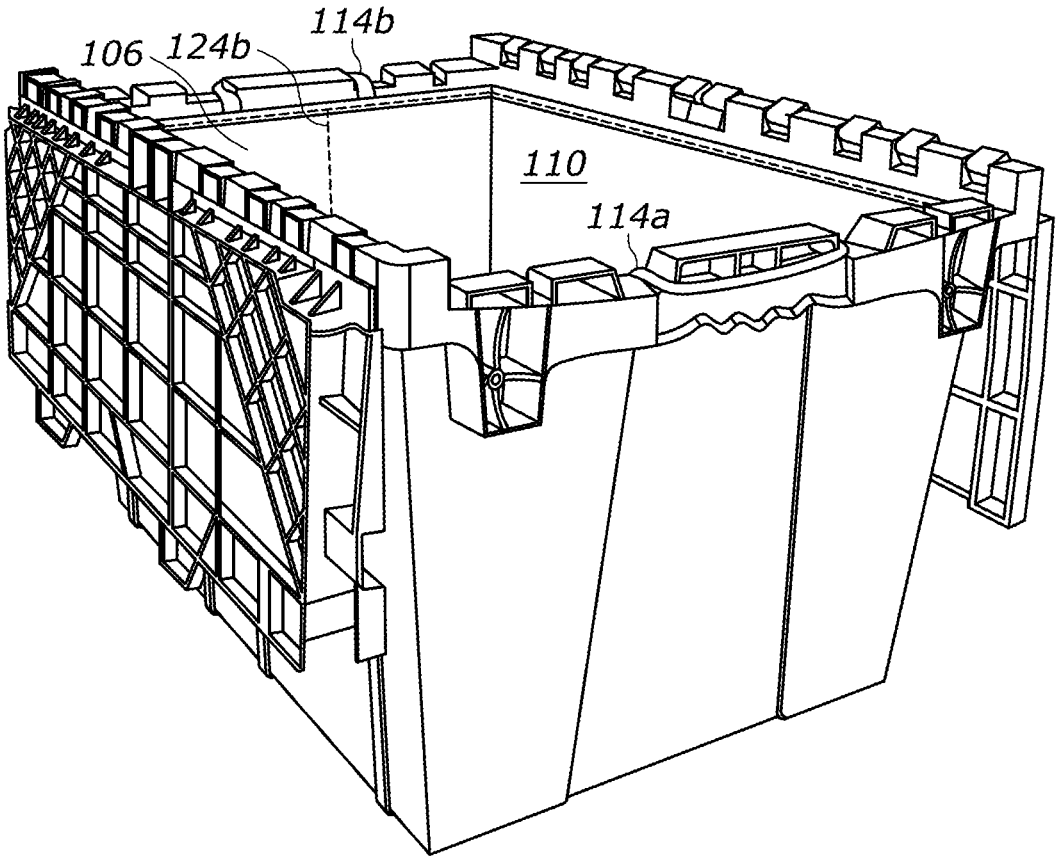
FIG. 4 is a perspective view of the liner of FIG. 1 fully inserted into a crate.

As shown, a pair of handles 114*a*, 114*b* are attached to the front wall 104 and the rear wall 106, respectively. In use, as shown in FIG. 4, the handles 114*a*, 114*b* can optionally affix to the crate (in some cases by affixing to the top edge of the crate) to ensure the liner 100 remains securely in position when the liner 100 is in use or to maintain the liner 100 in the open and upright position prior to being filled. In an alternative embodiment, the handles 114*a*, 114*b* extend above the opening of the cavity and may be used to carry the liner 100 or aid in the insertion of the liner 100 into the crate.

In an alternative embodiment, the liner 100, such as the liner shown in FIG. 1, may be self-sufficient in use, such that the liner may be used to store and transport items without the use of a crate. In such an embodiment, the pair of handles 114*a*, 114*b* may be used to carry the liner 100 when the liner 100 is in use. In an alternative embodiment (not shown), a single strap may be temporarily or permanently attached to either the opposing side walls 108, 110 or the front wall 104 and the rear wall 106 such that the strap extends over the opening of the liner 100 and may be used to carry the liner 100, such a strap may optionally include a clasp or the like to allow for adjusting the length of the strap.

Figure 6:
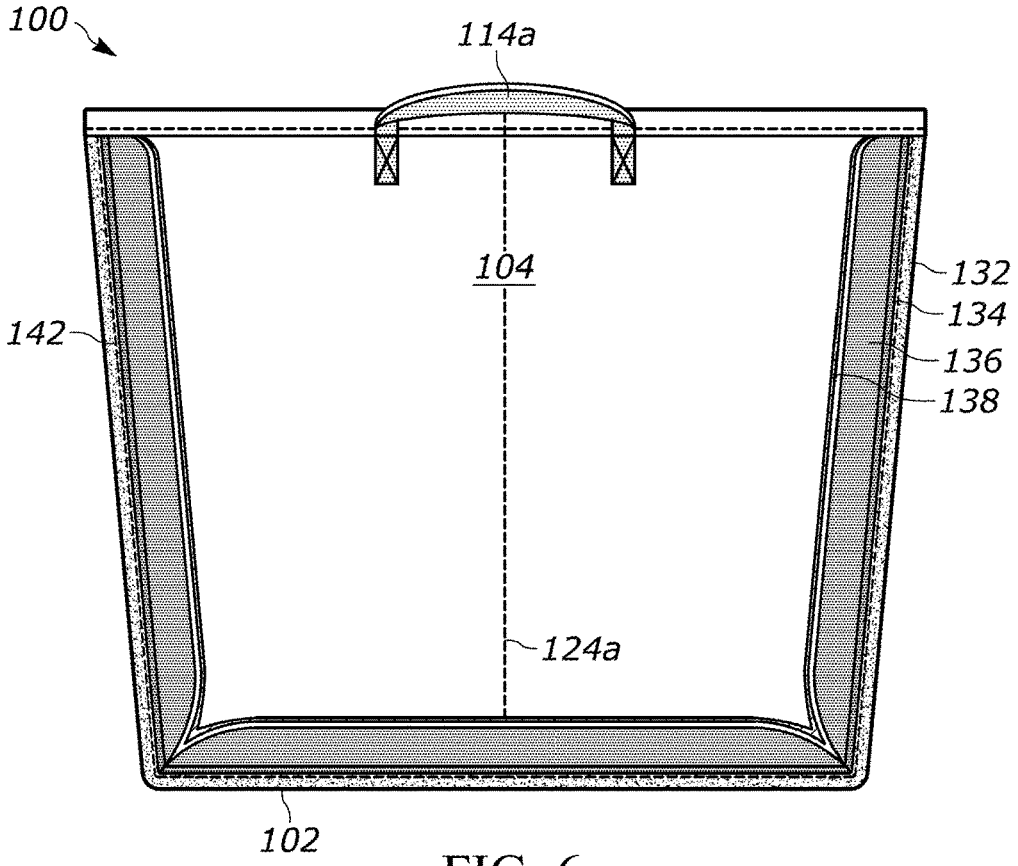
FIG. 6 is an expanded view showing the internal structure of the walls of the liner of FIG. 1.
Figure 7:
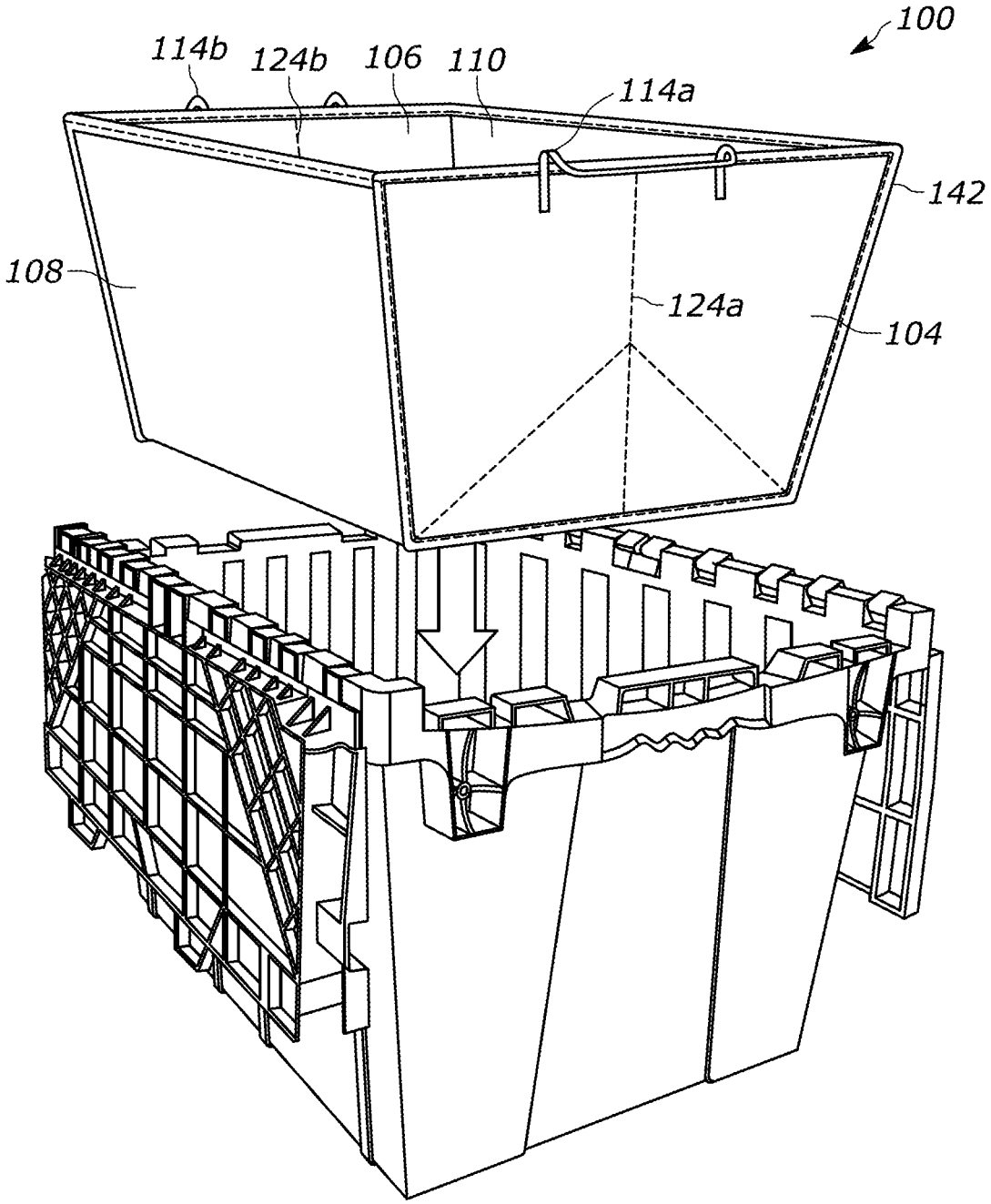
FIG. 7 is a perspective view of a second embodiment of a crate liner.
Figure 8:
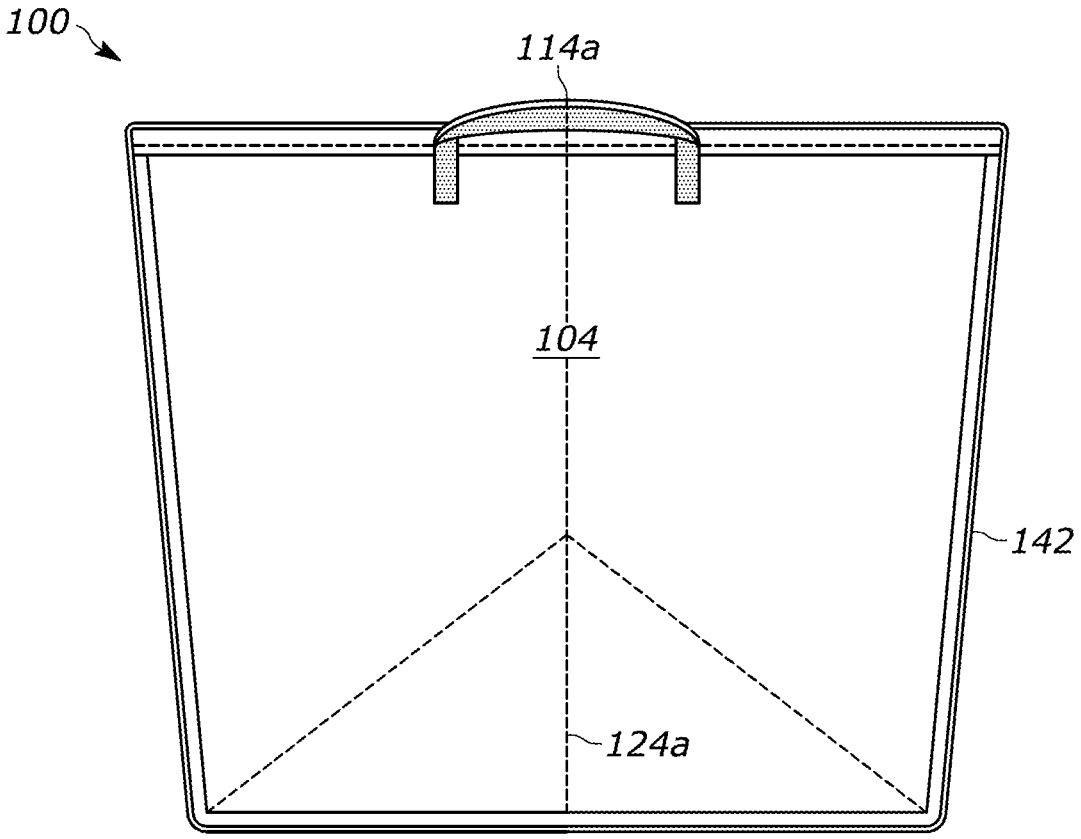
FIG. 8 is a front view of the liner of FIG. 7.
Figure 9:
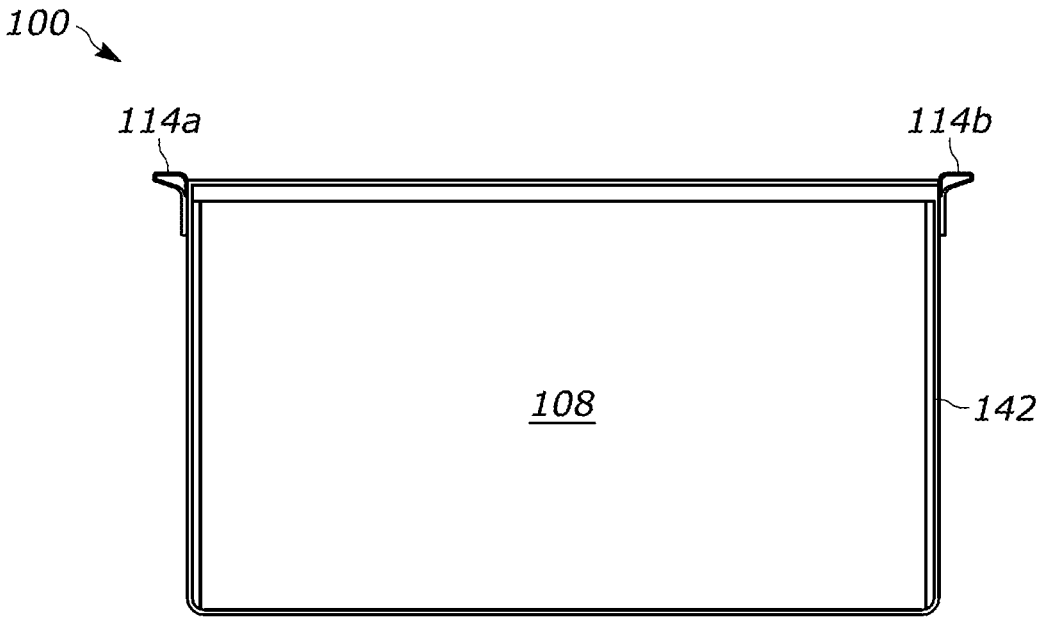
FIG. 9 is a side view of the liner of FIG. 7.
Figure 10:
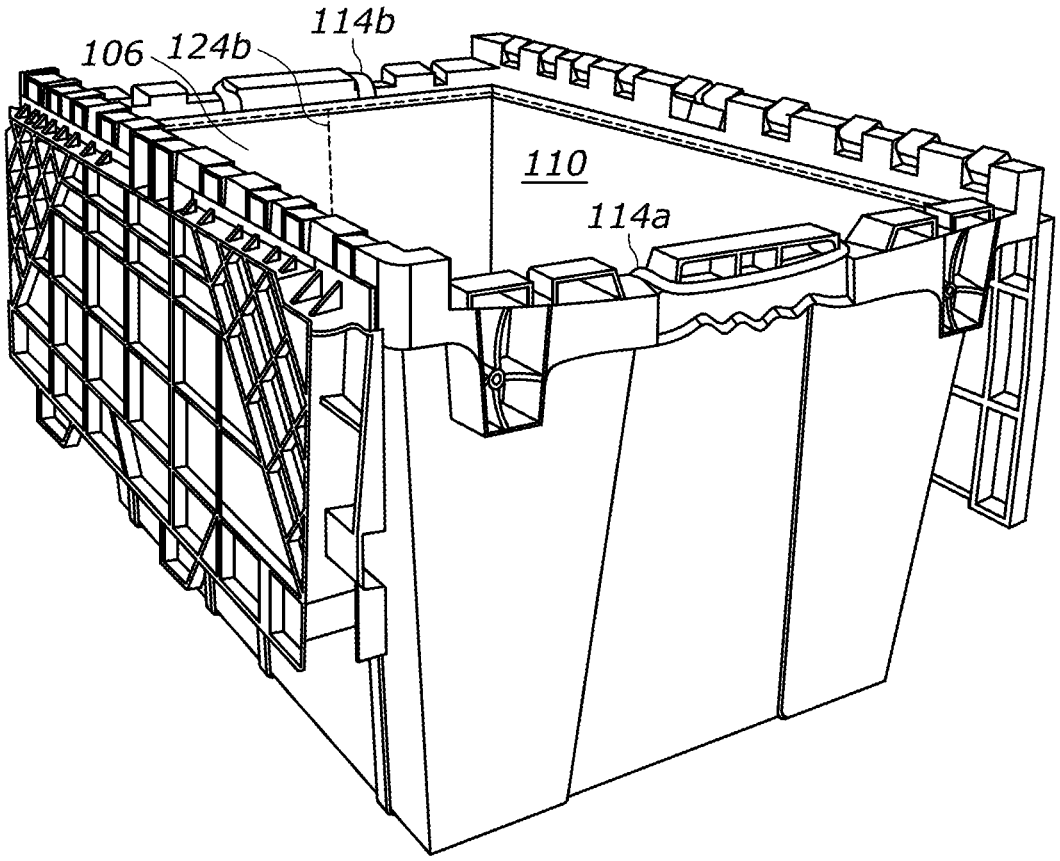
FIG. 10 is a perspective view of the liner of FIG. 7 fully inserted into a crate.

In an embodiment, the liner 100 is temperature-controlled so as to maintain the temperature of the items stored or transported within the liner 100. FIG. 6 depicts a cross-sectional illustration of the side walls 108, 110, and the base panel 102 (not shown to scale). In an embodiment, the same four layers comprise the front wall 104, the rear wall 106, the base panel 102, and the side walls 108, 110. The exterior layer 132 comprises a protective, relatively strong and durable synthetic or natural material such as a fabric, canvas, nylon, coated polyester, or the like. In an embodiment, the exterior layer 132 includes an aluminizing material or coating to better reflect and disperse radiation (such as heat) away from the liner 100. The interior layer 138 comprises a waterproof material, such as polyethylene vinyl acetate (PEVA), or a plastic foil material. The outer middle layer 134 comprises a rigid or semi-rigid material, such as polyethylene (PE) board or PE-coated paperboard, to provide support for the liner 100. The inner middle layer 136 comprises a material for maintaining the temperature of the cavity of the liner 100 and any items located therein (e.g., by either cooling or heating). As shown in FIG. 6, in an embodiment, the inner middle layer 136 comprises a gel pack comprising an outer wrapper or envelope of flexible or pliable material such as plastic film which is filled with and surrounds an insulating, nontoxic gel material, which may be any such material known to those of skill in the art, such as silica gel. The amount of fill of the gel material is such that the gel pack is substantially flattened in shape. In some embodiments (not shown), an additional layer comprises insulation, such as cotton insulation, an insulating foam, a rigid or semi-rigid polyurethane foam, a soft polyurethane foam, or a high-density polyethylene (HDPE) foam. In an embodiment, the insulation layer comprises a layer of insulation that is 2 centimeters thick. As will be clear to one of skill in the art from the present disclosure, in alternative embodiments, the structure of the walls 104, 106, 108, 110 may be varied to either include additional layers (such as by including additional layers of insulation) or omit layers (such as by omitting the outer middle layer 134 to provide a soft-sided liner).

As shown, the exterior layer 132, the outer middle layer 134, the inner middle layer 136, and the interior layer 138 of adjacent wall panels are connected together, for example by side seams or lines of stitching 142 at the intersections of the side walls 108, 110 with the front wall 104, the base panel 102, and the rear wall 106. In an embodiment, the front wall 104, the side walls 108, 110, and the rear wall 106 comprise a single continuous length of multiple layered wall panel material with one or more discrete gel packs forming the inner middle layer 136 in the front wall 104 and the rear wall 106. Multiple discrete gel packs may be used for the inner middle layer 136. As shown, a single gel pack is located in each of the side walls 108, 110, with each gel pack extending substantially between the front wall 104 and the rear wall 106. In an embodiment (not shown), a pair of gel packs are located in each of the front wall 104 and the rear wall 106, such that one gel pack is located in each of the spaces between the crease 124*a*, 124*b* and each of the side walls 108, 110. The crease 124*a*, 124*b* is formed by thermal welding, side seams, or lines of stitching extending through the exterior layer 132, the outer middle layer 134, and the interior layer 138 such that the separation between the gel packs in the side walls 108, 110 is maintained. In alternative embodiments, other structures of gel packs may be used. By way of example, a plurality of discrete gel packs may be located in each wall 104, 106, 108, 110, such as by using a grid of spaced-apart gel packs. Alternatively, each layer may stretch continuously around the liner 100 (i.e., inner middle layer 136 may be formed from a single continuous gel pack).

In an embodiment, as shown in FIG. 6, the base panel 102 comprises only the exterior layer 132 and the interior layer 138. An interior flap 128 sits adjacent to the base panel 102 and is affixed to one of the side walls 108 or 110 so as to allow the interior flap 128 to fold upward against the side wall 108 or 110 when the liner 100 is collapsed. Like the view shown in FIG. 6, the interior flap 128 comprises a shell, formed of a waterproof material such as polyethylene vinyl acetate (PEVA) or a plastic foil material, surrounding a first inner layer proximate the cavity of the liner 100 comprising a gel pack such as that used in the inner middle layer 136 and a second inner layer comprising a rigid or semi-rigid material, such as polyethylene (PE) board or PE-coated paperboard. In an embodiment, a pull tab 130 is attached to the interior flap 128 to enable the interior flap 128 to be easily folded against the rear wall 106. In alternative embodiments, the interior flap 128 is attached to one of the front wall 104, the side wall 108, or the side wall 110, permitting the interior flap 128 to fold against the respective wall 104, 108, 110. In alternative embodiments, the interior flap 128 omits the second inner layer and/or the base panel 102 includes an additional layer comprising a rigid or semi-rigid material, such as polyethylene (PE) board or PE-coated paperboard.

Freezable Crate Liner with Multiple Gel Pack Base

Figure 11:
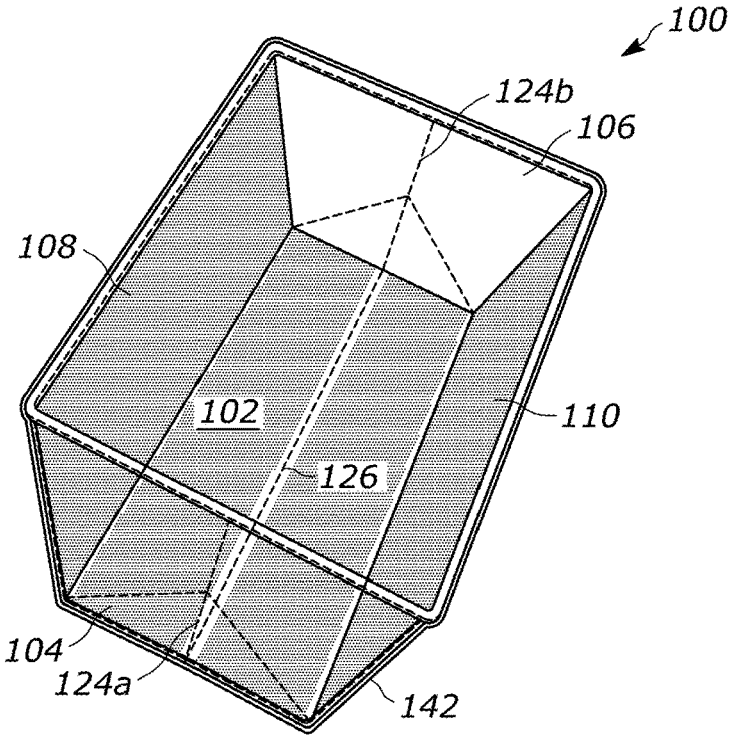
FIG. 11 is a top perspective view of the liner of FIG. 7.
Figure 12:
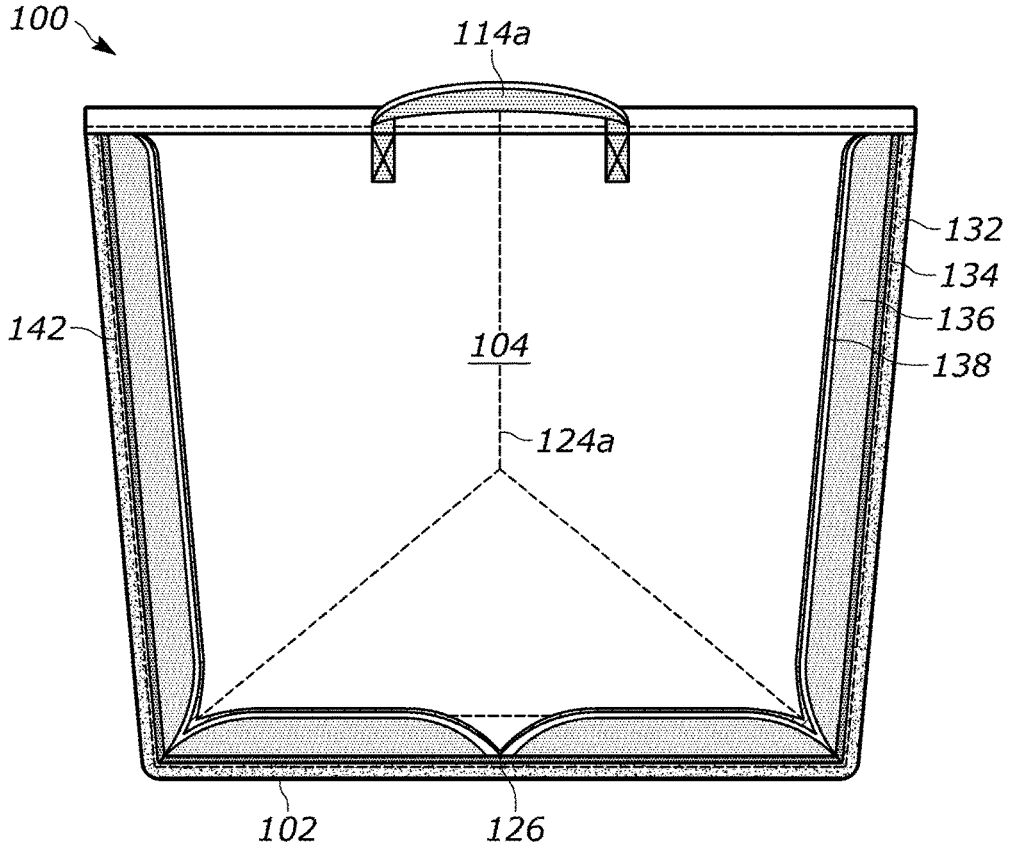
FIG. 12 is an expanded view showing the internal structure of the walls of the liner of FIG. 7.

FIGS. 7 through 11 illustrate a second embodiment of the liner 100 that further comprises an alternative configuration for the base panel 102. The base panel 102 comprises substantially the same layered structure as the other walls, and each includes at least one gel pack in the inner middle layer 136. As shown in FIG. 11, the base panel 102 contains a plurality of discrete gel packs separated by the crease 126, such that one gel pack is located in the base panel 102 in the area between the side wall 108 and the crease 126, and a second gel pack is located in the base panel 102 in the area between the side wall 110 and the crease 126. The crease 126 is formed by thermal welding, side seams, or lines of stitching extending through the exterior layer 132, the outer middle layer 134, the inner middle layer 136, and the interior layer 138 such that the separation between the gel packs in the side walls 108, 110 is maintained. In alternative embodiments, other structures of gel packs may be used. By way of example, a plurality of discrete gel packs may be located in the base panel 102, such as by using a grid of spaced-apart gel packs. Alternatively, each layer may stretch continuously around the liner 100 (i.e., inner middle layer 136 may be formed from a single continuous gel pack). In an alternative embodiment, the base panel 102 omits the inner middle layer 138 and does not contain any gel packs. In other alternative embodiments, the base panel 102 also omits the outer middle layer 134 to better allow the base panel 102 to fold inward when the liner 100 is folded.

Freezable Crate Liner with Front and Rear Lids with Gussets

Figure 13:
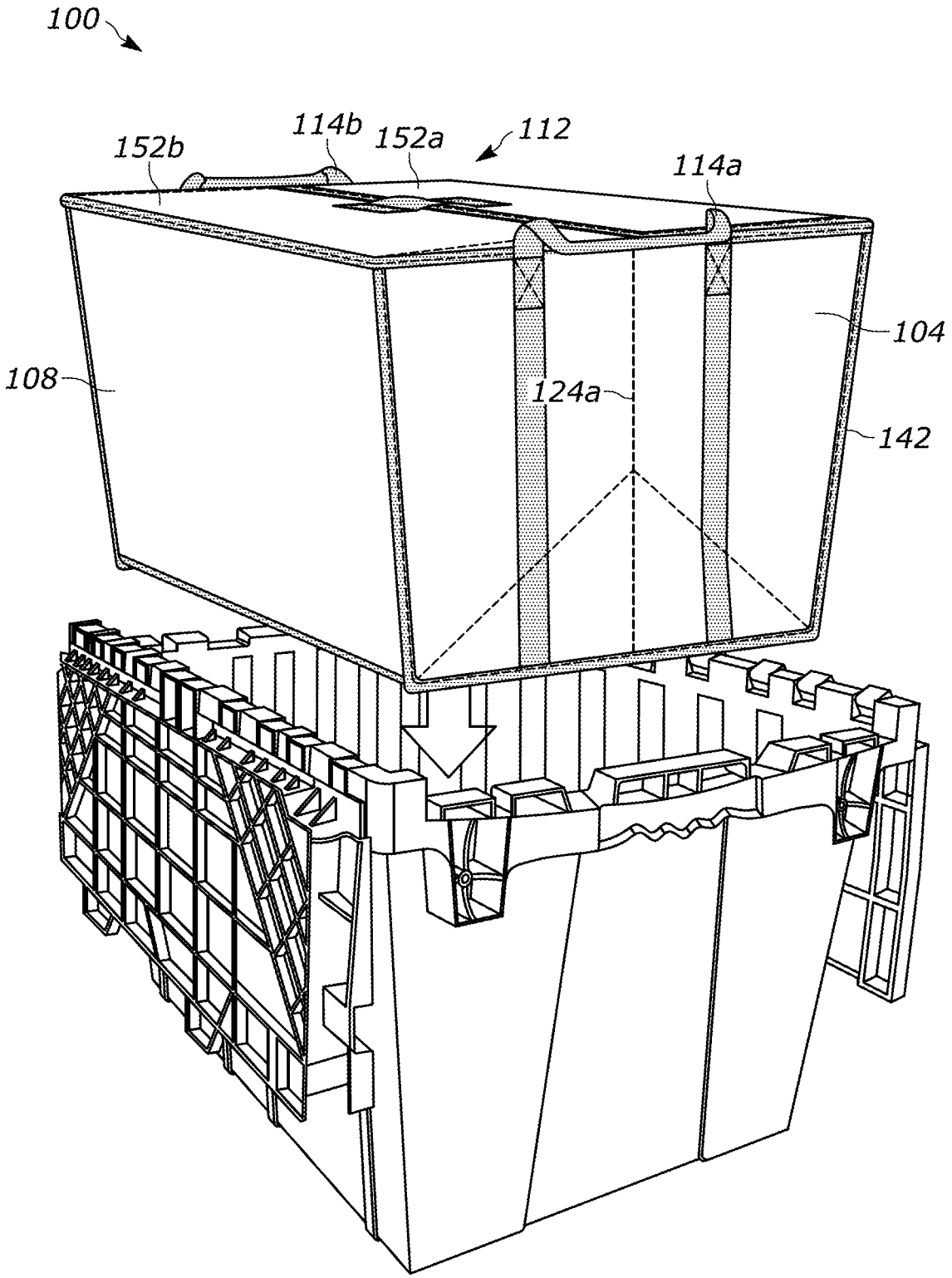
FIG. 13 is a perspective view of a third embodiment of a crate liner.
Figure 14:
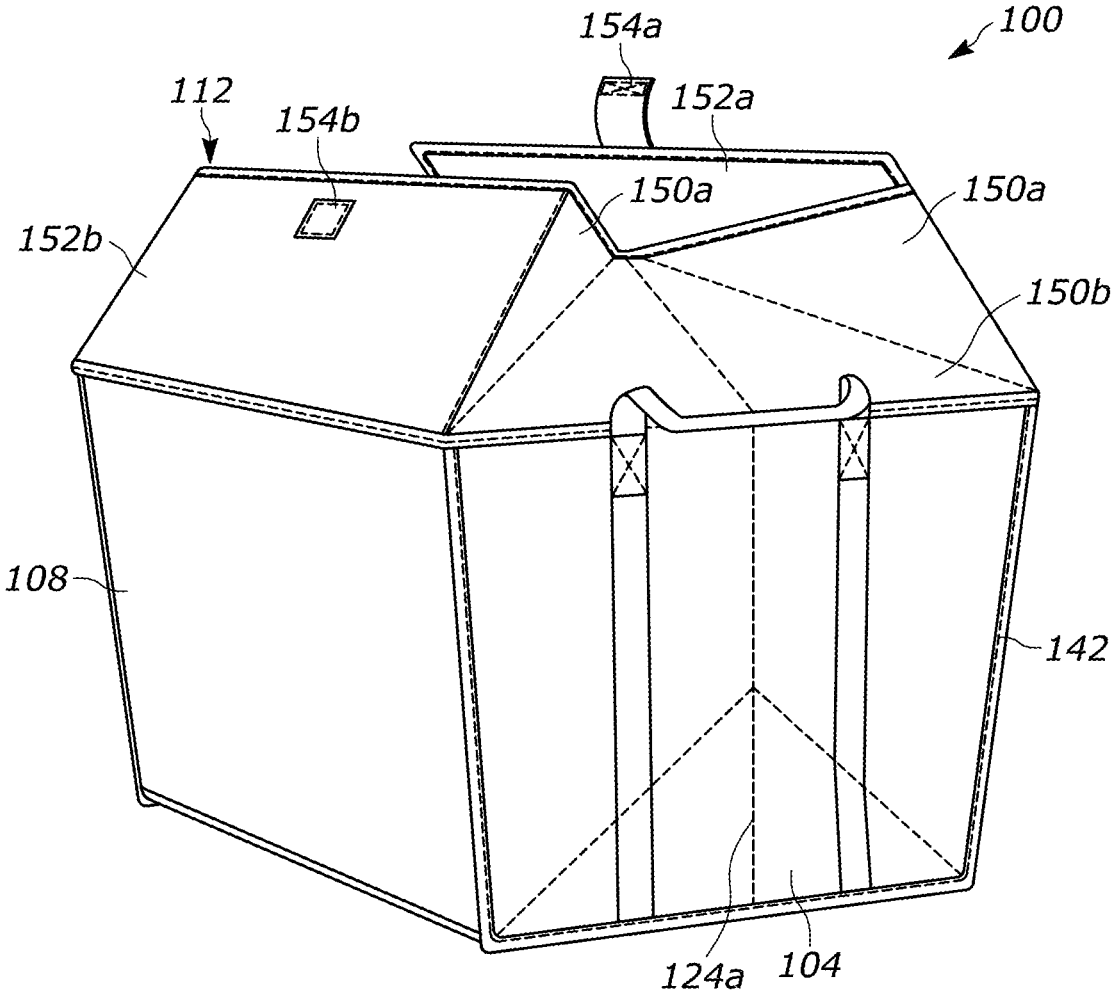
FIG. 14 is a perspective view of the liner of FIG. 13 with the lid partially raised.

In a third embodiment of the liner 100, as shown in FIGS. 13 and 14, which comprises a lid configuration, lid gussets 150*a*, 150*b* extend from the front wall 104 and the rear wall 106, and front and back lids 152*a*, 152*b* extend from the opposing side walls 108, 110 such that when the front and back lids 152*a*, 152*b* are folded over the cavity, the lid gussets 150*a*, 150*b* collapse into the cavity of the liner 100 and provide support to the front and back lids, as is shown in FIG. 13. Alternatively, as shown in FIG. 14, when the front and back lids 152*a*, 152*b* are not folded over the cavity, the lid gussets 150*a*, 150*b* provide tension against the front and back lids 152*a*, 152*b*, thereby freeing the opening of the cavity of the liner 100 while it is being filled. The lid gussets 150*a*, 150*b* comprise the same three layers, specifically, an interior layer 138, a rigid middle layer 134, and an exterior layer 132 where the rigid middle layer substantially fills the space within the bounds of the lid gussets 150*a*, 150*b* and the seams connecting the lid gussets 150*a*, 150*b* are formed by thermal welding, side seams, or lines of stitching extending through the exterior layer 132 and the interior layer 138 such that the separation between the rigid middle layer 138 of each lid gusset 150*a*, 150*b* is maintained. In alternative embodiments, other layer configurations of the lid gussets 150*a*, 150*b* are contemplated, such as omitting the rigid middle layer 138, including an insulation layer in addition to or in place of the rigid middle layer 138, or including at least one gel pack in the middle layer. As shown in FIG. 14, in an embodiment, the front and back lids 152*a*, 152*b* each contain a latching mechanism 154*a*, 154*b*, such as a hook-and-loop fastener, on the exterior of the lids, respectively, so as to provide additional insulation and prevent the lids 152*a*, 152*b* from being inadvertently lifted while the liner 100 is in use.

Other configurations of a lid 112 are also contemplated, including an embodiment where a lid 112 is attached to the rear wall 106 such that the lid 112 may be folded away from the side walls 108, 110 and the front wall 104 to permit access to the cavity within the liner. In alternative embodiments, the lid 112 may be movably attached to a different one or more of the walls 104, 106, 108, 110 or may be removably attached to multiple of the walls 104, 106, 108, 110. In an embodiment, a flap extends from a lid 112 towards the base panel 102 such that the flap 122 overlaps the portion of the walls 108, 110, 104 proximate the lid 112.

Freezable Crate Liner with Front and Rear Lids with Flat Pocket

FIGS. 15 through 18 illustrate a fourth embodiment of a liner 1500 comprising walls 104, 106, 108, 110, base 102, front lid 1502 and rear lid 1504.

In an embodiment, the liner 1500 is temperature-controlled so as to maintain the temperature of the items stored or transported within the liner 1500. FIGS. 15B, 15E, 15F, 16, 17B, 17E, 17F, and 18 depict cross-sectional illustrations of the front wall 104, the rear wall 106, and the base panel 102 (not shown to scale). In an embodiment, the same four layers-namely, interior layer 138, inner middle layer 136, outer middle layer 134, and exterior layer 132-comprise the front wall 104, the rear wall 106, the base panel 102, and the side walls 108, 110. The interior layer 138 (which is proximate the interior cavity of the liner) comprises a waterproof material, such as polyethylene vinyl acetate (PEVA), or a plastic foil material. The inner middle layer 136 comprises a material for maintaining the temperature of the cavity of the liner 1500 and any items located therein (e.g., by either cooling or heating). As shown in FIGS. 15B, 15E, 15F, 16, 17B, 17E, 17F, and 18, in an embodiment, the inner middle layer 136 comprises a gel pack comprising an outer wrapper or envelope of flexible or pliable material such as plastic film which is filled with and surrounds an insulating, nontoxic gel material, which may be any such material known to those of skill in the art, such as silica gel. The amount of fill of the gel material is such that the gel pack is substantially flattened in shape. In some embodiments (not shown), an additional layer comprises insulation, such as cotton insulation, an insulating foam, a rigid or semi-rigid polyurethane foam, a soft polyurethane foam, or a high-density polyethylene (HDPE) foam. In an embodiment, the insulation layer comprises a layer of insulation that is 2 centimeters thick. The outer middle layer 134 comprises a rigid or semi-rigid material, such as polyethylene (PE) board or PE-coated paperboard, to provide support for the liner 1500. The exterior layer 132 comprises a protective, relatively strong and durable synthetic or natural material such as a fabric, canvas, nylon, coated polyester, or the like. In an embodiment, the exterior layer 132 includes an aluminizing material or coating to better reflect and disperse radiation (such as heat) away from the liner 1500. As will be clear to one of skill in the art from the present disclosure, in alternative embodiments, the structure of the walls 104, 106, 108, 110 may be varied to either include additional layers (such as by including additional layers of insulation) or omit layers (such as by omitting the outer middle layer 134 to provide a soft-sided liner).

Figures 15A, 15B, 15C, 15D, 15E, 15F, 15G, 15H, 15I, 15J:
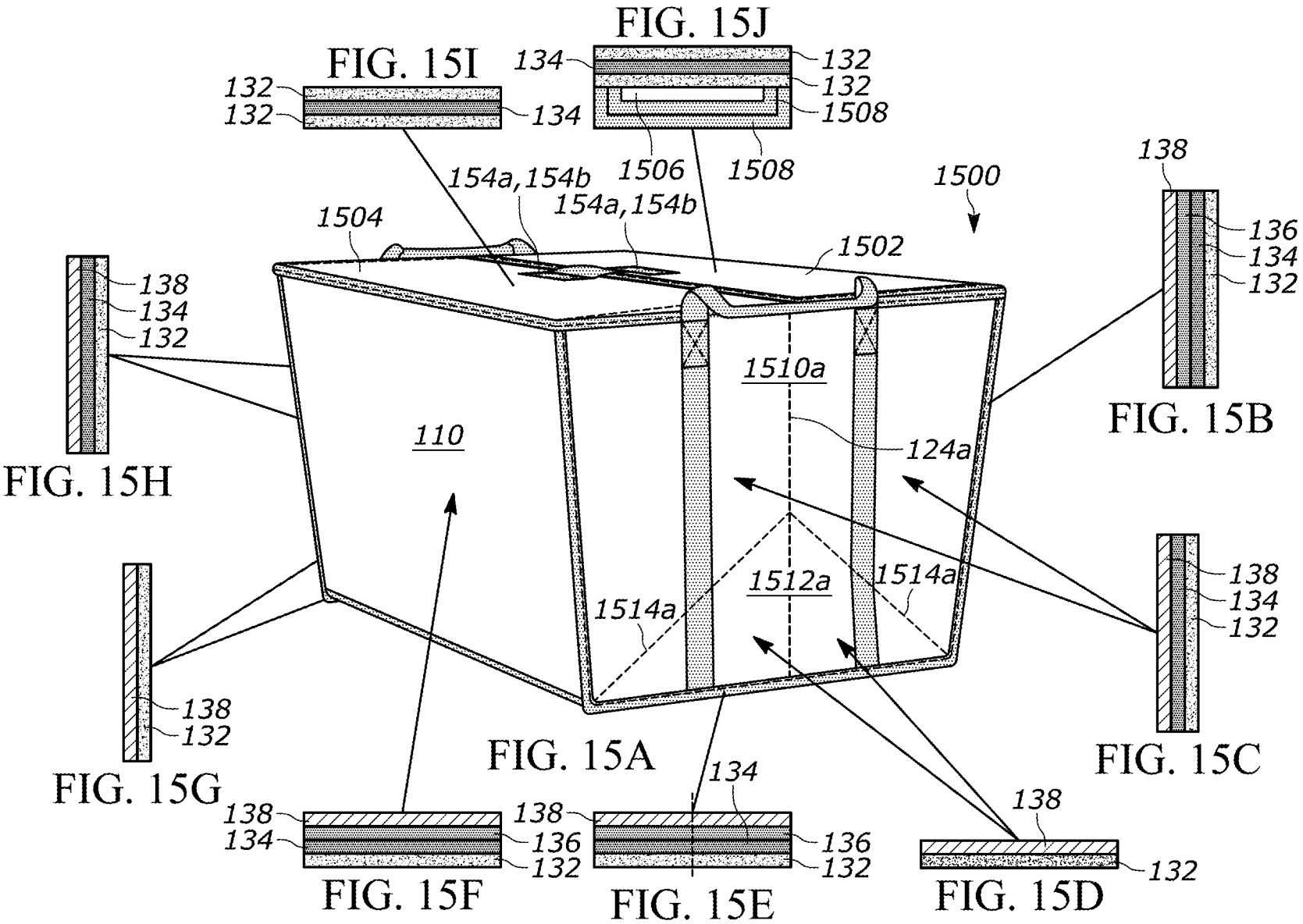
FIG. 15A is a perspective view of a fourth embodiment of a crate liner.
FIG. 15B is a cross-sectional view of the side wall shown in FIG. 15A.
FIG. 15C is a cross-sectional view of the upper portion of the rear wall shown in FIG. 15A.
FIG. 15D is a cross-sectional view of the gusset portion of the rear wall shown in FIG. 15A.
FIG. 15E is a cross-sectional view of the base panel shown in FIG. 15A.
FIG. 15F is a cross-sectional view of the side wall shown in FIG. 15A.
FIG. 15G is a cross-sectional view of the gusset portion of the front wall shown in FIG. 15A.
FIG. 15H is a cross-sectional view of the upper portion of the front wall shown in FIG. 15A.
FIG. 15I is a cross-sectional view of the non-pocketed flap of the lid shown in FIG. 15A.
FIG. 15J is a cross-sectional view of the pocketed flap of the lid shown in FIG. 15A.
Figures 17A, 17B, 17C, 17D, 17E, 17F, 17G, 17H:
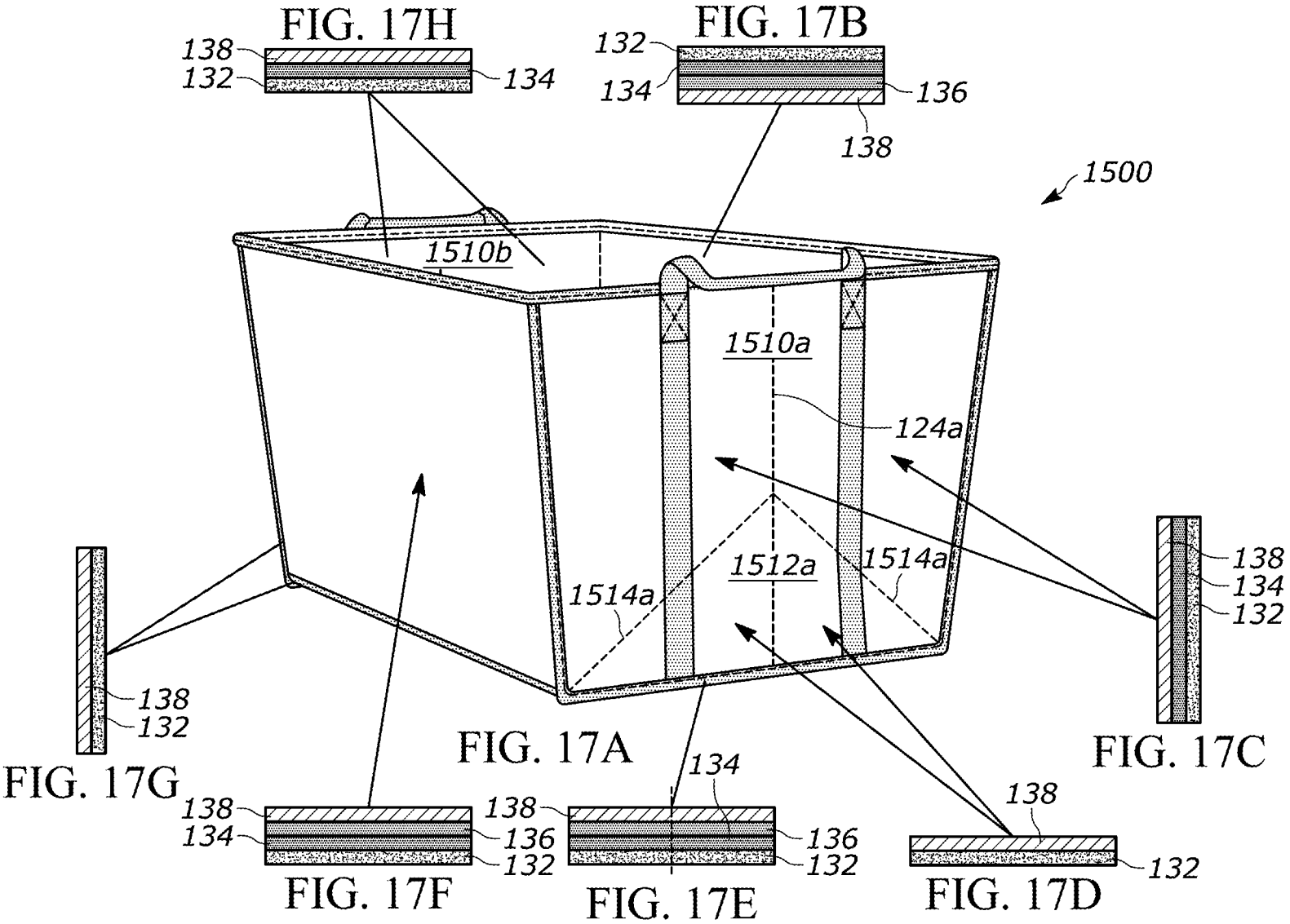
FIG. 17A is a perspective view of an alternative embodiment of the liner of FIG. 15A.
FIG. 17B is a cross-sectional view of the side wall shown in FIG. 17A.
FIG. 17C is a cross-sectional view of the upper portion of the rear wall shown in FIG. 17A.
FIG. 17D is a cross-sectional view of the gusset portion of the rear wall shown in FIG. 17A.
FIG. 17E is a cross-sectional view of the base panel shown in FIG. 17A.
FIG. 17F is a cross-sectional view of the side wall shown in FIG. 17A.
FIG. 17G is a cross-sectional view of the gusset portion of the front wall shown in FIG. 17A.
FIG. 17H is a cross-sectional view of the upper portion of the front wall shown in FIG. 17A.
Figure 18:
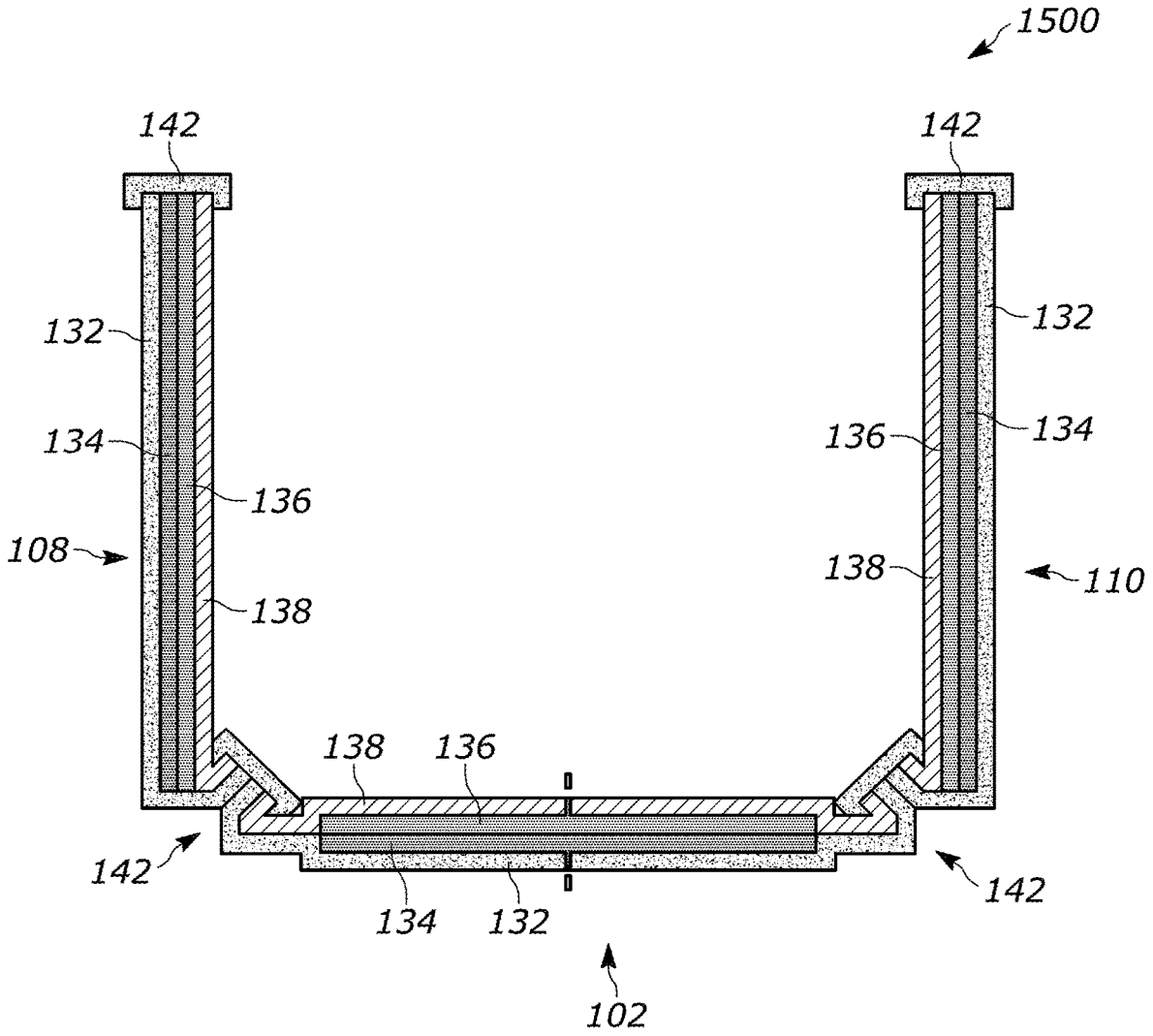
FIG. 18 is an expanded view showing the internal structure of the walls of the liner of FIG. 17A.

As shown in FIGS. 15A and 17A, in an embodiment, vertical creases 124*a*, 124*b* extend along the front wall 104 and the rear wall 106 from proximate the base panel 102 to proximate the opening of the cavity to facilitate folding of the front wall 104 and the rear wall 106 when the liner 1500 is collapsed. In an embodiment, the structure of these vertical creases 124*a*, 124*b* differ from that of the remainder of the front wall 104 and the rear wall 106. Specifically, in an embodiment the vertical creases 124*a*, 124*b* comprise only exterior layer 132 and interior layer 138 while the remainder of the side walls 108, 110 comprise interior layer 138, inner middle layer 136, outer middle layer 134, and exterior layer 132. The omission of the outer middle layer and the inner middle layer from the vertical creases 124*a*, 125*b* increases the pliability of the vertical creases and enables the front wall 104 and the rear wall 106 to fold more readily about the vertical creases. The base panel 102 also includes one or more creases 126 to facilitate folding the base panel 102. As with the vertical creases, in an embodiment, the structure of these one or more creases 126 differ from that of the remainder of the base panel 102 in that the one or more creases 126 comprise only exterior layer 132 and interior layer 138 while the remainder of the base panel 102 comprises interior layer 138, inner middle layer 136, outer middle layer 134, and exterior layer 132. To collapse the liner 1500, the base panel 102 is folded into the liner 1500 along the creases 126 while the front wall 104 and the rear wall 106 are folded into the liner 1500 along creases 124*a*, 124*b* such that the the side walls 108, 110 are moved towards each other. In the embodiment shown in FIGS. 15A and 17A, additional creases 1514*a*, 1514*b* extend along the front wall 104 and the rear wall 106 from proximate the base wall 102 to proximate the vertical creases 124*a*, 124*b* thereby separating the front wall 104 and the rear wall 106 into an upper portion 1510*a*, 1510*b* and a lower gusseted portion 1512*a*, 1512*b* to facilitate folding the front wall 104 and the rear wall 106 into the liner 1500. As shown in FIGS. 15C, 15H, 17C, and 17H, the upper portion 1510*a*, 1510*b* of the front wall 104 and the rear wall 106 comprises an exterior layer 132, a rigid interior layer 134, and an interior layer 138. In alternative embodiments, other configurations are contemplated, such as by including an additional insulation or temperature control layer. As shown in FIGS. 15D, 15G, 17D, and 17G, the lower gusseted portion 1514*a*, 1514*b* of the front wall 104 and the rear wall 106 comprises an exterior layer 132 and an interior layer 138. In alternative embodiments, other configurations are contemplated, such as by including additional rigid, insulation, or temperature control layers. In some embodiments (not shown), the liner 1500 is secured in the collapsed configuration by using clips or other attachment means (such as hook-and-loop fasteners).

As shown, in an embodiment the exterior layer 132 and the interior layer 138 of adjacent wall panels are connected together at the intersections of the side walls 108, 110 with the front wall 104, the base panel 102, the rear wall 106, front lid 1502 and rear lid 1504. In an embodiment, these connections are made via lines of stitching 142. In alternative embodiments, these connections made be made by other methods including heat welding. In an embodiment, each of the front wall 104, the side walls 108, 110, and the rear wall 106 comprise a single continuous length of multiple layered wall panel material with one or more discrete gel packs forming the inner middle layer 136 in each wall. Multiple discrete gel packs may be used for the inner middle layer 136. As shown, a single gel pack is located in each of the side walls 108, 110, with each gel pack extending substantially between the front wall 104 and the rear wall 106. In an embodiment (not shown), a pair of gel packs are located in each of the front wall 104 and the rear wall 106, such that one gel pack is located in each of the spaces between the crease 124*a*, 124*b* and each of the side walls 108, 110. The crease 124*a*, 124*b* is formed by thermal welding, side seams, or lines of stitching extending through the exterior layer 132, the outer middle layer 134, the inner middle layer 136, and the interior layer 138 such that the separation between the gel packs in the side walls 108, 110 is maintained. In alternative embodiments, other structures of gel packs may be used. By way of example, a plurality of discrete gel packs may be located in each wall 104, 106, 108, 110, such as by using a grid of spaced-apart gel packs. Alternatively, each layer may stretch continuously around the liner 1500 (i.e., inner middle layer 136 may be formed from a single continuous gel pack).

Figure 16:
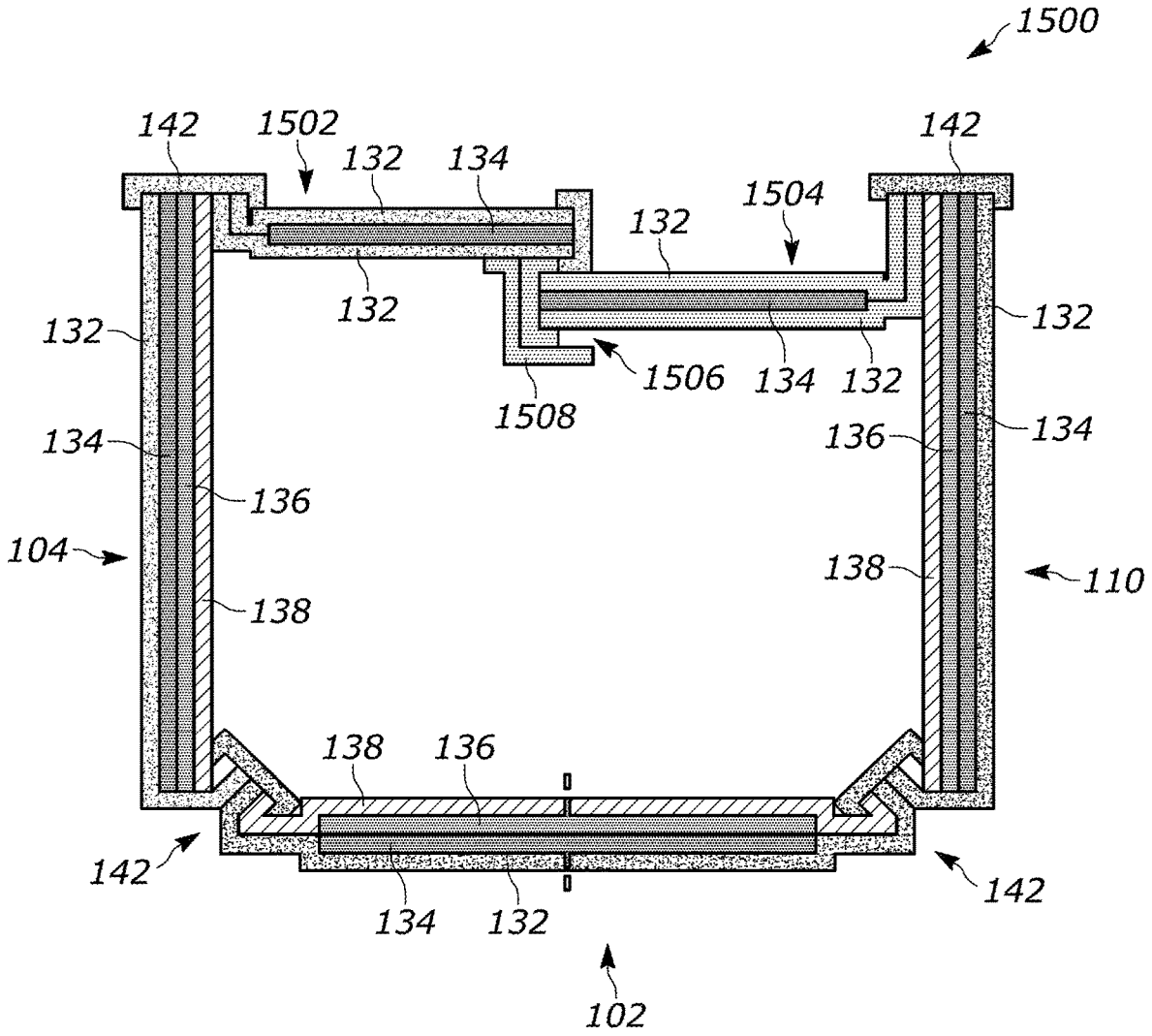
FIG. 16 is an expanded view showing the internal structure of the walls and lid of the liner of FIG. 15A.

In an embodiment, as shown in FIG. 15A, the liner further comprises a front lid 1502 and a rear lid 1504 movably attached to the side walls 108, 110, respectively. In the embodiment shown in FIG. 15A, as shown in FIGS. 15I and 16, the front lid 1502 and the rear lid 1504 each comprise a rigid interior layer 134 placed between two layers of exterior material 132. In the embodiment shown in FIG. 15A, as further shown in FIGS. 15J and 16, the front lid 1502 comprises an additional flap of two layers of material 1508 affixed to the bottom of the front lid 1502 so as to form a pocket 1506 with an opening proximate the second lid flap 1502 when the front lid 1502 and rear lid 1504 are closed. Other configurations of flap 1508 are also contemplated, such as the inclusion of additional insulation or rigid layers. The pocket 1506 extends substantially the width of the front lid 1502. In the embodiment shown in FIGS. 15A and 16, the rear lid 1504 is of a length such that, when the front lid 1502 and rear lid 1504 are closed, at least a terminal portion of the rear lid 1504 may be inserted into the pocket 1506 thereby creating an improved temperature seal and providing tension such that the front lid 1502 and rear lid 1504 do not fall into the cavity of the liner 1500. In an embodiment, the rear lid 1504 comprises rounded corners so as to facilitate insertion into the pocket 1506. Alternatively, in an embodiment, the rear lid 1504 may be trapezoidal in shape such that the portion closes to the pocket 1506 is narrower than the width of the rear wall 106 the rear lid 1504 is attached to so as to facilitate insertion into the pocket 1506.

Other configurations of front lid 1502 and rear lid 1504 are also contemplated, including an embodiment wherein the front lid 1502 and rear lid 1504 may be attached to different one(s) of the walls 104, 106, 108, 110 or may be removably attached to multiple of the walls 104, 106, 108, 110. In an alternative embodiment the lid may further comprise gussets 150*a*, 150*b*, such as those shown in FIGS. 13 and 14, attached to the front lid 1502 and rear lid 1504 and the front wall 104 and the rear wall 106.

As shown in FIG. 15A, in an embodiment, the front lid 1502 and rear lid 1504 each contain a latching mechanism 154*a*, 154*b*, such as a hook-and-loop fastener, one or more magnets, etc., on the exterior of the lids, respectively, so as to provide additional insulation and prevent the front lid 1502 and rear lid 1504 from being inadvertently lifted while the liner 1500 is in use.

Freezable Crate Liner with Right and Left Lids and Lid Straps

FIGS. 19 through 29 illustrate a fifth embodiment of a liner 1900 comprising walls 104, 106, 108, 110, base 102, and right and left lids 1952*a*, 1952*b*.

Figure 19:
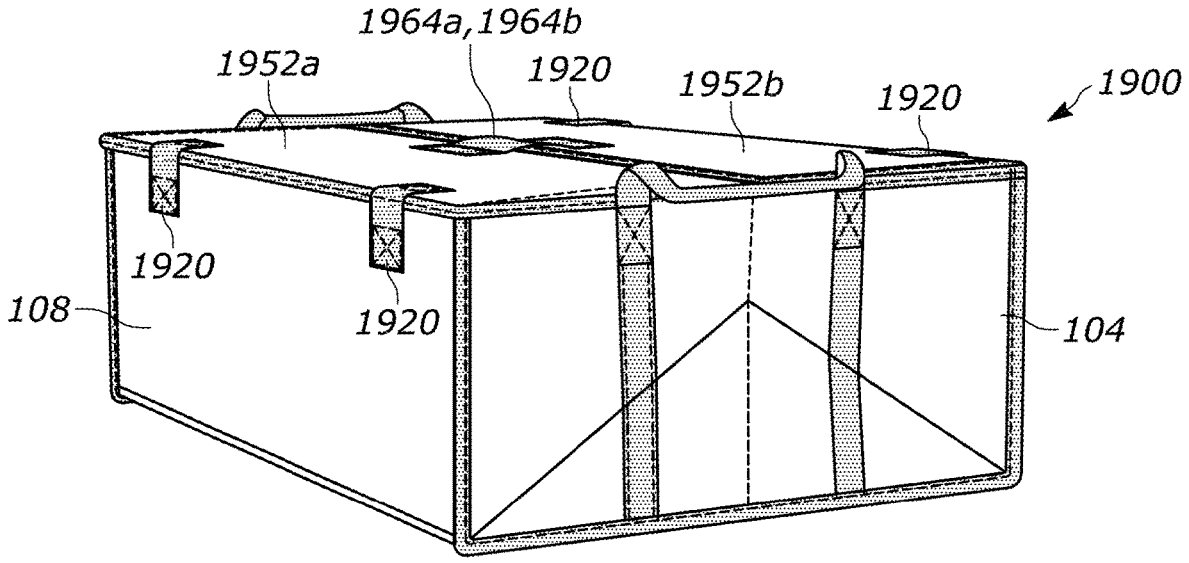
FIG. 19 is a perspective view of a fifth embodiment of a liner with the lid in a closed position.
Figure 20:
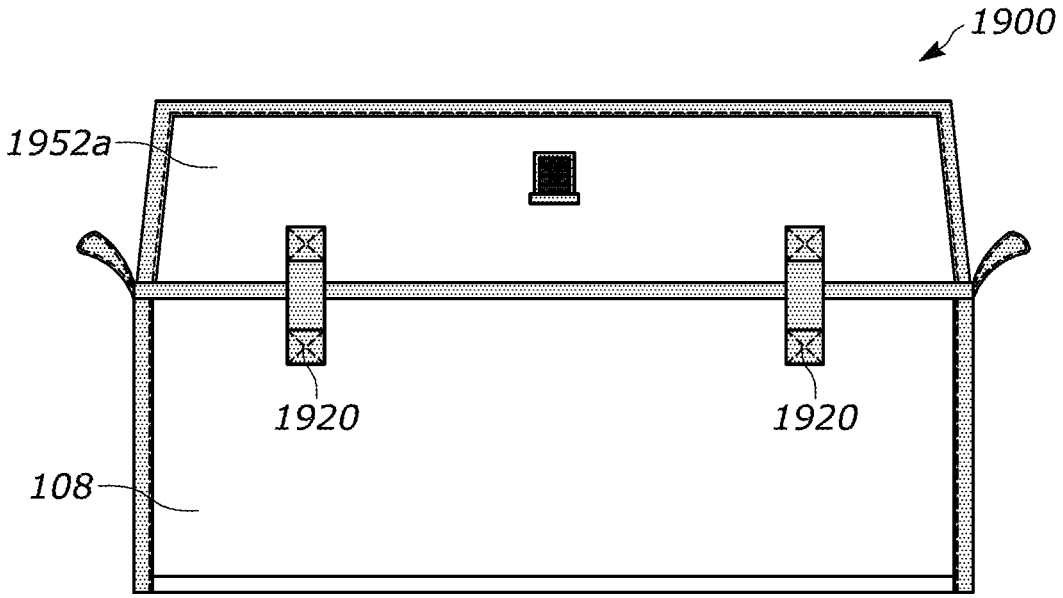
FIG. 20 is a side view of the liner of FIG. 19 with the lid raised.
Figure 21:
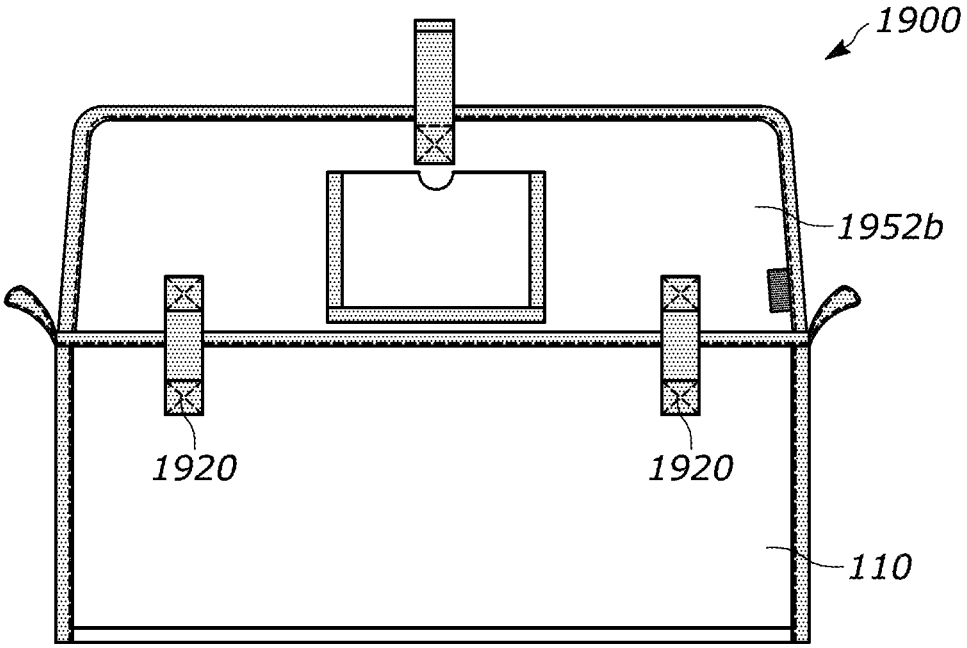
FIG. 21 is a side view of the liner of FIG. 19 with the lid raised.
Figure 22:
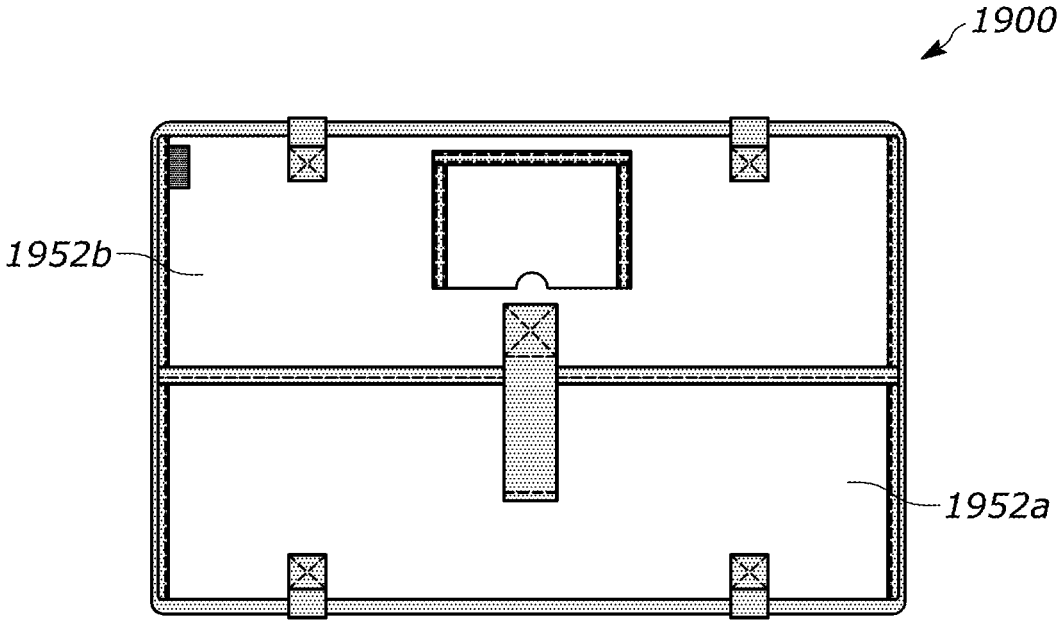
FIG. 22 is a top view of the liner of FIG. 19 with the lid in a closed position.
Figure 23:
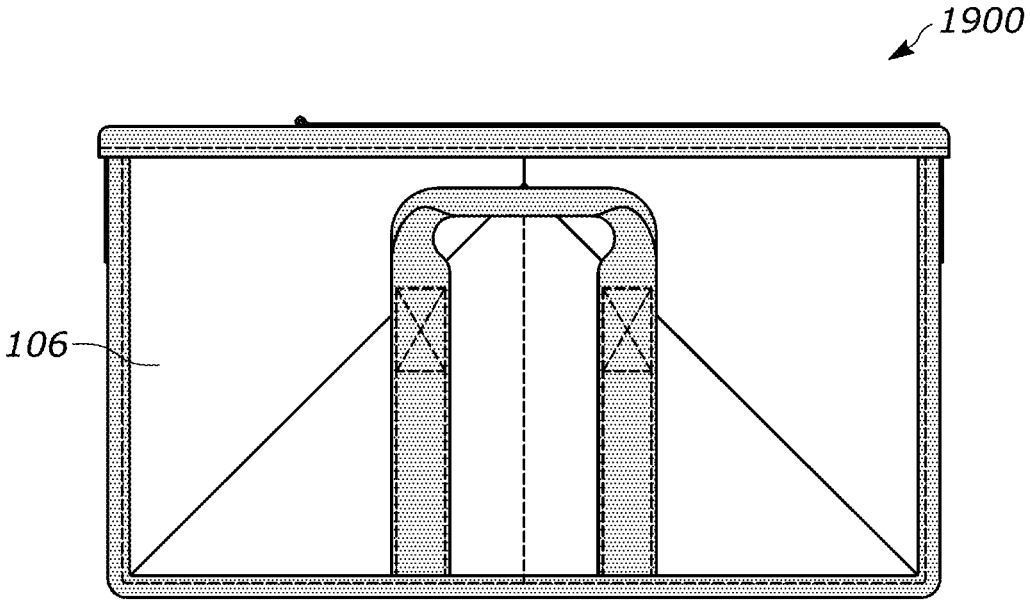
FIG. 23 is a rear view of the liner of FIG. 19 with the lid in a closed position.

As shown, the proportions and dimensions of the liner 1900 differ from those of the embodiments discussed above. The precise dimensions of the liner 1900 may be selected based on a number of factors, including the desired internal volume and, in embodiments in which the liner 1900 is intended to be used inside a separate container, the dimension of that separate container. Such variations are also expressly contemplated hereby. As shown in FIGS. 19 thorough 29, the walls 104, 106, 108, 110 may be shorter or taller than other embodiments, additionally, the length of the walls 104, 106, 108, 110 proximate the opening of the liner may be greater than or equal to the length of the walls 104, 106, 108, 110 proximate the base 102 to suit the parameters of the respective crates (i.e., rectangular in profile or wider at the opening).

Figure 24:
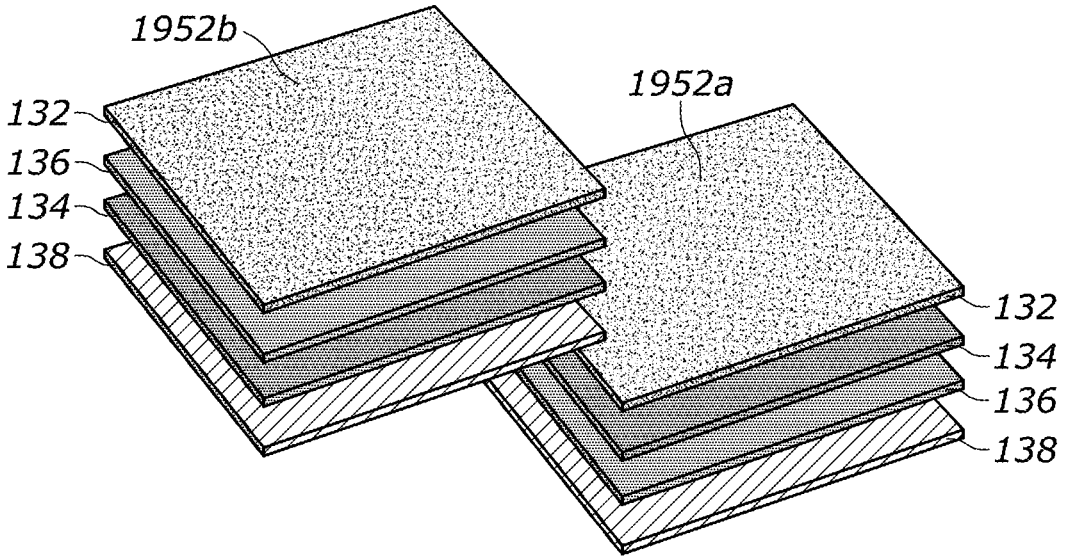
FIG. 24 a cross-sectional view of the overlapping lid flaps of the liner of FIG. 19.
Figure 25:
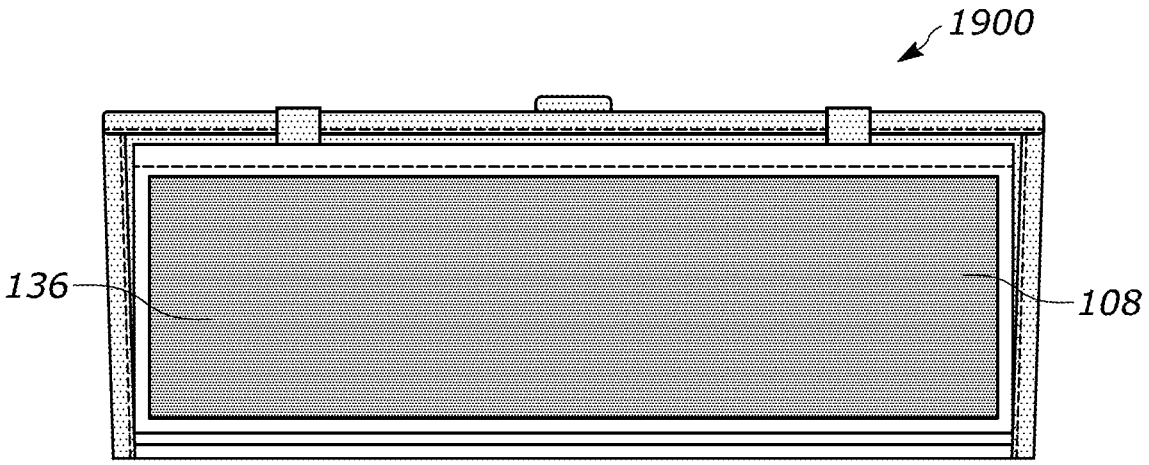
FIG. 25 is a side view of the liner of FIG. 19 showing the inner middle layer.
Figure 26:
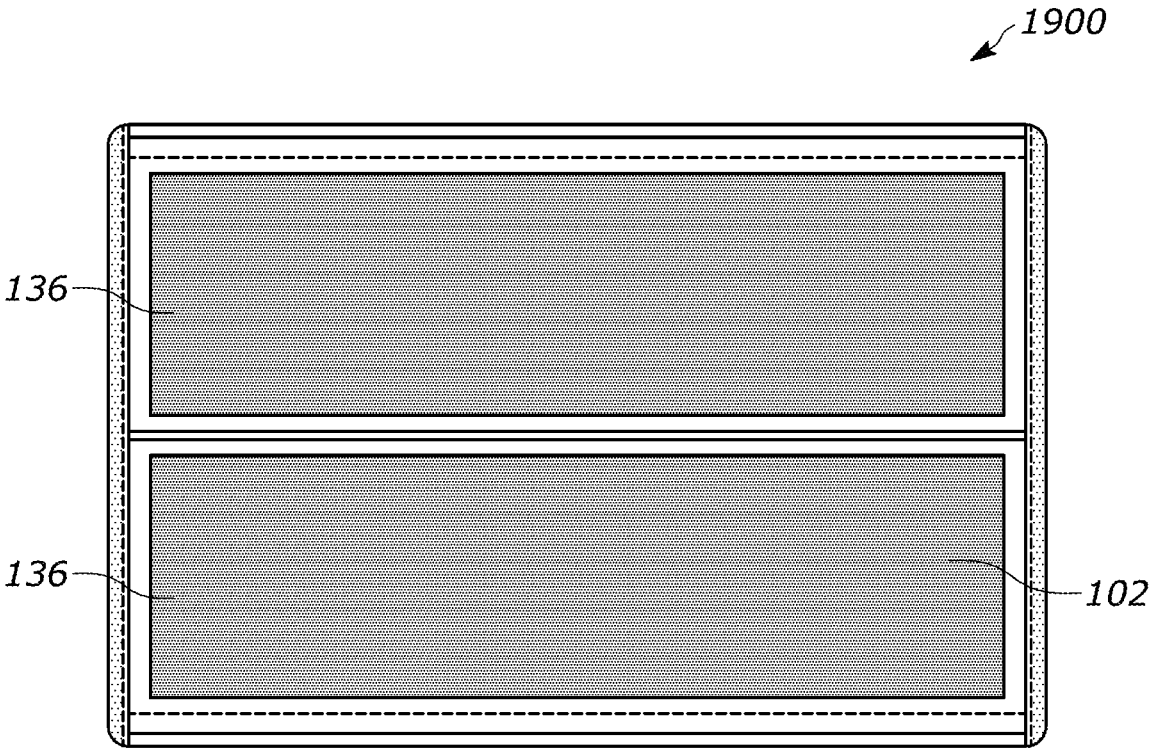
FIG. 26 is a bottom view of the liner of FIG. 19 showing the inner middle layer.
Figure 27:
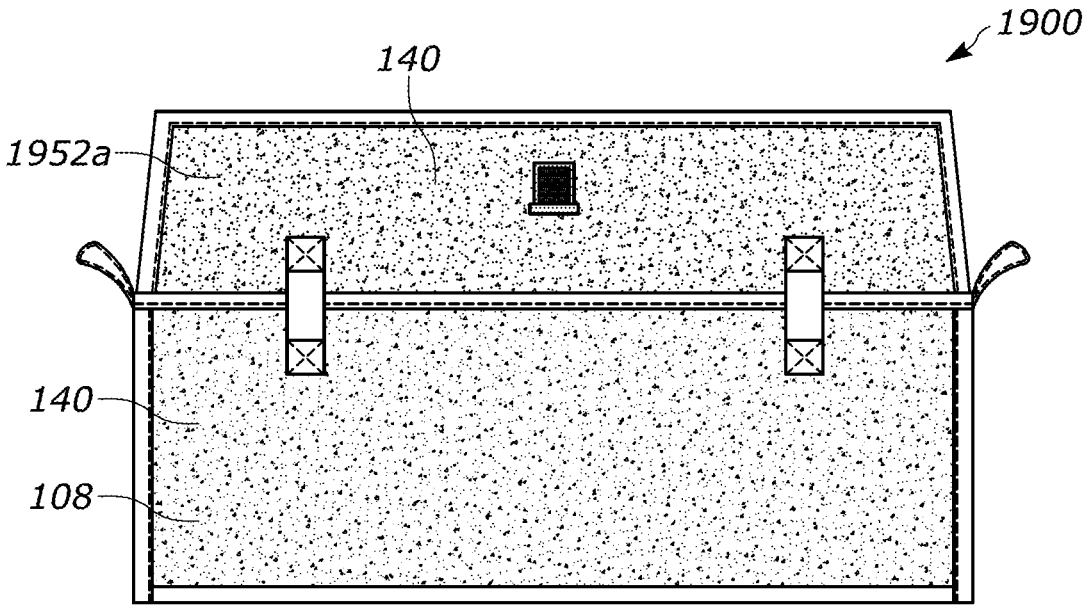
FIG. 27 is a side view of the liner of FIG. 19 showing the insulation layer.
Figure 28:
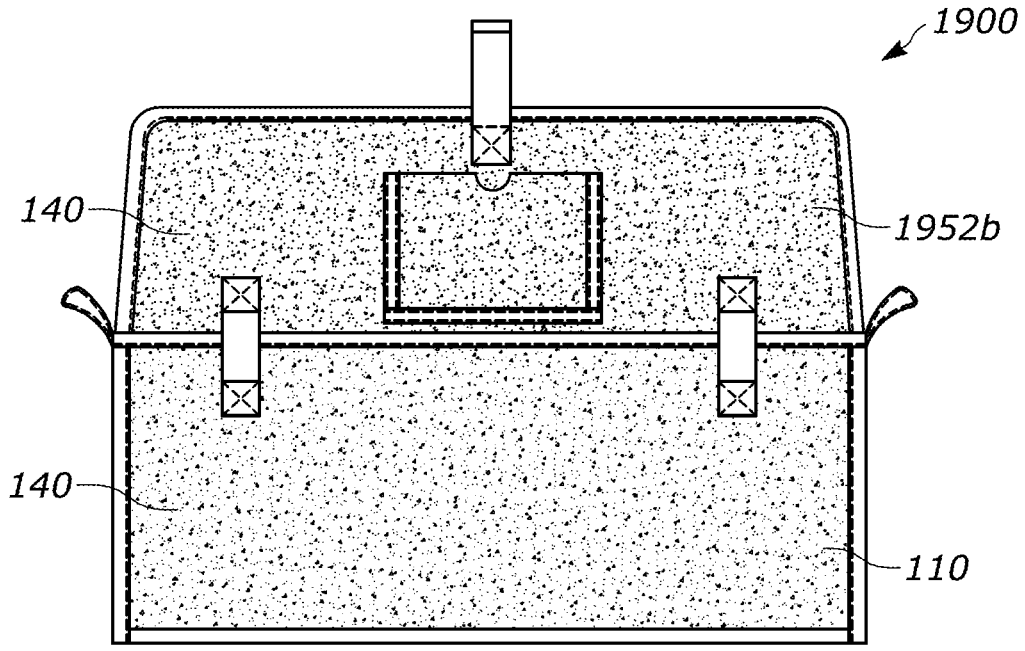
FIG. 28 is a side view of the liner of FIG. 19 showing the insulation layer.
Figure 29:
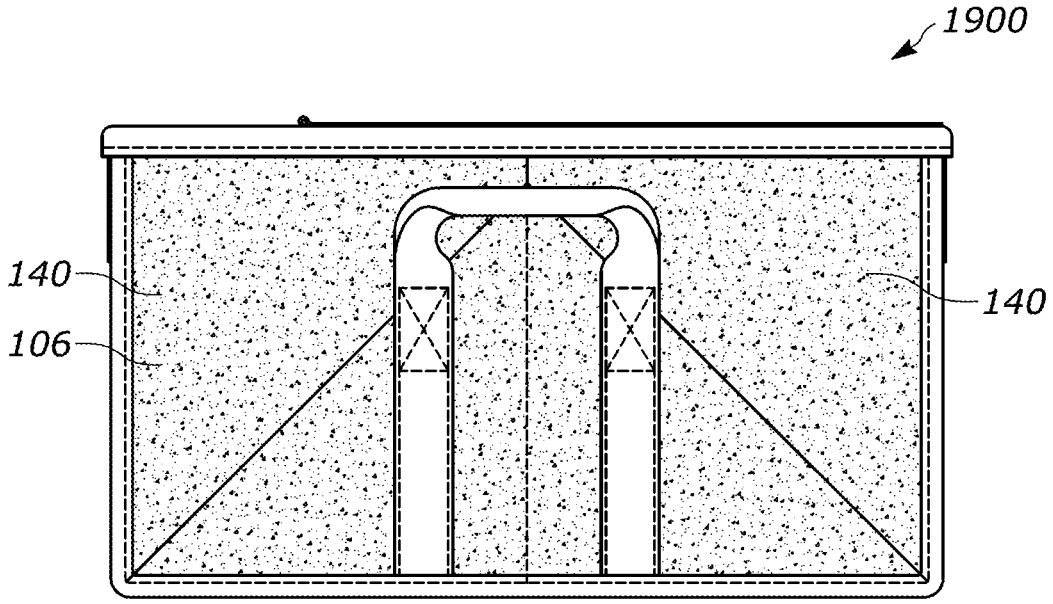
FIG. 29 is a rear view of the liner of FIG. 19 showing the insulation layer.

In an embodiment, the liner 1900 is temperature-controlled so as to maintain the temperature of the items stored or transported within the liner 1900. In an embodiment, the same four layers—namely, interior layer 138, inner middle layer 136, outer middle layer 134, and exterior layer 132—comprise the front wall 104, the rear wall 106, the base panel 102, the right and left lids 1952*a*, 1952*b*, and the side walls 108, 110. The interior layer 138 (which is proximate the interior cavity of the liner) comprises a waterproof material, such as such as Radiant Shield™, polyethylene vinyl acetate (PEVA), or a plastic foil material. The inner middle layer 136 comprises a material for maintaining the temperature of the cavity of the liner 1900 and any items located therein (e.g., by either cooling or heating). FIG. 24 depicts cross-sectional illustrations of the overlapping portions of right and left lids 1952*a*, 1952*b* when in a closed position (not shown to scale) where one lid flap 1952*b* switches the inner middle layer 136 and the outer middle layer 134 and the other lid flap 1952*a* does not. As shown in FIGS. 25 through 26 in an embodiment, the inner middle layer 136 comprises a gel pack comprising an outer wrapper or envelope of flexible or pliable material such as plastic film which is filled with and surrounds an insulating, nontoxic gel material, which may be any such material known to those of skill in the art, such as silica gel. The amount of fill of the gel material is such that the gel pack is substantially flattened in shape. It would be understood by one with skill in the art that other means of temperature control may be substituted for the gel packs. In some embodiments, such as the embodiment shown in FIGS. 27 through 29, an additional layer comprises insulation 140, such as cotton insulation, an insulating foam, a rigid or semi-rigid polyurethane foam, a soft polyurethane foam, or a high-density polyethylene (HDPE) foam. In an embodiment, the insulation layer 140 comprises a layer of insulation that is 2 centimeters thick. The outer middle layer 134 comprises a rigid or semi-rigid material, such as polyethylene (PE) board or PE-coated paperboard, to provide support for the liner 1900. The exterior layer 132 comprises a protective, relatively strong and durable synthetic or natural material such as Radiant Shield™, a fabric, canvas, nylon, coated polyester, or the like. In an embodiment, the exterior layer 132 includes an aluminizing material or coating to better reflect and disperse radiation (such as heat) away from the liner 1900. As will be clear to one of skill in the art from the present disclosure, in alternative embodiments, the structure of the walls 104, 106, 108, 110 may be varied to either include additional layers (such as by including additional layers of insulation), omit layers (such as by omitting the outer middle layer 134 to provide a soft-sided liner), or re-arrange layers (such as by switching the inner middle layer 136 and the outer middle layer 134)

As shown in FIGS. 19, 20, 21, 24, 27, and 28, in an embodiment, the liner 1900 further comprises right and left lids 1952*a*, 1952*b* that are attached to the opposite side walls 108, 110 and when in the closed position the right and left lids 1952*a*, 1952*b* each covers a portion of the opening of the liner 1900 proximate the respective opposite side walls 108, 110 and extending between the front wall 104 and rear wall 106. As shown, the right and left lids 1952*a*, 1952*b* are of differing length such that when they are closed they overlap to provide additional insulation and stability. Alternatively, the right and left lids 1952*a*, 1952*b* may be the same length and that length is sufficient for them to overlap to provide additional insulation and stability. The right and left lids 1952*a*, 1952*b* each contains a latching mechanism, such as one or more magnets, a hook-and-loop fastener, etc., on the exterior of the lids, respectively, so as to provide additional insulation and prevent the right and left lids 1952*a*, 1952*b* from being inadvertently lifted while the liner 1900 is in use. The latching mechanism may be omitted. In some embodiments, a tamper-resistant clasp may be used, as shown in FIG. 19, comprising a mechanism such as a pair of loops 1964*a*, 1964*b* or the like where a securing mechanism such as a zip-tie, bolt, lock, or the like may be inserted into the loops and secured so as to prevent unauthorized access to the contents and notification to the user that the contents have not been tampered with. In some embodiments, the loops 1964*a*, 1964*b* further comprise a latching mechanism 1966*a*, 1966*b*, such as a hook-and-loop fastener or the like, that allows the loops to be secured together and facilitate the insertion of the securing mechanism such as a zip-tie, bolt, lock, or the like.

Figure 30:
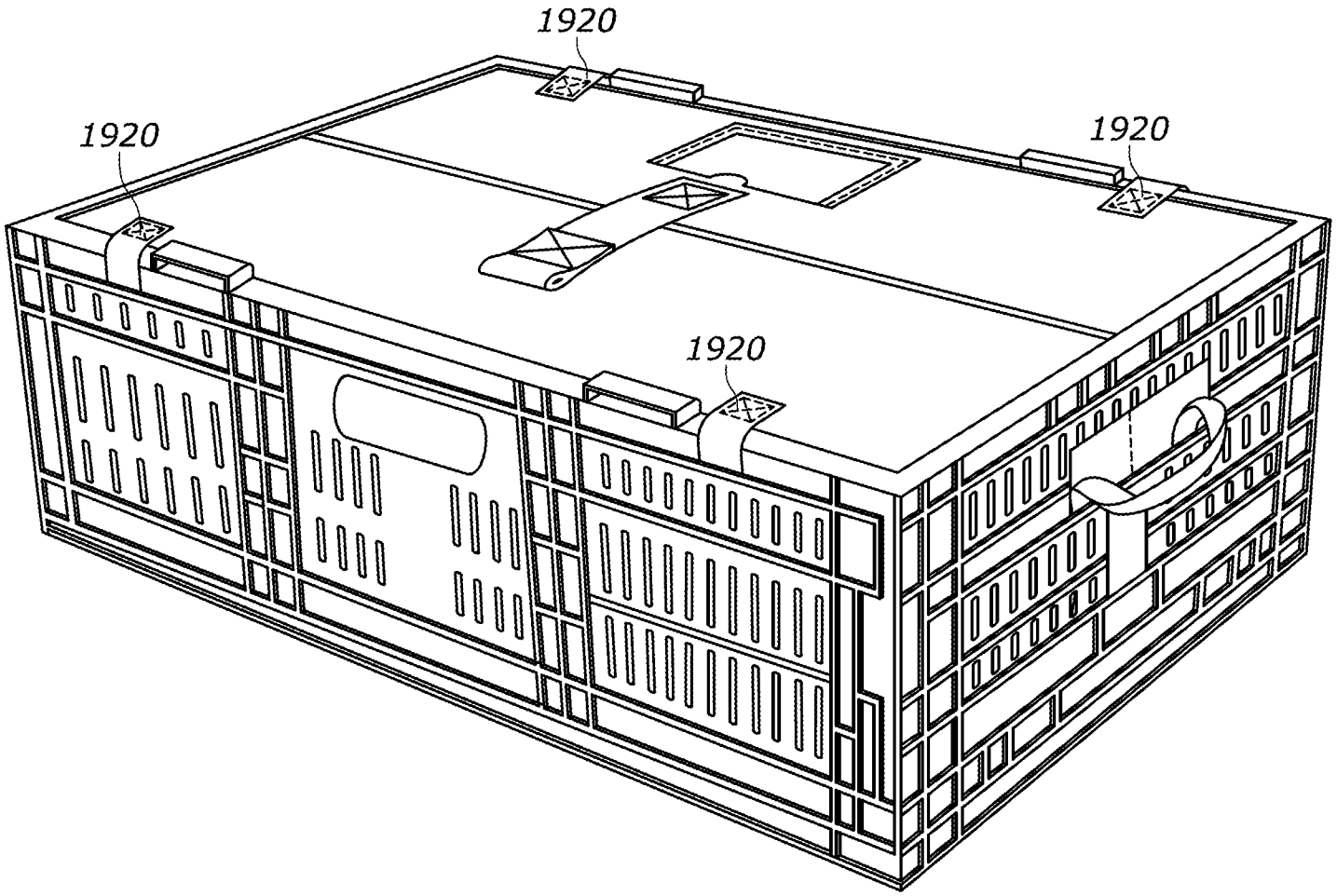
FIG. 30 is a perspective view of the liner of FIG. 19 inserted into a crate with the straps securing the liner to the crate.

As shown in FIGS. 19, 20, 21, and 22 the liner 1900 may further comprise four straps 1920 are each attached to the respective opposing side walls 108, 110 and removably attached to the respective lid 1952*a*, 1952*b* via a fastening mechanism 1922 (such as a hood and loop fastener or the like) so as to allow the straps 1920 to be weaved through openings of the crate, as shown in FIG. 30, when the liner 1900 is inserted into the crate and thereby securing the liner 1900 in its open configuration and prevent the liner 1900 from collapsing. In alternate embodiments (not shown), the straps 1920 allow the lid 1952*a*, 1952*b* to be removable and to provide reinforcement to the liner 1900 both when the lid 1952*a*, 1952*b* are open and closed. In other embodiments, the straps 1920 may be removably attached to both the respective lid 1952*a*, 1952*b* and the respective opposing side walls 108, 110, or the straps 1920 may be non-removably attached to both the respective lid 1952*a*, 1952*b* and the respective opposing side walls 108, 110, or the straps 1920 may be attached to the attached to the respective lid 1952*a*, 1952*b* and removably attached to the respective opposing side walls 108, 110. Other configurations are also considered, for example the straps 1920 may be attached or removably attached to the respective lid 1952*a*, 1952*b* and attached or removably attached to the front and back walls, respectively. In some embodiments, not shown, less or more pairs of straps 1920 are used.

Freezable Crate Liner with Right and Left Lids and Lid Gussets

FIGS. 31 through 35 illustrate a sixth embodiment of a liner 1900 comprising walls 104, 106, 108, 110, base 102, and right and left lids 1952*a*, 1952*b*. The embodiment shown in FIGS. 31 through 35 is substantially the same as the fifth embodiment but omits the lid straps and contains an alternate lid structure.

Figure 31:
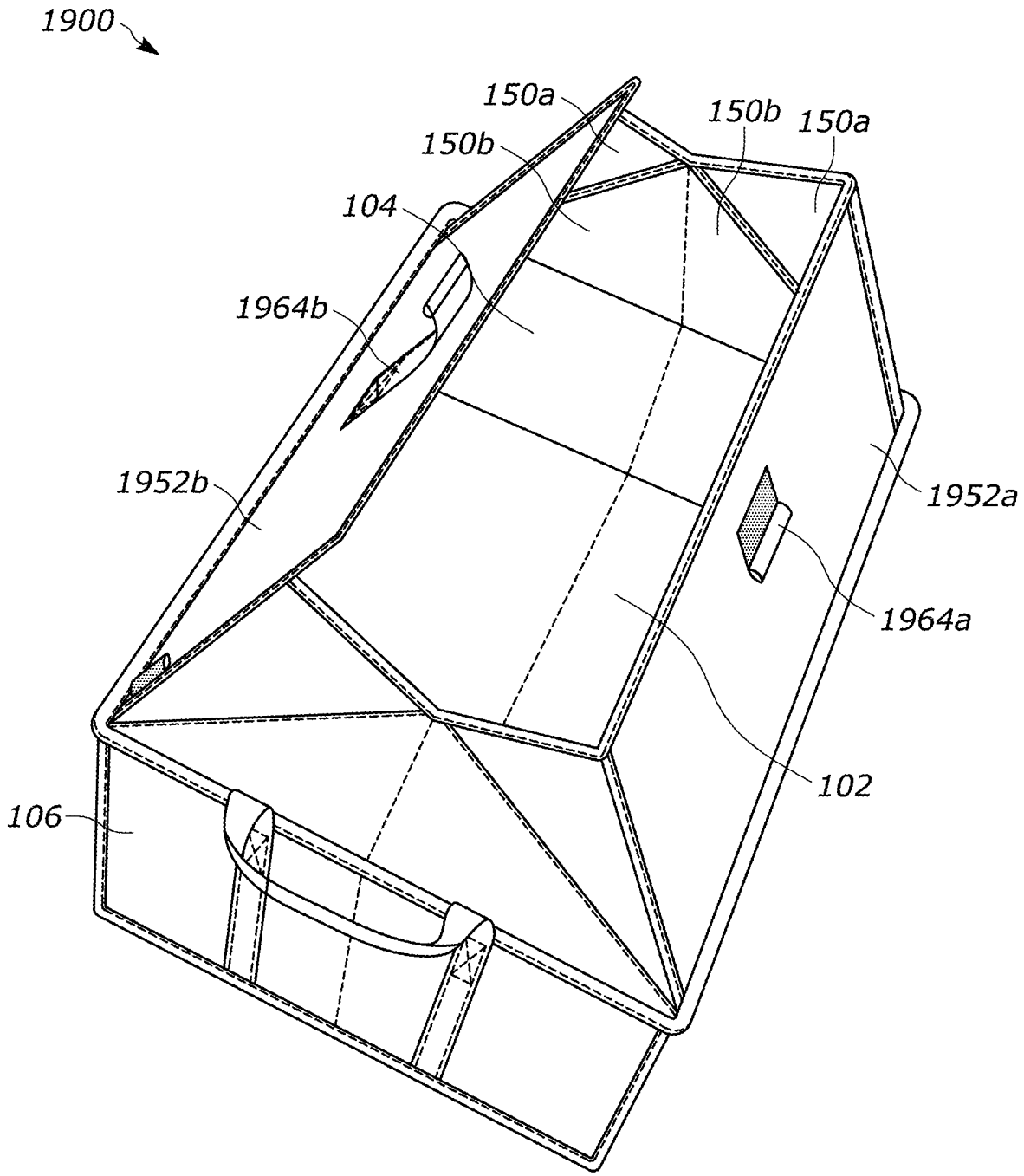
FIG. 31 is a top perspective view of a sixth embodiment of a liner with the lid in a partially closed position.
Figure 32:
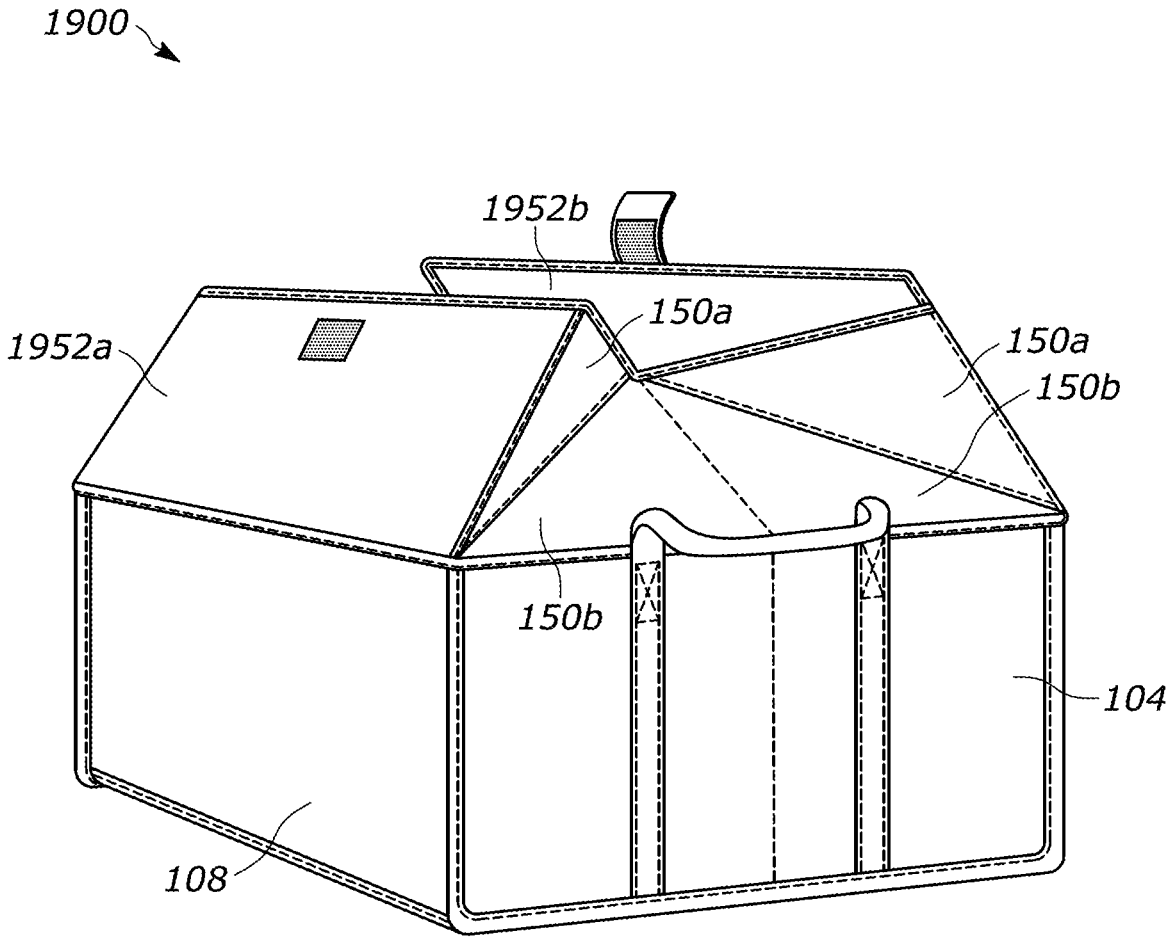
FIG. 32 is a front perspective view of the liner of FIG. 31 with the lid in a partially closed position.
Figure 33:
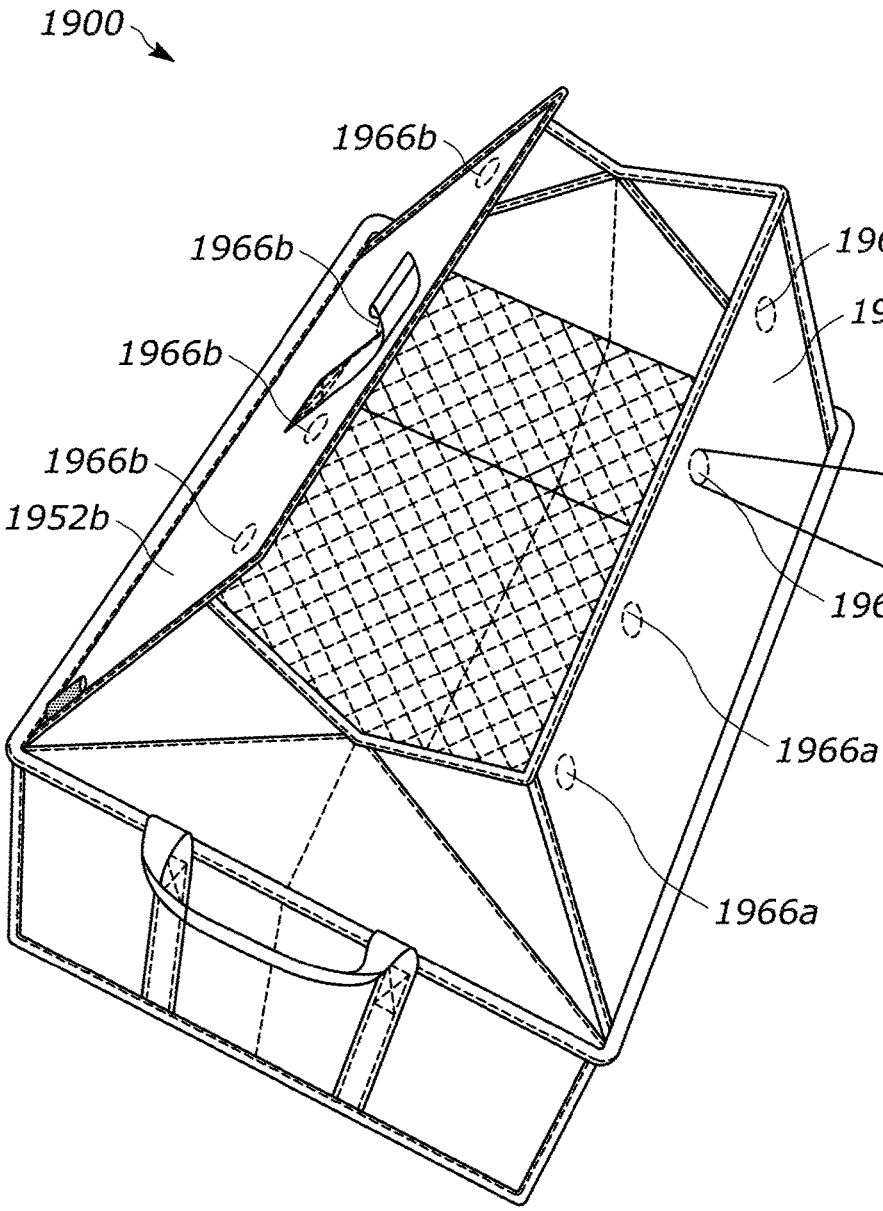
FIG. 33 is a top perspective view of the liner of FIG. 31 with a magnet lid closure.

As shown in FIGS. 31, 32, and 33, in an embodiment, the liner 1900 further comprises right and left lids 1952*a*, 1952*b* that are attached to the opposite side walls 108, 110 and when in the closed position the right and left lids 1952*a*, 1952*b* each covers a portion of the opening of the liner 1900 proximate the respective opposite side walls 108, 110 and extending between the front wall 104 and rear wall 106. As shown, the right and left lids 1952*a*, 1952*b* are of differing length such that one lid 1952*b* extends past the lid gussets 150*a*, 150*b* and when the right and left lids 1952*a*, 1952*b* are closed they overlap to provide additional insulation and stability. Alternatively, the right and left lids 1952*a*, 1952*b* may be the same length and that length is sufficient for them to overlap to provide additional insulation and stability. As shown in FIG. 33, the right and left lids 1952*a*, 1952*b* each contains a latching mechanism 1966*a*, 1966*b*, such as one or more magnets, a hook-and-loop fastener, etc., on the exterior of the lids, respectively, so as to provide additional insulation and prevent the right and left lids 1952*a*, 1952*b* from being inadvertently lifted while the liner 1900 is in use. The latching mechanism may be omitted. In some embodiments (not shown), a tamper-resistant clasp may be used comprising a mechanism such as a pair of loops or the like where a securing mechanism such as a zip-tie, bolt, lock, or the like may be inserted into the loops and secured so as to prevent unauthorized access to the contents and notification to the user that the contents have not been tampered with. In some embodiments, the loops further comprise a latching mechanism, such as a hook-and-loop fastener or the like, that allows the loops to be secured together and facilitate the insertion of the securing mechanism such as a zip-tie, bolt, lock, or the like.

Figure 34:
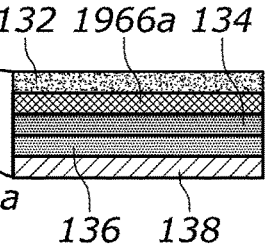
FIG. 34 is a cross-sectional view of the portion of the lid with a magnet lid closure shown in FIG. 33.
Figure 35:
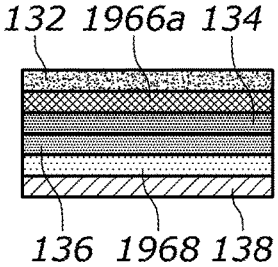
FIG. 35 is a cross-sectional view of the lid with a magnet lid closure and additional gel pack layer in FIG. 33.

In an embodiment, the same four layers—namely, interior layer 138, inner middle layer 136, outer middle layer 134, and exterior layer 132—comprise the right and left lids 1952*a*, 1952*b*. The interior layer 138 (which is proximate the interior cavity of the liner) comprises a waterproof material, such as such as Radiant Shield™, polyethylene vinyl acetate (PEVA), or a plastic foil material. The inner middle layer 136 comprises a material for maintaining the temperature of the cavity of the liner 1900 and any items located therein (e.g., by either insulating, cooling or heating). FIGS. 34 and 35 depict cross-sectional illustrations of the portions of the right and left lids 1952*a*, 1952*b* where the magnet 1966*a*, 1966*b* that latch the lid are located. As shown in FIGS. 34 and 35, the magnets 1966*a*, 1966*b* are located between the outer layer 132 and the outer middle layer 134. In some embodiments, such as the embodiment shown in FIG. 35, an additional layer 1968 comprises a gel pack comprising an outer wrapper or envelope of flexible or pliable material such as plastic film which is filled with and surrounds an insulating, nontoxic gel material, which may be any such material known to those of skill in the art, such as silica gel. The amount of fill of the gel material is such that the gel pack is substantially flattened in shape. It would be understood by one with skill in the art that other means of temperature control may be substituted for the gel packs. The outer middle layer 134 comprises a rigid or semi-rigid material, such as polyethylene (PE) board or PE-coated paperboard, to provide support for the liner 1900. The exterior layer 132 comprises a protective, relatively strong and durable synthetic or natural material such as Radiant Shield™, a fabric, canvas, nylon, coated polyester, or the like. In an embodiment, the exterior layer 132 includes an aluminizing material or coating to better reflect and disperse radiation (such as heat) away from the liner 1900. As will be clear to one of skill in the art from the present disclosure, in alternative embodiments, the structure of the walls 104, 106, 108, 110 may be varied to either include additional layers (such as by including additional layers of insulation), omit layers (such as by omitting the outer middle layer 134 to provide a soft-sided liner), or re-arrange layers (such as by switching the inner middle layer 136 and the outer middle layer 134)

As shown the liner 1900 may further comprise several lid gussets 150*a*, 150*b* which extend from the front wall 104 and the rear wall 106 such that when the right and left lids 1952*a*, 1952*b* are folded over the cavity, the lid gussets 150*a*, 150*b* collapse into the cavity of the liner 100 and provide support to the right and left lids 1952*a*, 1952*b*, as is shown in FIGS. 31 and 32. Alternatively, when the right and left lids 1952*a*, 1952*b* are not folded over the cavity, the lid gussets 150*a*, 150*b* provide tension against the right and left lids 1952*a*, 1952*b*, thereby freeing the opening of the cavity of the liner 100 while it is being filled. The lid gussets 150*a*, 150*b* comprise substantially the same four layers as the front wall 104, the rear wall 106, the opposing side walls 108, 110, and the right and left lids 1952*a*, 1952*b*, specifically, an interior layer 138, an inner middle layer 136, an outer middle layer 134, and an exterior layer 132. In alternative embodiments, the lid gussets 150*a*, 150*b* comprise the same three layers, specifically, an interior layer 138, a rigid middle layer 134, and an exterior layer 132 where the rigid middle layer substantially fills the space within the bounds of the lid gussets 150*a*, 150*b*. The seams connecting the lid gussets 150*a*, 150*b* are formed by thermal welding, side seams, or lines of stitching extending through the exterior layer 132 and the interior layer 138 such that the separation between the rigid middle layer 138 of each lid gusset 150*a*, 150*b* is maintained. In alternative embodiments, other layer configurations of the lid gussets 150*a*, 150*b* are contemplated, such as omitting the rigid middle layer 138 or including an insulation layer in addition to or in place of the rigid middle layer 138.

Freezable Crate Liner with Right and Left Lids and Lid Gussets

Figure 36:
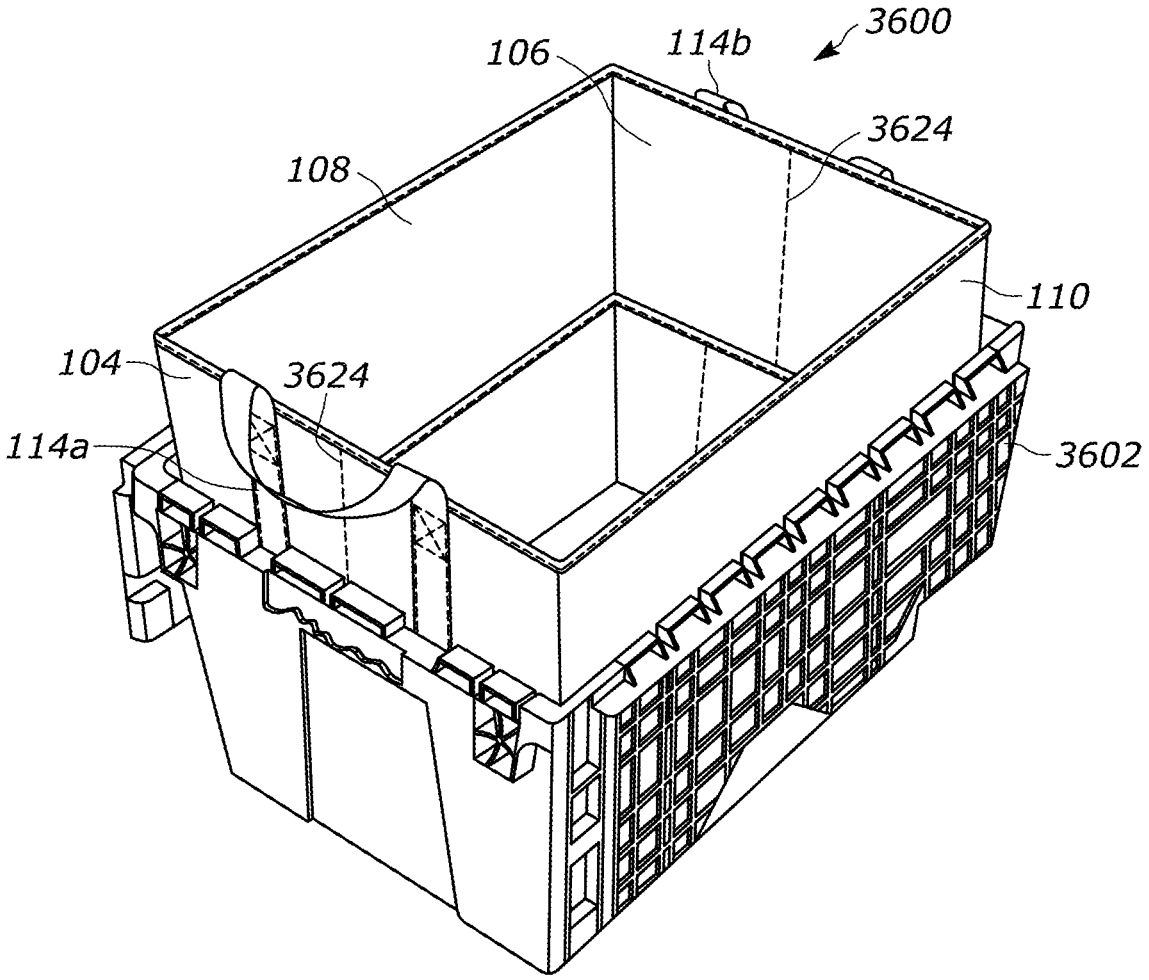
FIG. 36 is a perspective view of a seventh embodiment of a liner with the liner partially inserted into a crate.
Figure 37:
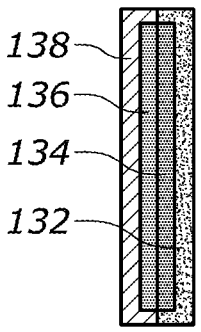
FIG. 37 is a cross-sectional view of the walls of the liner of FIG. 36.
Figure 38:
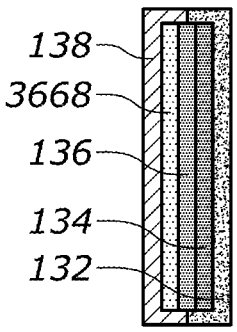
FIG. 38 is a cross-sectional view of an alternate configuration of the walls of the liner of FIG. 36.

FIGS. 36 through 38 illustrate a seventh embodiment of a liner 3600 comprising walls 104, 106, 108, 110. Notably, this embodiment omits the base panel, right and left lids, and the lid gussets of the sixth embodiment.

As shown in FIG. 36, opposing side walls 108, 110, front wall 104, the rear wall 106 comprise the liner 3600 which is shown partially inserted into a crate 3602. In embodiments the liner 3600 is collapsible to permit the liner 3600 to be easily transported or stored while empty. As shown, one or more vertical creases 3624 extend along the front wall 104 and rear wall 106 to facilitate the folding of the front wall 104 and rear wall 106 when the liner 3600 is collapsed. In other embodiments (not shown), the opposing side walls 108, 110 may contain one or more vertical creases to facilitate the folding of the opposing side walls 108, 110 when the liner 3600 is collapsed. Advantageously, the liner 3600 may be removed from the crate 3602 without disturbing items present in the crate 3602. This advantageously allows the liner 3600 to be quickly separated from the crate 3602 (for example, to allow the liner to be re-frozen or used with a different crate) without requiring that the crate be emptied. Similarly, liner 3600 may be inserted into a crate 3602 already containing one or more items without needing to first remove the items. As the liner 3600 is open both at the top and bottom of walls 104, 106, 108, 110, liner 3600 may be more rapidly frozen or heated as hair can access the inner surface of the walls from both ends.

As shown, a pair of handles 114*a*, 114*b* are attached to the opposing walls 104, 106, respectively. In use, as shown in FIG. 36, the handles 114*a*, 114*b* can optionally pass through openings in the upper wall of the crate 3602, such that the handles extend outside the crate 3602 when the lid of the crate is closed over the liner 3600 and permit the crate to be carried by the handles 114*a*, 114*b* once the lid of the crate 3602 is secured in a closed position. The liner 3600 may be removed from the crate 3602 by opening the lid of the crate 3602 and lifting up on the handles 114*a*, 114*b*.

In an embodiment, the same four layers—namely, interior layer 138, inner middle layer 136, outer middle layer 134, and exterior layer 132—comprise the walls 104, 106, 108, 110. FIG. 37 depicts a cross-sectional illustration of the walls 104, 106, 108, 110. The interior layer 138 (which is proximate the interior cavity of the liner) comprises a waterproof material, such as such as Radiant Shield™, polyethylene vinyl acetate (PEVA), or a plastic foil material. In some embodiments, such as the embodiment shown in FIG. 38, an additional layer 3668 comprises one or more discrete gel packs comprising an outer wrapper or envelope of flexible or pliable material such as plastic film which is filled with and surrounds an insulating, nontoxic gel material, which may be any such material known to those of skill in the art, such as silica gel. The amount of fill of the gel material is such that the gel pack is substantially flattened in shape. In alternative embodiments, other structures of gel packs may be used. By way of example, a plurality of discrete gel packs may be located in each wall 104, 106, 108, 110, such as by using a grid of spaced-apart gel packs. It would be understood by one with skill in the art that other means of temperature control may be substituted for the gel packs. The inner middle layer 136 comprises a material for maintaining the temperature of the cavity of the liner 3600 and any items located therein (e.g., by either insulating, cooling, or heating). The outer middle layer 134 comprises a rigid or semi-rigid material, such as polyethylene (PE) board or PE-coated paperboard, to provide support for the liner 3600. The exterior layer 132 comprises a protective, relatively strong and durable synthetic or natural material such as Radiant Shield™, a fabric, canvas, nylon, coated polyester, or the like. In an embodiment, the exterior layer 132 includes an aluminizing material or coating to better reflect and disperse radiation (such as heat) away from the liner 3600. As will be clear to one of skill in the art from the present disclosure, in alternative embodiments, the structure of the walls 104, 106, 108, 110 may be varied to either include additional layers (such as by including additional layers of insulation), omit layers (such as by omitting the outer middle layer 134 to provide a soft-sided liner), or re-arrange layers (such as by switching the inner middle layer 136 and the outer middle layer 134)

Insulated Crate Liner with Hinged Lid and Tab

FIGS. 39 through 43 illustrate an eighth embodiment of an insulated crate liner 10100. In the depicted embodiment, the liner 10100 generally comprises a rectangular structure having a base panel 10102, a front wall 10104, a rear wall 10106, opposite side walls 10108, 10110, and a lid 10112, which together define a cavity which receives items to be transported or stored in the liner 10100 (such as, but not limited to, articles of food, beverages, and the like). In other embodiments (not shown), the liner 10100 may take other shapes. By way of example and not of limitation, in other embodiments, the liner 10100 may have a greater or lesser number of walls (e.g., being cylindrical in shape and having only a single side wall, or being polyhedral and having additional walls). In some embodiments, the portion of the walls 10104, 10106, 10108, 10110 proximate to the base panel 10102 is narrower than the portion proximate to the opening of the liner 10100 such that the liner 10100 fits securely and efficiently in the crate upon insertion.

Figure 39:
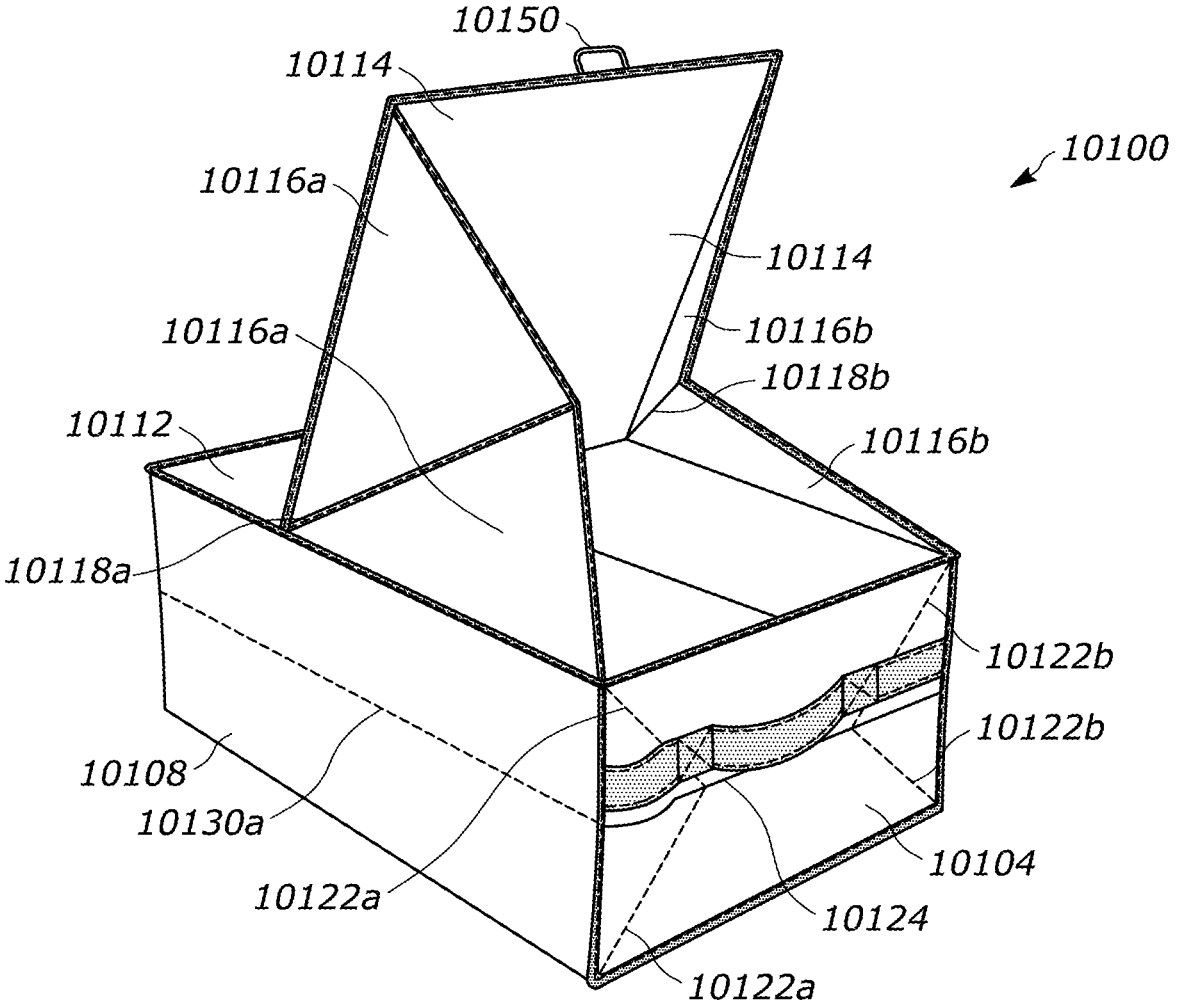
FIG. 39 is a perspective view of an eighth embodiment of a crate liner.
Figure 42:
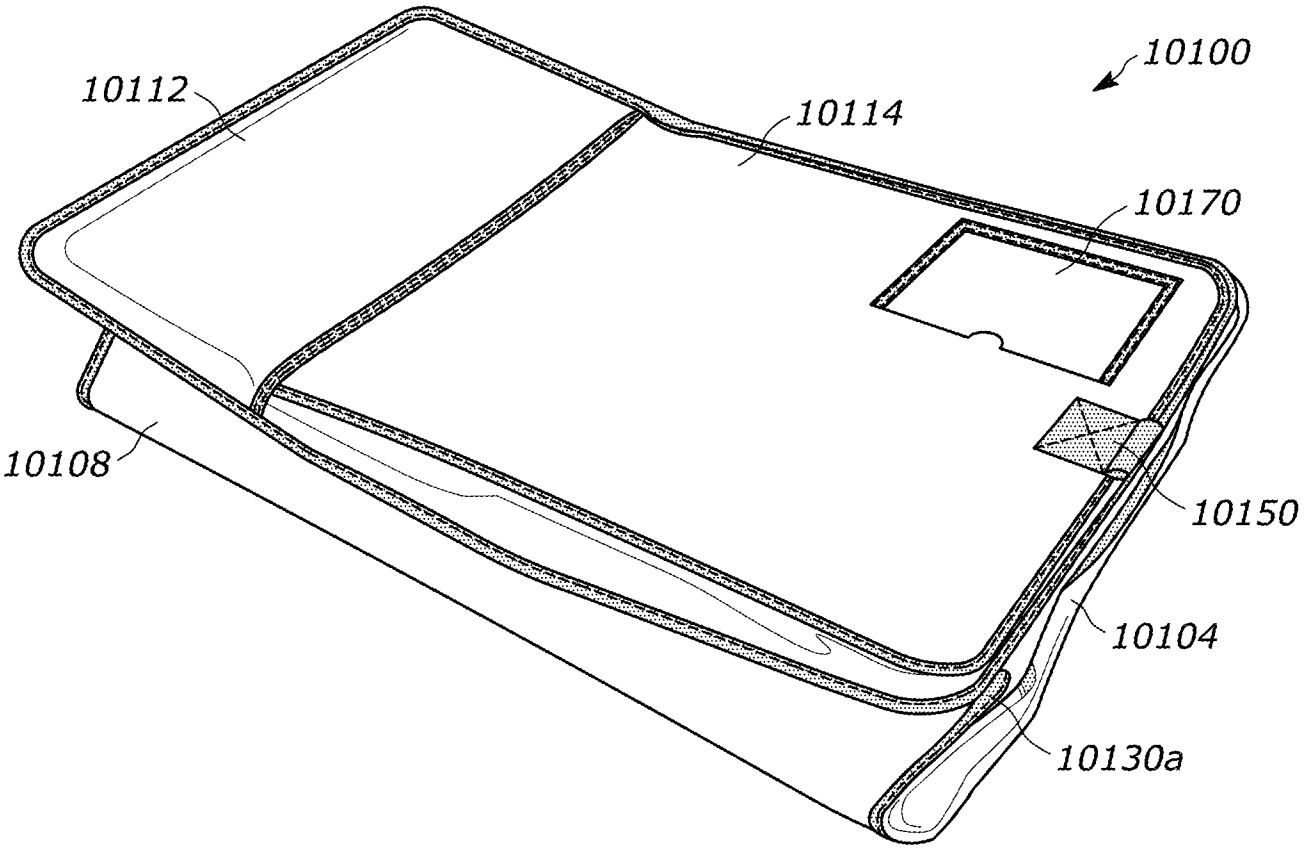
FIG. 42 is a front perspective view of the liner of FIG. 39 in a collapsed configuration.
Figure 43:
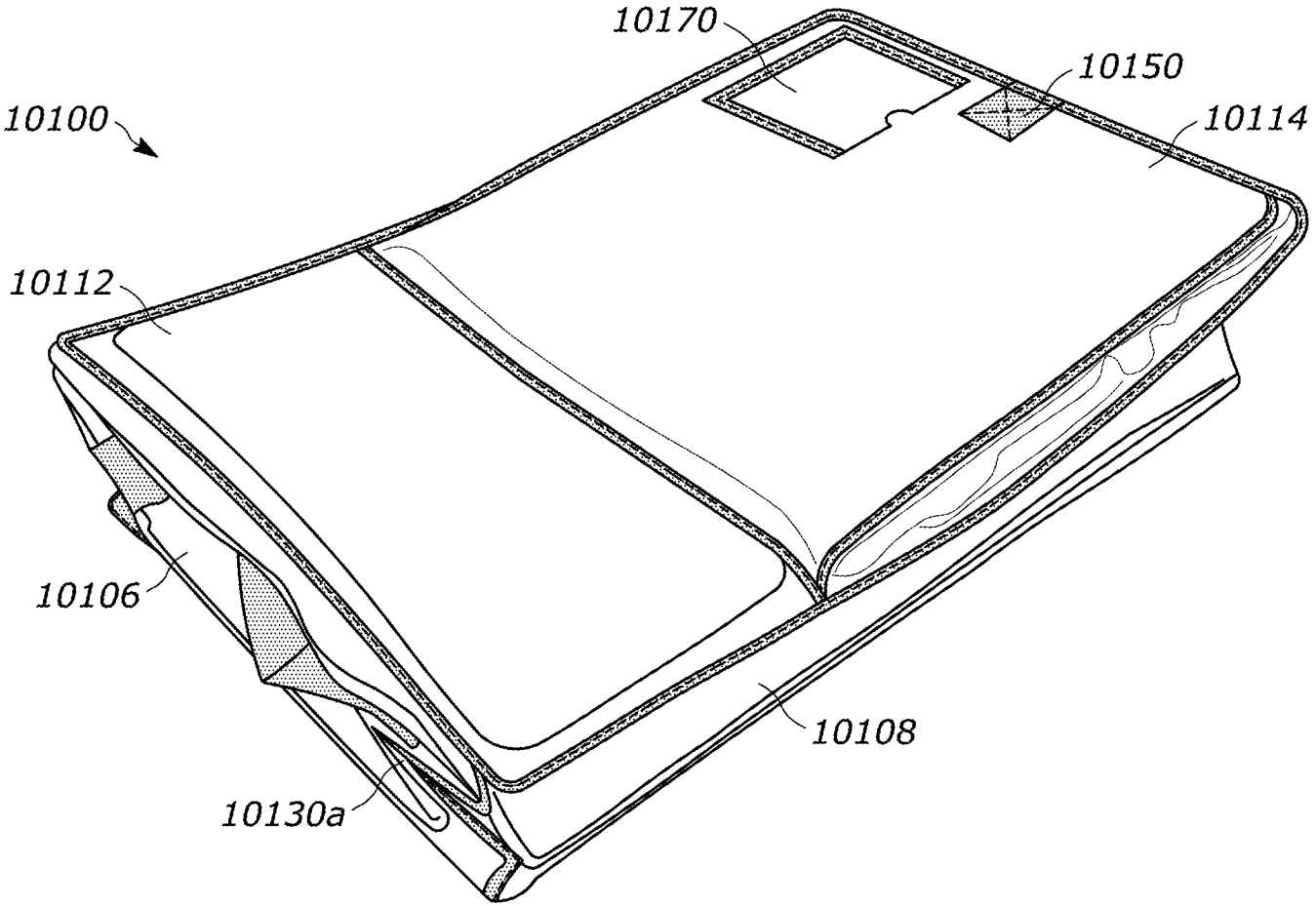
FIG. 43 is a rear perspective view of the liner of FIG. 39 in a collapsed configuration.

As shown in FIGS. 39, 42, and 43, in embodiments the liner 10100 is collapsible to permit the liner 10100 to be easily transported or stored while empty. As shown, horizontal creases 10130*a*, 10130*b* extend along the side walls

10108, 10110 from proximate the rear wall 10106 to proximate the front wall 10104 to facilitate folding of the side walls 10108, 10110 when the liner 10100 is collapsed. and one or more angled creases that extend from proximate the base panel to proximate the one or more horizontal creases and one or more angled creases that extend from proximate the opening of the liner to the one or more horizontal creases, As shown, the front wall and the rear wall comprise horizontal creases 10124, 10128 that are parallel to the base panel 10102 and pairs of diagonal creases 10122*a*, 10122*b*, 10126*a*, 10126*b* extend along the front wall 10104 and rear wall 10106 from proximate the base panel 10102 to proximate the horizontal creases 10124, 10128 and extend from proximate the opening of the liner 10100 to proximate the horizontal creases 10124, 10128. To collapse the liner 10100, the front wall 10104 and rear wall 10106 fold into the liner 10100 along the diagonal and horizontal creases 10122*a*, 10122*b*, 10126*a*, 10126*b*, 10124, 10128 while the side walls 10108, 10110 fold into the liner 10100 along horizontal creases 10130*a*, 10130*b* such that the base panel 10102 moves towards the opening of the liner. In some embodiments (not shown), the liner 10100 is secured in the collapsed configuration by using clips or other attachment means (such as hook-and-loop fasteners).

As shown, a pair of handles 10163*a*, 10163*b* are attached to the front wall 10104 and rear wall 10106, respectively. In an alternative embodiment, the handles 10163*a*, 10163*b* extend above the opening of the cavity and may be used to carry the liner 10100 or aid in the insertion of the liner 10100 into the crate. In an alternative embodiment, the handles 10163*a*, 10163*b* are attached to the opposite side walls 10108, 10110, respectively.

Figure 40:
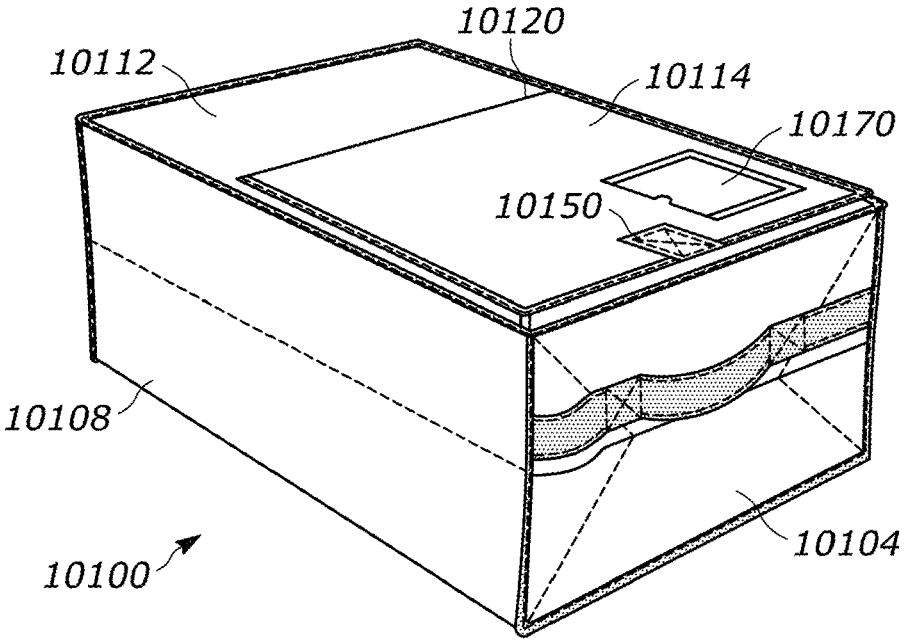
FIG. 40 is a perspective view of the liner of FIG. 39 with the lid in a closed position.
Figure 41:
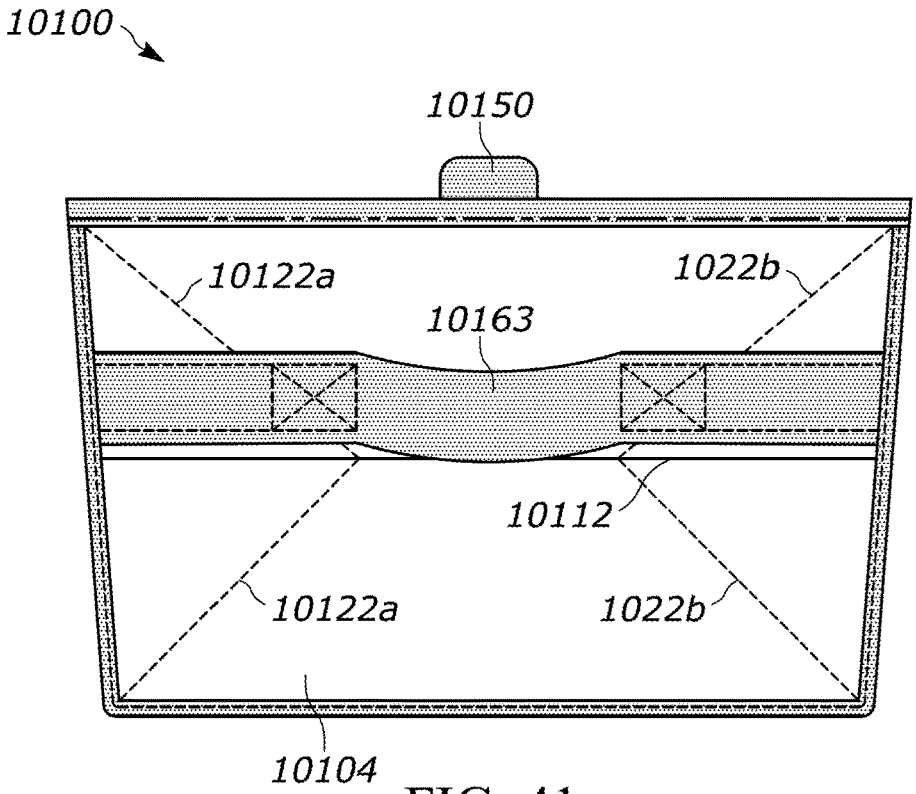
FIG. 41 a front view of the liner of FIG. 39.
Figures 59A, 59B:
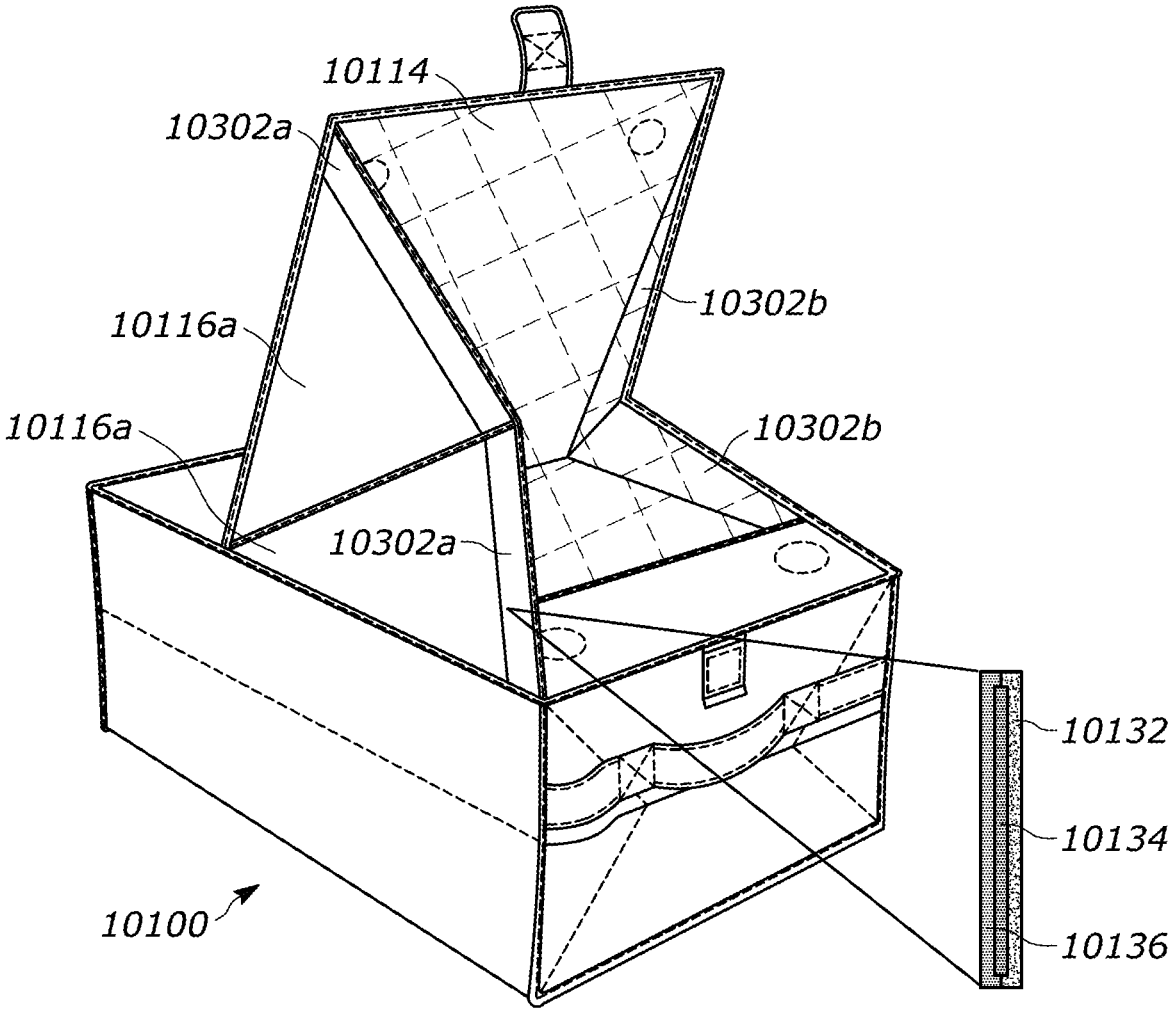
FIG. 59A is a perspective view of the liner of FIG. 45A showing the location of semi-rigid panels in the lid gussets.
FIG. 59B is an expanded view showing the internal structure of the portion of the lid gussets where the semi-rigid panels are located.
Figure 60:
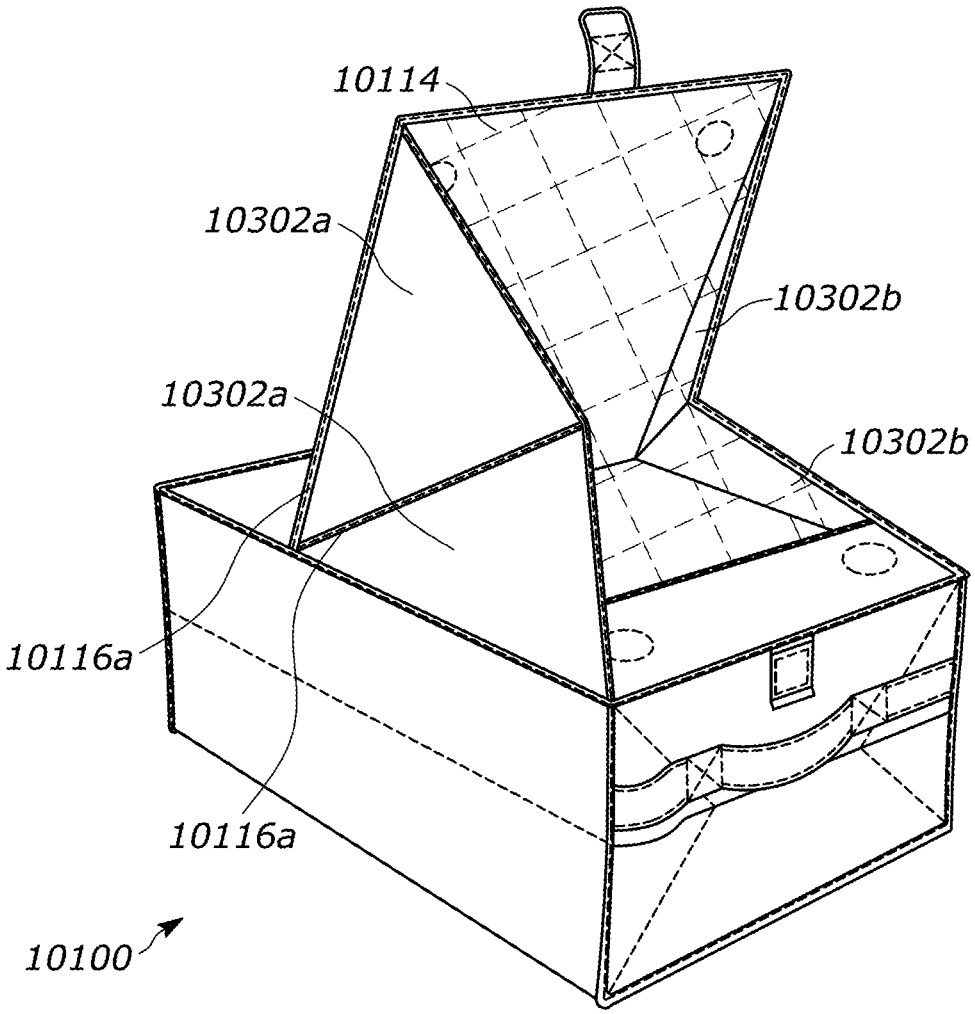
FIG. 60 is a perspective view of the liner of FIG. 45A showing an alternate configuration of semi-rigid panels in the lid gussets.

As shown in FIGS. 39, 40, 42, and 43, the liner 10100 further comprises a stationary portion 10112 and a lid flap 10114 that together form a lid. The lid stationary portion 10112 is attached to the rear wall 10106 and a portion of each of the opposite side walls 10108, 10110 and covers a portion of the opening of the liner 10100 proximate the rear wall 10106 and extending between the opposite side walls 10108, 10110. The lid flap portion 10114 is attached to the lid stationary portion 10112 at a crease 10120 (shown in FIG. 40) to facilitate raising and lowering the lid flap portion 10114. The lid flap portion 10114 is configured (not shown) in such a way when the liner 10100 is in a collapsed configuration the interior can still be accessed by opening the lid flap portion 10114 to allow for more efficient cooling of gel packs. The lid flap portion 10114 covers a portion of the opening of the liner 10100 when in a closed position. The lid flap portion 10114 is held in a closed position by gravity until lifted by a user. As shown, in embodiments, lid gussets 10116*a*, 10116*b*, attach to the lid flap portion 10114 and the opposite side walls 10108, 10110, respectively. When the lid flap portion 10114 is in the closed position, as shown in FIG. 40, the lid gussets 10116*a*, 10116*b* fold into the liner 10100 along creases 10118*a*, 10118*b*. Other ratios of the lid stationary portion 10112 and lid flap portion 10114 than what is depicted in FIGS. 39, 40, 42, and 43 are considered, such that the lid stationary portion 10112 and lid flap portion 10114 may each respectively cover a larger or smaller portion of the opening of the liner 10100. In other embodiments, the lid flap portion 10114 forms the lid alone and connects directly to the rear wall 10106 such that there is no lid stationary portion 10112. In some embodiments, the lid gussets 10116*a*, 10116*b* are sufficiently rigid such that, when the lid flap portion 10114 is in the open position, as shown in FIG. 39, the lid gussets 10116*a*, 10116*b* maintain the lid flap portion 10114 in the open position. In embodiments this rigidity is provided by a layer of semi-rigid material 10134 that substantially fills the lid gussets 10116*a*, 10116*b*. As shown in FIGS. 59A and 60, in alternative embodiments, the lid gussets 10116*a*, 10116*b* may include panels 10302*a*, 10302*b* that offer rigidity to the gussets. As shown in FIG. 59A, the panels 10302*a*, 10302*b* may extend substantially along the width of the lid gussets 10116*a*, 10116*b* proximate the opening of the liner 10100. In alternate embodiments, such as shown in FIG. 60, the panels 10302*a*, 10302*b* may substantially fill the lid gussets 10116*a*, 10116*b*. As shown in FIG. 59B, the panels 10302*a*, 10302*b* may comprise additional layers of material, flexible semi-rigid material, or other suitable alternatives.

As shown in FIGS. 39 through 43, the lid may also comprise a tab 10150 attached to the lid flap portion 10114 such that the tab 10150 may be used to raise the lid flap portion 10114 from a closed position. The tab 10150 may consist of a single layer of fabric, or, as shown, a loop of fabric. The tab 10150, as shown, may extend past the end of the lid flap portion 10114 proximate the front wall 10104 to make it easier for the user to grasp the tab 10150.

As shown in FIGS. 40, 42, and 43, the liner 10100 may optionally include a layer of transparent material attached via stitching or thermal welding to create a transparent pocket 10170 suitably sized to hold a piece of paper, label, ID, etc. As shown, the transparent pocket 10170 is located on the lid flap portion 10114 so the contents of the transparent pocket 10170 would be easily seen when the liner 10100 is inserted into a crate. Other locations for the transparent pocket 10170 are contemplated, such as on the stationary portion of the lid 10112 or any of the opposing side walls 10108, 10110, front wall 10104, or rear wall 10106.

Insulated Crate Liner with Hinged Lid, Magnet Closure, and Tab

Figure 44:
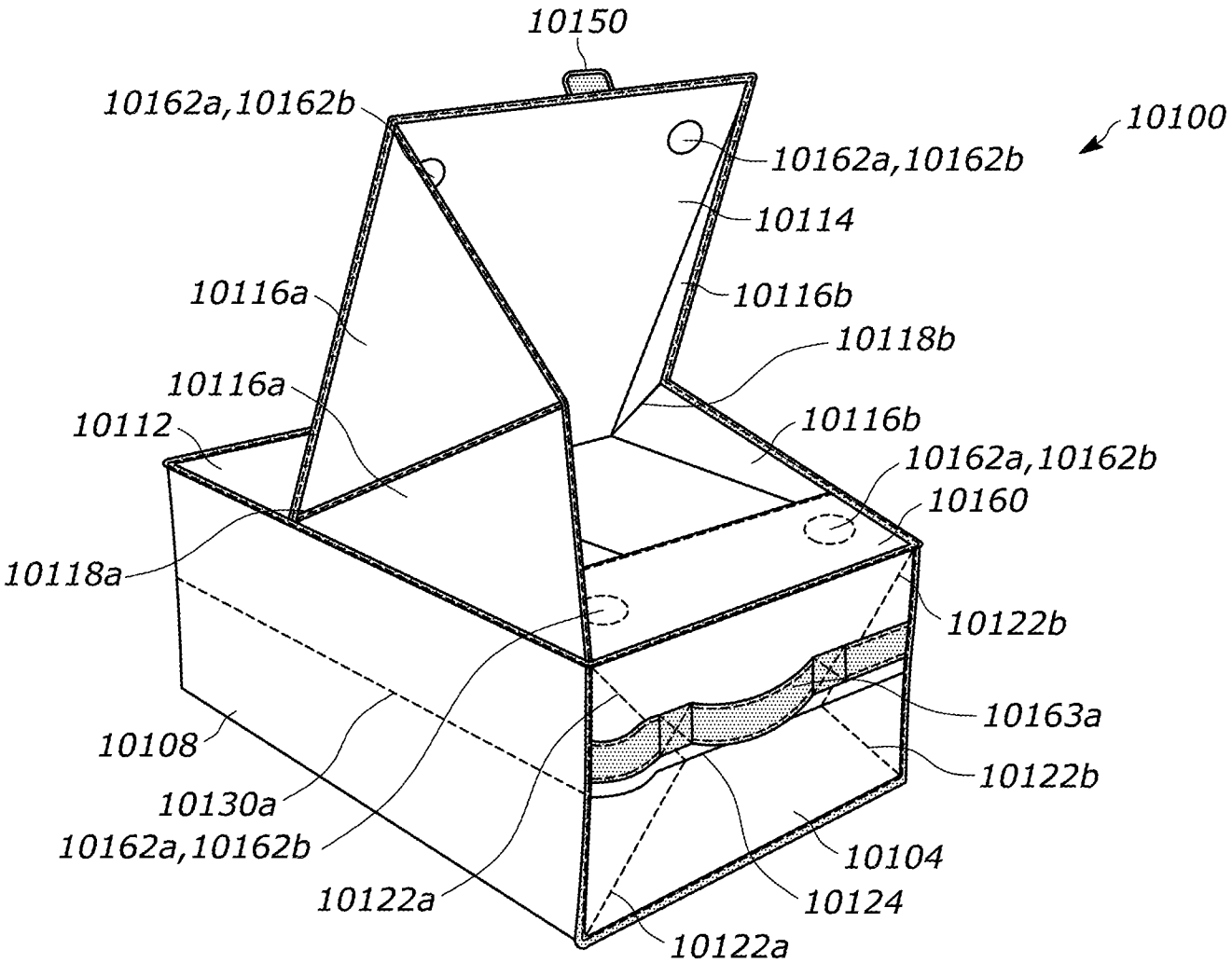
FIG. 44 is a perspective view of a ninth embodiment of a crate liner.

FIG. 44 illustrates a ninth embodiment of an insulated crate liner 10100. The embodiment shown in FIG. 44 is substantially the same as the eighth embodiment but includes additional closure structure in the lid. As shown in FIG. 44, the lid further comprises a second stationary portion 10160 that is attached to the front wall 10104 and a portion of each of the opposite side walls 10108, 10110 and covers a portion of the opening of the liner 10100 proximate the front wall 10104 and extending between the opposite side walls 10108, 10110. The second stationary portion 10160 and the lid flap portion 10114 each contains a closure mechanism 10162*a*, 10162*b*, such as one or more magnets, a hook-and-loop fastener, etc., affixed to the bottom and top, respectively, so as to provide additional insulation and prevent the lid flap portion 10114 from being inadvertently lifted while the liner 10100 is in use.

Insulated Crate Liner with Hinged Lid, Magnet Closure, Latching Mechanism, and Tab FIGS. 45A through 60 illustrates a tenth embodiment of an insulated crate liner 10100. The embodiment shown in FIGS. 45A through 60 is substantially the same as the ninth embodiment but includes additional latching structure in the lid. As shown in FIGS. 45A, 45B, 46, 47, 50, 51, 56A, 57A, 58A, 59A, and 60, a tamper-resistant clasp may be used in place of, or in addition to, the tab 10150. The tamper-resistant clasp comprising a mechanism such as a pair of loops or the like 10164*a*, 10164*b* where a securing mechanism such as a zip-tie, bolt, lock, or the like may be inserted into the loops and secured so as to prevent unauthorized access to the contents and notification to the user that the contents have not been tampered with. In some embodiments, the loops 10164*a*, 10164*b* further comprise a latching mechanism 10166, such as a hook-and-loop fastener or the like, that allows the loops to be secured together and facilitate the insertion of the securing mechanism such as a zip-tie, bolt, lock, or the like.

Figures 45A, 45B, 45C, 45D:
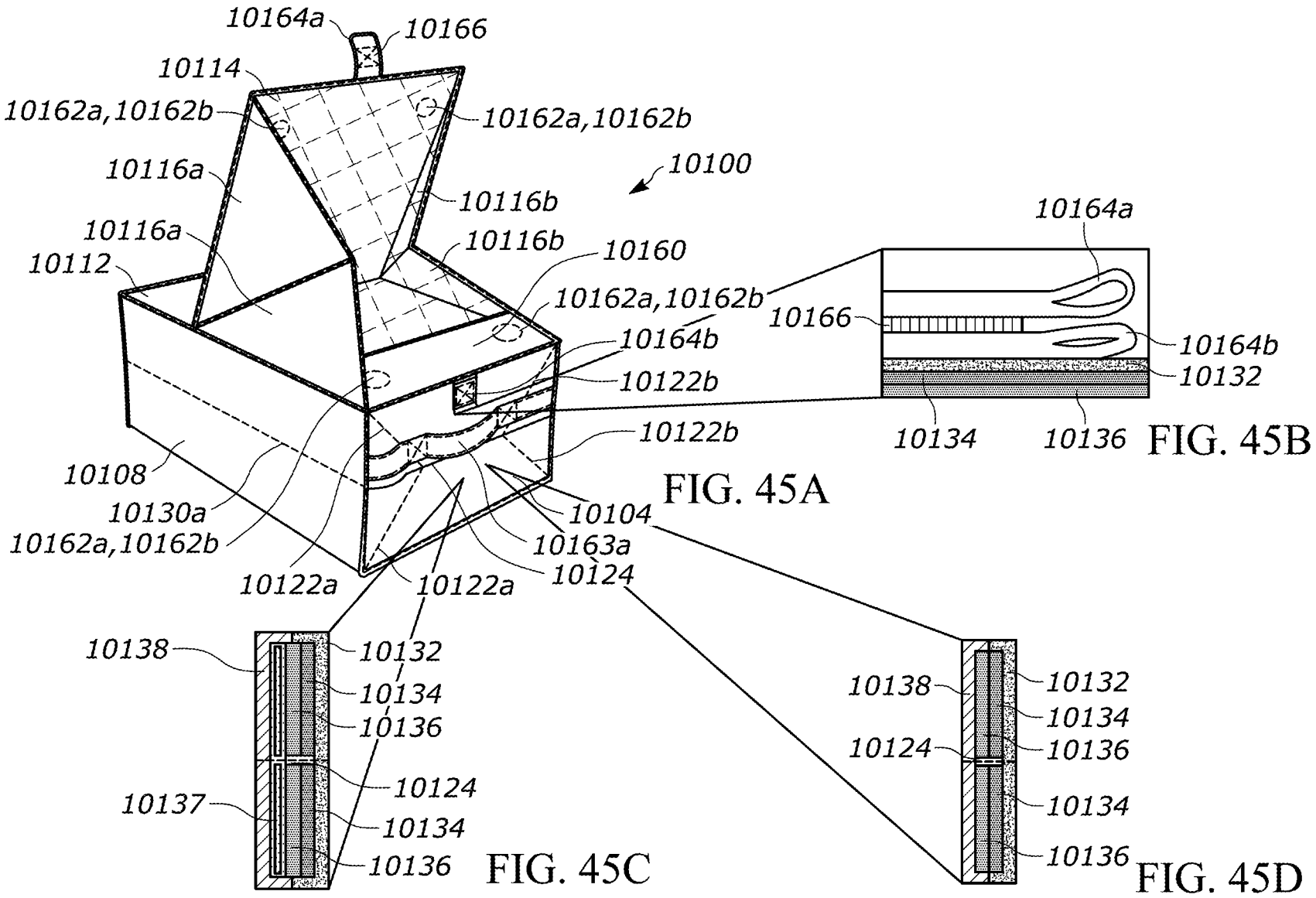
FIG. 45A is a perspective view of a tenth embodiment of a crate liner.
FIG. 45B is an expanded view showing portions of the internal structure of the portion of the front wall of the liner of FIG. 39 where the tamper-evident loops are located.
FIG. 45C is an expanded view showing the internal structure of the front wall of the liner of FIG. 39.
FIG. 45D is an expanded view showing an alternative internal structure of the front wall of the liner of FIG. 39.
Figure 46:
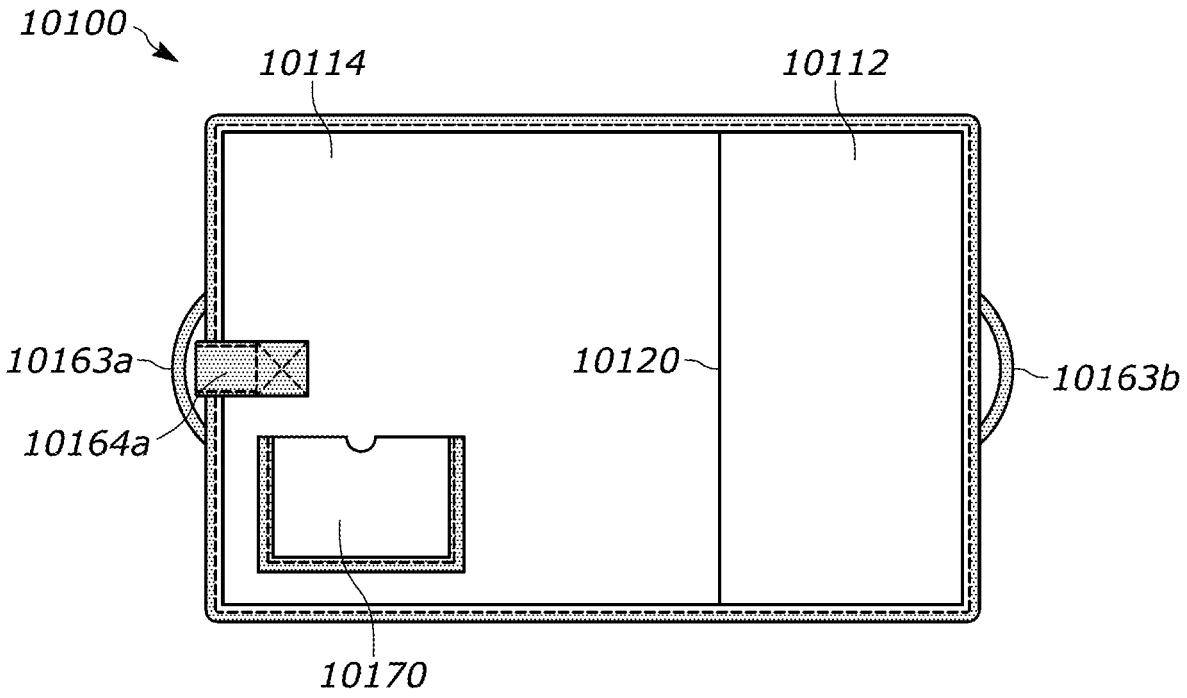
FIG. 46 is a top view of the liner of FIG. 45A.
Figure 47:
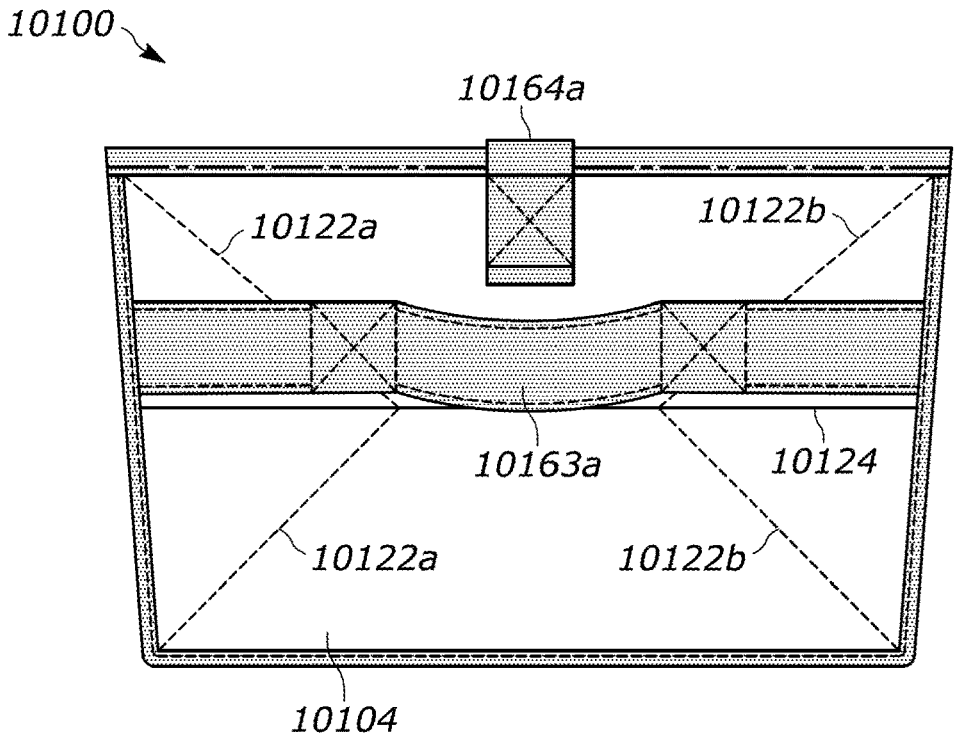
FIG. 47 is a front view of the liner of FIG. 45A.
Figure 48:
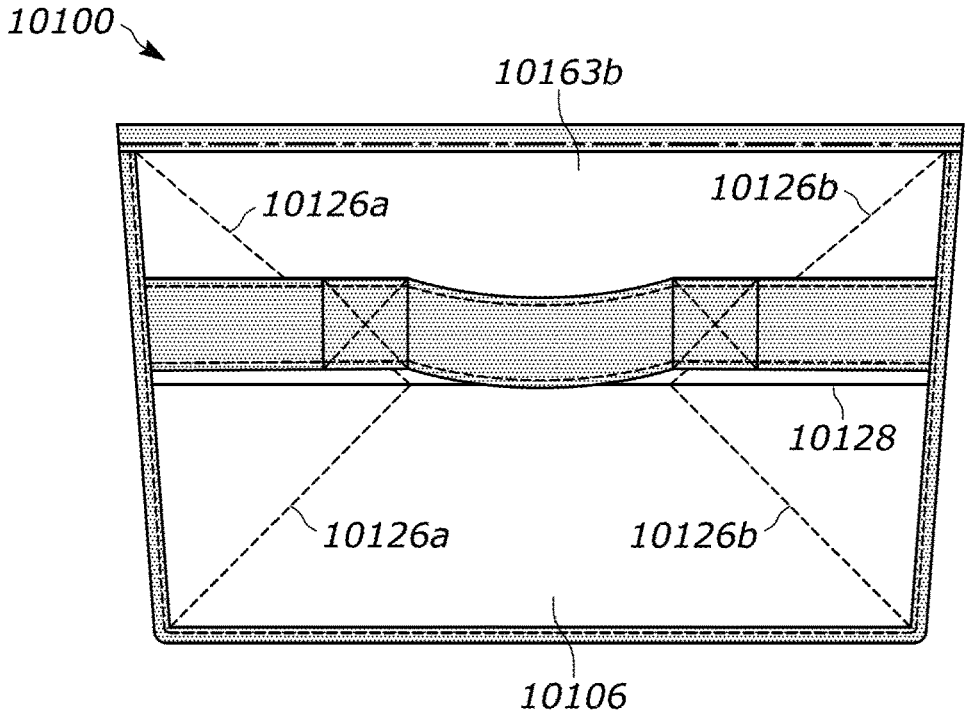
FIG. 48 is a rear view of the liner of FIG. 45A.
Figure 49:
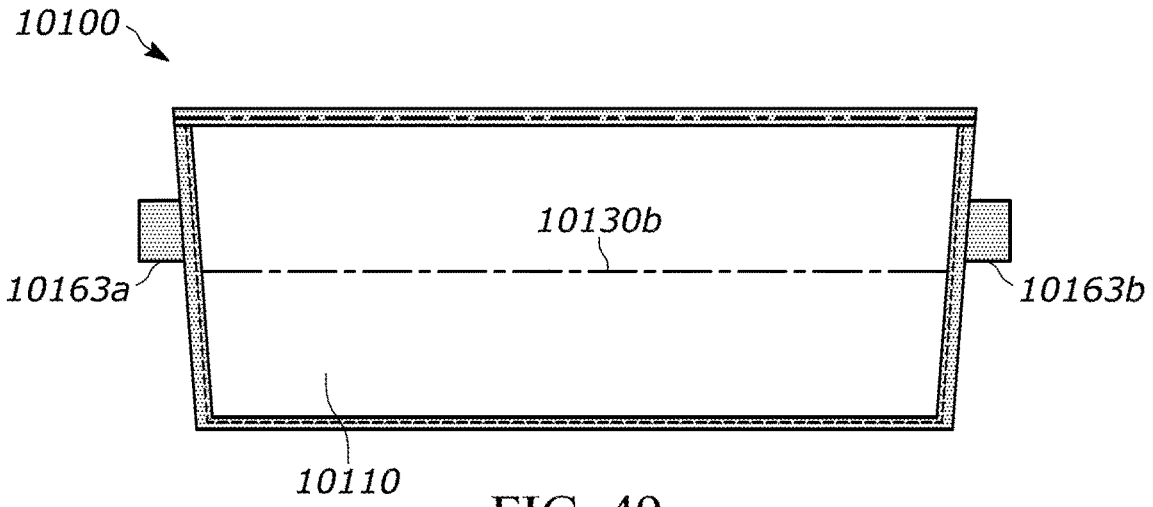
FIG. 49 is side view of the liner of FIG. 45A.
Figure 50:
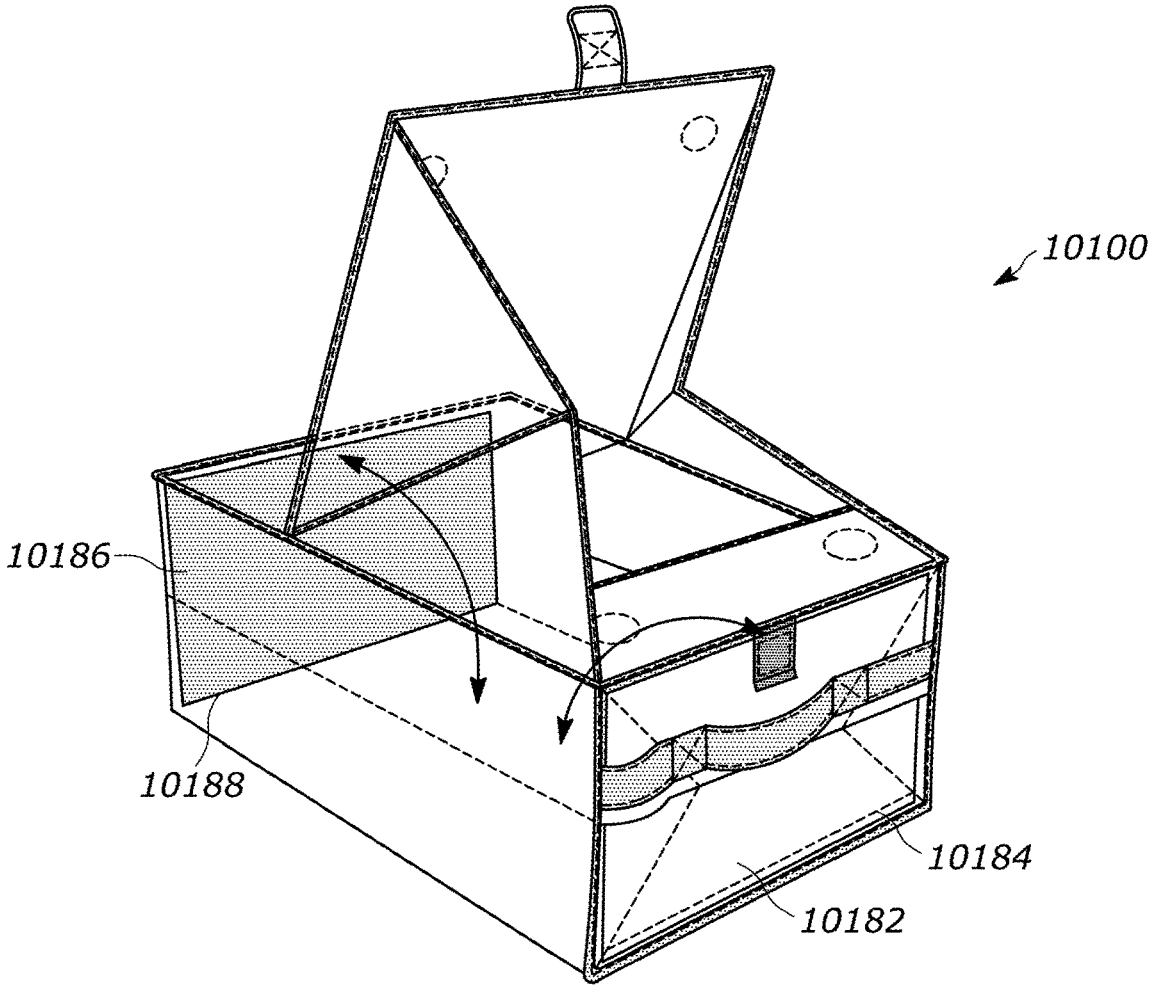
FIG. 50 is a perspective view of the liner of FIG. 45A with the interior flaps raised.
Figures 56A, 56B:
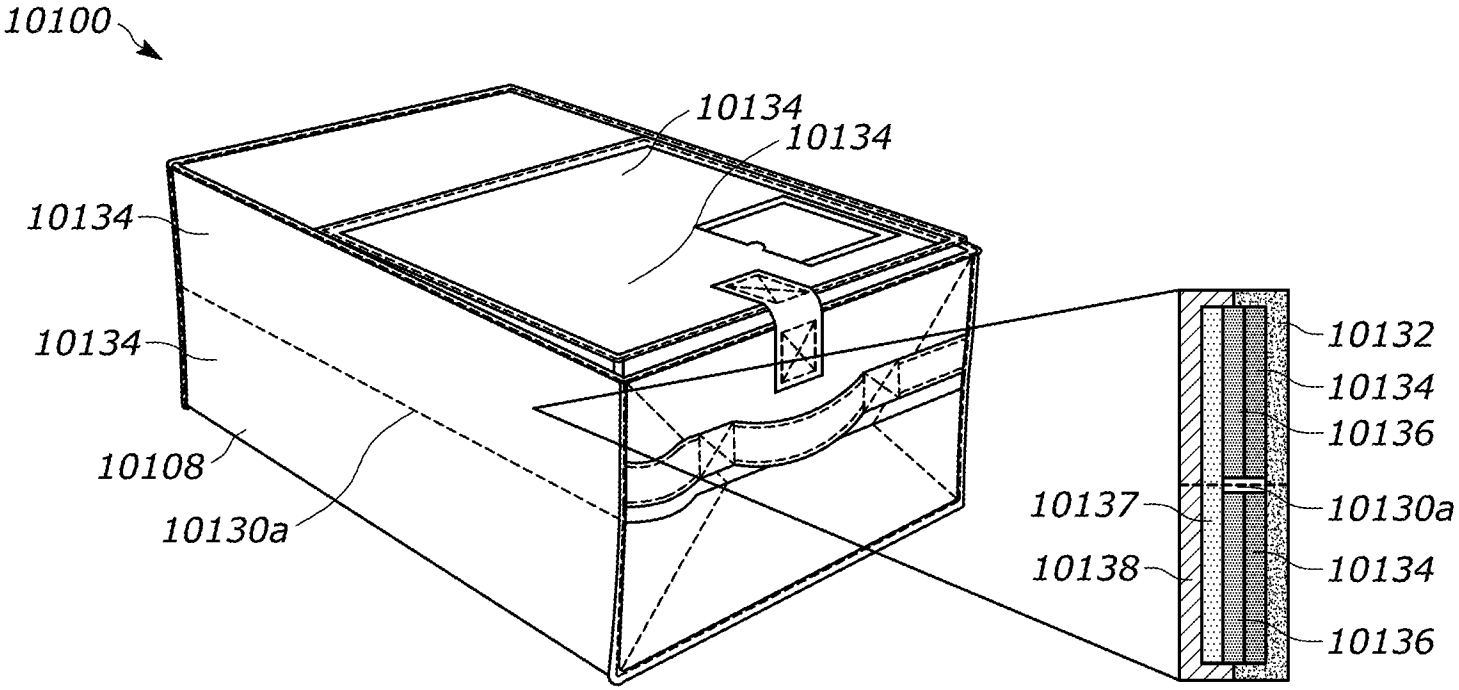
FIG. 56A is a front perspective view of the liner of FIG. 45A showing the location of the semi-ridged panels in the opposing side walls.
FIG. 56B is an expanded view showing the internal structure of the portion of the opposing side walls where the semi-rigid panels are located.
Figures 57A, 57B, 57C, 57D:
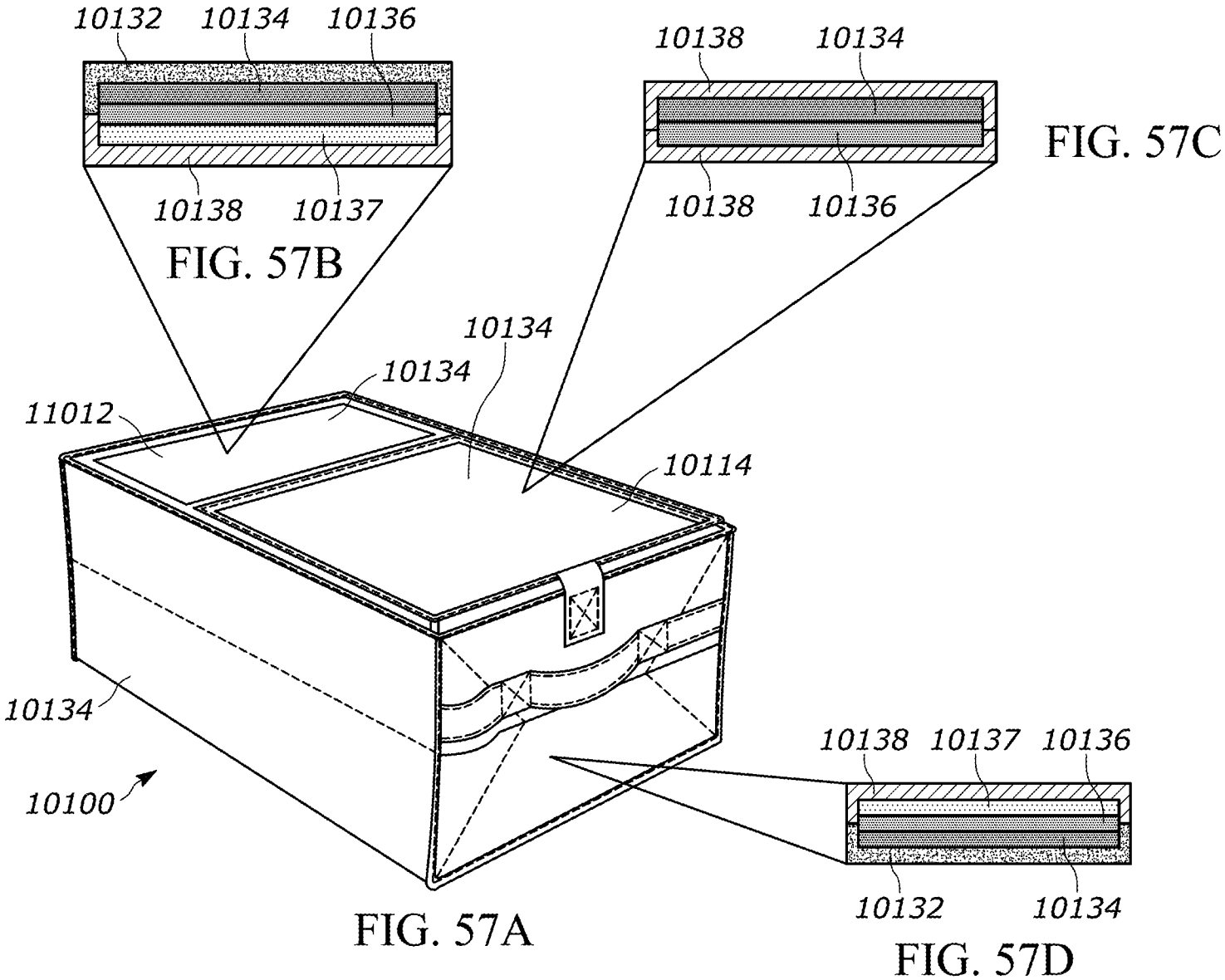
FIG. 57A is a front perspective view of the liner of FIG. 45A showing the location of the semi-ridged panels in the opposing side walls.
FIG. 57B is an expanded view showing the internal structure of the stationary portion of the lid.
FIG. 57C is an expanded view showing the internal structure of the flap portion of the lid.
FIG. 57D is an expanded view showing the internal structure of the base panel.

In an embodiment, the liner 10100 is insulated so as to maintain the temperature of the items stored or transported within the liner 10100. FIG. 45B depicts a partial cross-sectional illustration of the front wall 10104 where the lid is in the closed position and the loops 10164*a*, 10164*b* are secured via the latching mechanism 10166 (not shown to scale). In an embodiment, as shown in FIGS. 45C, 56B, 57B, 57D, the same five layers comprise the front wall 10104, the rear wall 10106, the base panel 10102, the side walls 10108, 10110, and the stationary lid portion 10112. The exterior layer 10132 comprises a protective, relatively strong and durable synthetic or natural material such as a fabric, canvas, nylon, coated polyester, or the like. In an embodiment, the exterior layer 10132 includes an aluminizing material, such as Radiant Shield™, or coating to better reflect and disperse radiation (such as heat) away from the liner 10100. The interior layer 10138 comprises a waterproof material such as polyethylene vinyl acetate (PEVA), or a plastic foil material. In alternative embodiments, the inner layer 10138 and the exterior layer 10132 comprise the same material, such as either the durable or waterproof materials described above. The outer middle layer 10134 comprises a rigid or semi-rigid material, such as polyethylene (PE) board or PE-coated paperboard, to provide support for the liner 10100. The middle layer 10136 comprises a material for maintaining the temperature of the cavity of the liner 10100 and any items located therein (e.g., by either insulating, cooling, or heating), such as cotton insulation, an insulating foam, a soft polyurethane foam, a rigid polyurethane foam, or a high-density polyethylene (HDPE) foam. In an embodiment, the middle layer 10136 comprises a layer of insulation that is 2 centimeters thick. The inner middle layer 10137 comprises a gel pack comprising an outer wrapper or envelope of flexible or pliable material such as plastic film which is filled with and surrounds an insulating, nontoxic gel material, which may be any such material known to those of skill in the art, such as silica gel. The amount of fill of the gel material is such that the gel pack 10137 is substantially flattened in shape. As shown in FIG. 57C, the flap lid portion 10114 omits the inner middle layer 10137, however, alternate embodiments (not shown) are contemplated where the flap lid portion 10114 may comprise one or more gel packs 10137. As shown in FIG. 45D, the front wall 10104 and the rear wall 10106 may omit the inner middle layer 10137. In other embodiments (not shown), the front wall 10104 and the rear wall 10106 may comprise only the inner layer 10138, the middle layer 10136, and the exterior layer 10132. As will be clear to one of skill in the art from the present disclosure, in alternative embodiments, the structure of the walls 10104, 10106, 10108, 10110, lid portions 10112, 10114, and the base panel 10102 may be varied to either include additional layers (such as by including additional layers of insulation) or omit layers (such as by omitting the outer middle layer 10134 to provide a soft-sided liner).

Figure 51:
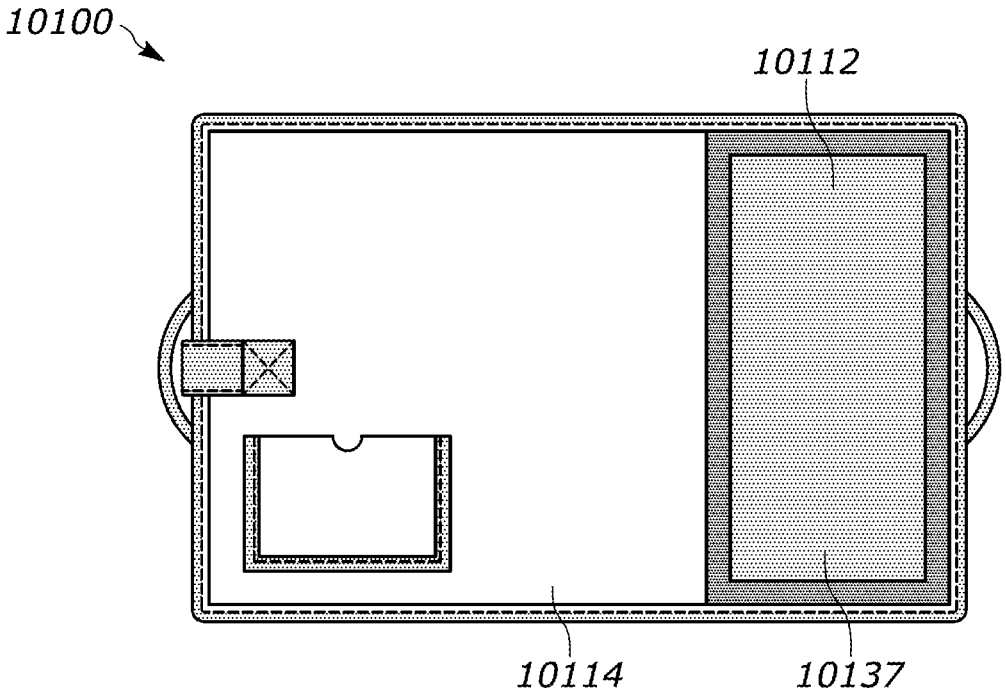
FIG. 51 is a top view of the liner of FIG. 45A showing the location of a gel pack in the stationary portion of the lid.

As shown, the exterior layer 10132 and the interior layer 10138 of adjacent wall panels are connected together, for example by side seams or lines of stitching 10142 at the intersections of the side walls 10108, 10110 with the front wall 10104, the base panel 10102, and the rear wall 10106. In an embodiment, the front wall 10104, the side walls 10108, 10110, and the rear wall 10106 comprise a single continuous length of multiple layered wall panel material with one or more discrete gel packs forming the inner middle layer 10137 in each wall. Multiple discrete gel packs may be used for the inner middle layer 10137. A single gel pack is located in each of the front wall 10104 and the rear wall 10106, with each gel pack extending substantially between the side walls 10108, 10110. As shown in FIG. 51, in an embodiment, a single gel pack is located in lid stationary portion 10112, with the gel pack extending substantially between the side walls 10108, 10110 and extending substantially between the crease 10120 and proximate the rear wall 10106. In an embodiment (not shown), a single gel pack is located in the lid flap portion 10114, with the gel pack extending substantially between the side walls 10108, 10110 and extending substantially between the crease 10120 and proximate the front wall 10104.

Figure 52:
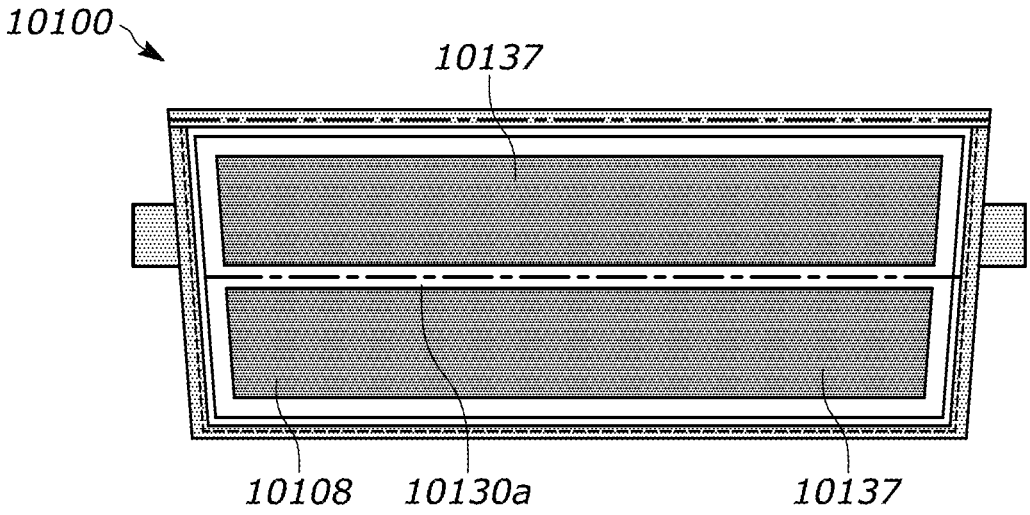
FIG. 52 is a side view of the liner of FIG. 45A showing the location of a gel pack in the side wall.

As shown in FIG. 52, in an embodiment, a pair of gel packs are located in each of the side walls 10108, 10110, such that one gel pack is located in each side wall 10108, 10110 in the area between the opening of the liner 10100 and the crease 10130*a*, 10130*b*, and a second gel pack is located in each side wall 10108, 10110 in the area between base panel 10102 and the crease 10130*a*, 10130*b*. As shown in FIG. 56B, the crease 10130*a*, 10130*b* is formed by thermal welding, side seams, or lines of stitching extending through the exterior layer 10132 and the interior layer 10138 such that the separation between the gel packs in the side walls 10108, 10110 is maintained. In alternative embodiments, other structures of gel packs may be used. By way of example, a plurality of discrete gel packs may be located in each wall 10104, 10106, 10108, 10110, such as by using a grid of spaced-apart gel packs. Alternatively, each layer may stretch continuously around the liner 10100 (i.e., inner middle layer 10136 may be formed from a single continuous gel pack). Alternatively, a single gel pack may be located in each of the side walls 10108, 10110, such that the gel pack substantially extends between the front wall 10104 and the rear wall 10106 and the crease 10130*a*, 10130*b* is formed by thermal welding of the gel pack such that the gel pack contains two pockets of gel, one gel pocket being located in the area between the opening of the liner 10100 and the crease 10130*a*, 10130*b*, and the second gel pocket being located in the area between base panel 10102 and the crease 10130*a*, 10130*b*. It would be understood by one with skill in the art that other means of temperature control may be substituted for the gel packs.

Figure 53:
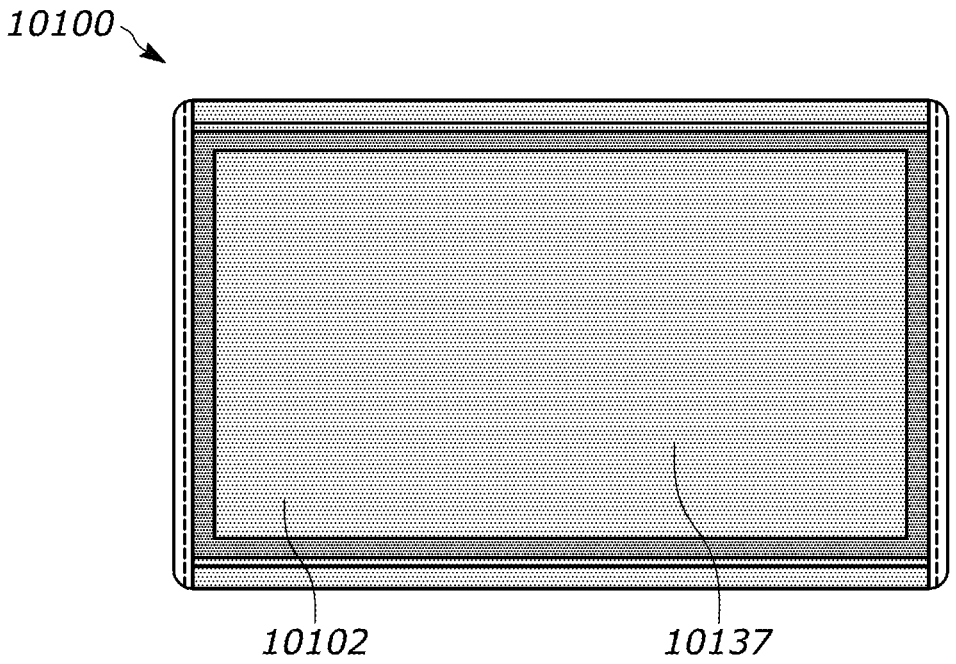
FIG. 53 is a bottom view of the liner of FIG. 45A showing a gel pack in the bottom panel.
Figure 54:
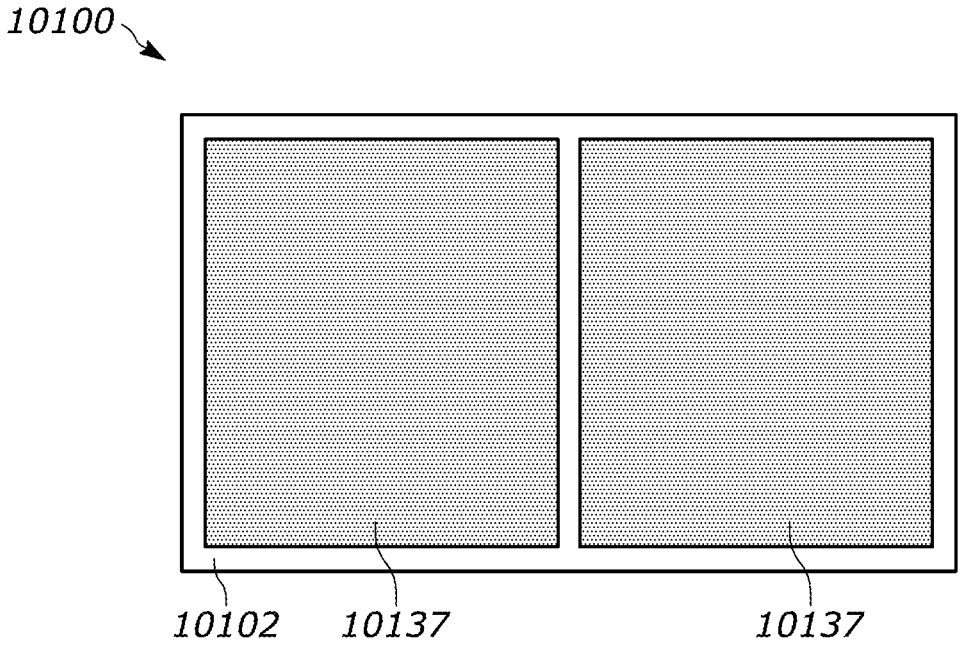
FIG. 54 is a bottom view of the liner of FIG. 45A showing an alternative configuration of gel packs in the bottom panel.
Figure 55:
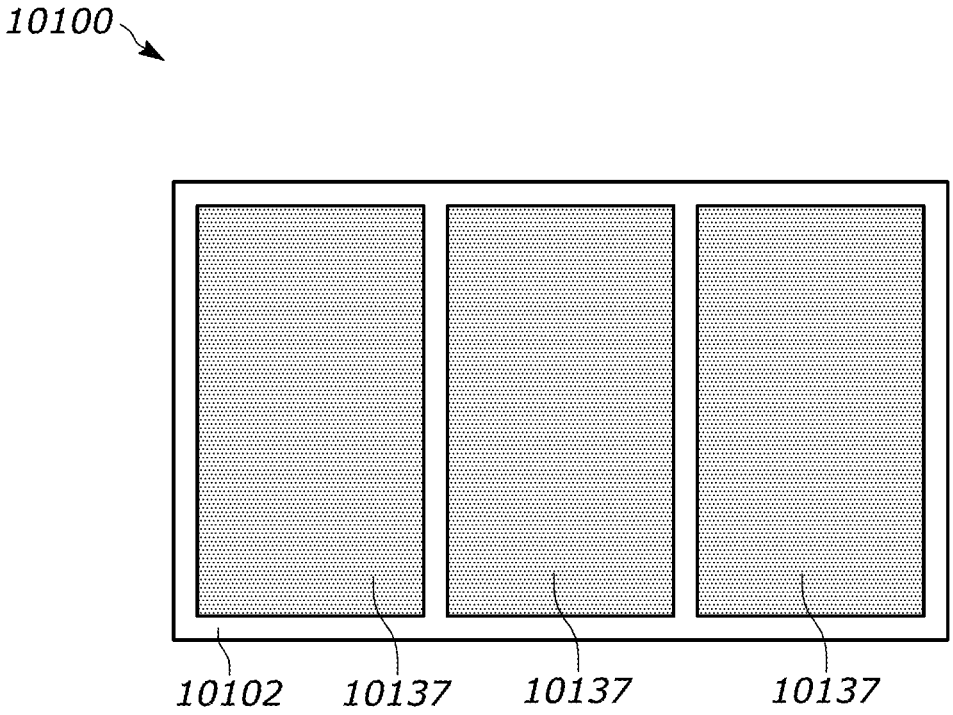
FIG. 55 is a bottom view of the liner of FIG. 45A showing an alternative configuration of gel packs in the bottom panel.

In an embodiment, as shown in FIG. 53, a single gel pack is located in the base panel 10102. In an alternative embodiment, as shown in FIG. 54, a pair of gel packs are located in the base panel 10102, such that one gel pack is located in the area proximate the rear wall 10106, and a second gel pack is located in the area proximate the front wall 10104. In an alternative embodiment, as shown in FIG. 55, a third gel pack is located between the first and second gel packs. A crease between each gel pack is formed by thermal welding, side seams, or lines of stitching extending through the exterior layer 10132 and the interior layer 10138 such that the separation between the gel packs in the base panel 10102 is maintained. In alternative embodiments, other structures of gel packs may be used. By way of example, a plurality of discrete gel packs may be located in the base panel 10102, such as by using a grid of spaced-apart gel packs. Alternatively, each layer may stretch continuously around the liner 10100 (i.e., inner middle layer 10136 may be formed from a single continuous gel pack). Alternatively, a single gel pack may be located in the base panel 10102, such that the gel pack substantially fills the base panel 10102 and one or more creases are formed by thermal welding of the gel pack such that the gel pack contains two pockets of gel, one gel pocket being located in the area between the opening of the liner 10100 and the one or more creases, and the second gel pocket being located in the area between base panel 10102 and the one or more creases. It would be understood by one with skill in the art that other means of temperature control may be substituted for the gel packs.

Figures 58A, 58B:
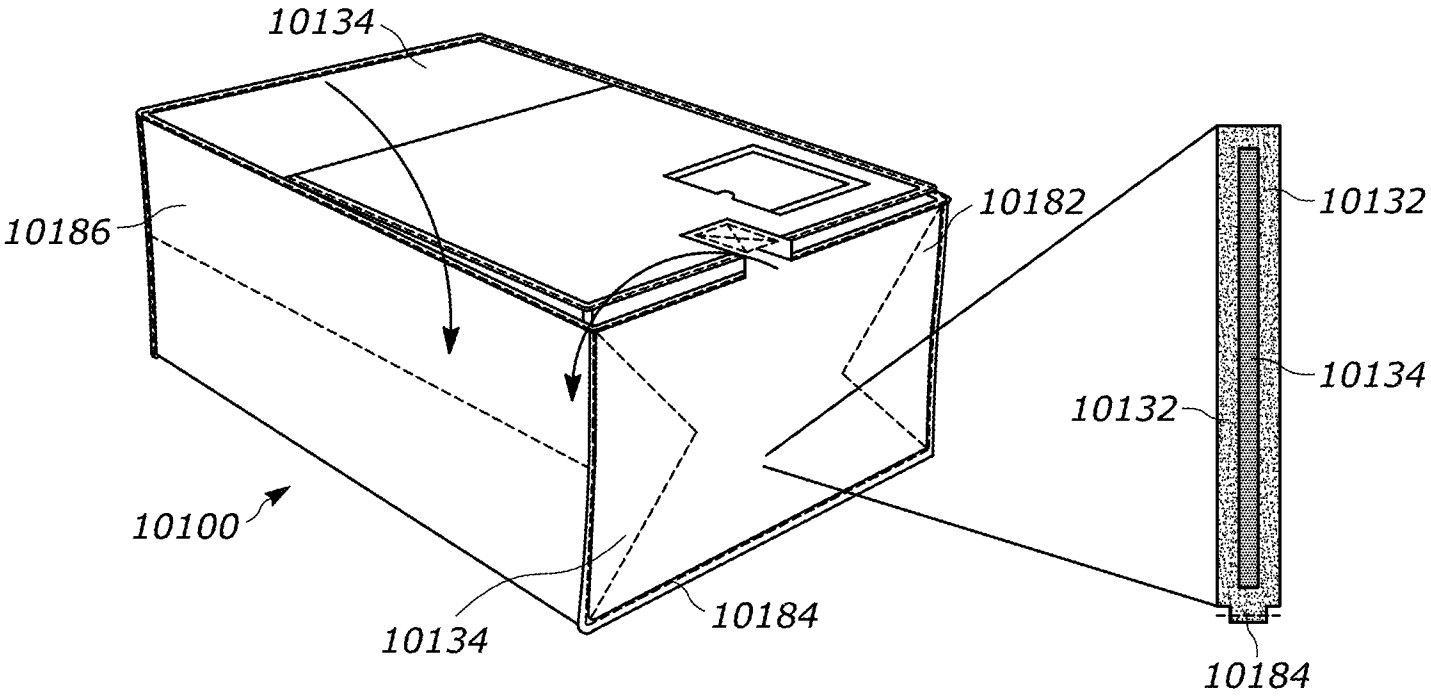
FIG. 58A is a front perspective view of the liner of FIG. 45A showing the location of the semi-ridged flaps in the front and rear walls.
FIG. 58B is an expanded view showing the internal structure of the semi-rigid flaps in the front and rear walls.

In an embodiment, interior flaps 10182, 10186 sit adjacent the front wall 10104 and rear wall 10106 and are affixed to the base panel 10102 proximate the front wall 10104 and rear wall 10106 so as to allow the interior flaps 10182, 10186 to fold downward along respective folding lines 10184, 10188 against the base panel 10102 when the liner 10100 is collapsed. As shown in FIG. 58B, the interior flap 10182, 10186 comprises a shell, formed of a waterproof material such as Radiant Shield™, polyethylene vinyl acetate (PEVA) or a plastic foil material, surrounding an inner layer 10134 comprising a rigid or semi-rigid material, such as polyethylene (PE) board or PE-coated paperboard such as that used in the outer middle layer 10134. In an embodiment (not shown), the interior flaps 10182, 10186 may comprise an additional layers such as an insulation layer, or gel pack(s). In an embodiment, a pull tab is attached to the interior flaps 10182, 10186 to enable the interior flaps 10182, 10186 to be easily folded against the base panel 10102. In alternative embodiments, the interior flaps 10182, 10186 are attached to one of the front wall 10104, the side wall 10108, or the side wall 10110, permitting the flaps 10182, 10186 to fold against the respective wall 10104, 10106, 10108, 10110.

Insulated Crate Liner with Hinged Lid, Magnet Closure, and Tab

Figure 61:
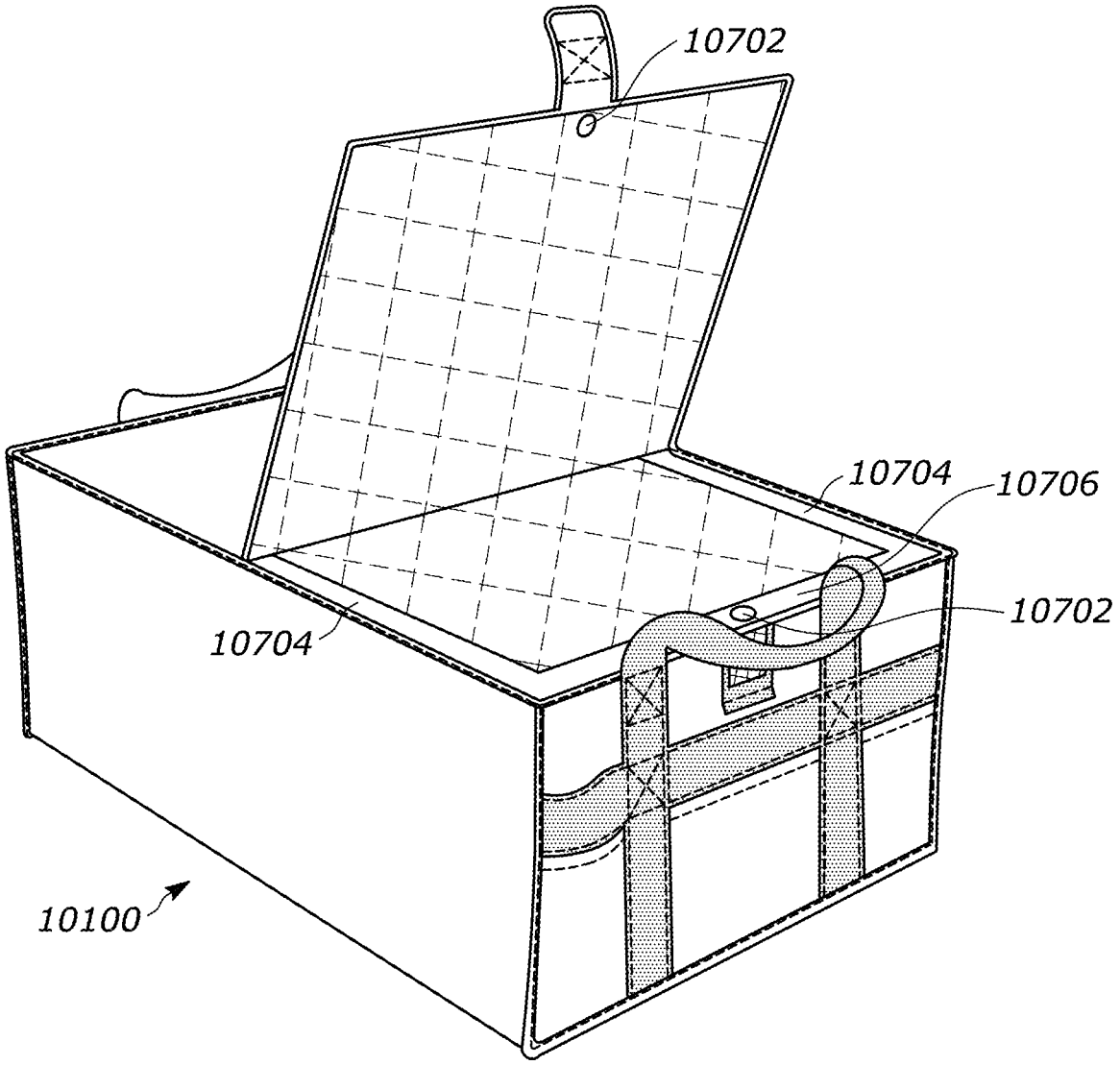
FIG. 61 is a perspective view of an eleventh embodiment of a crate liner.

FIG. 61 illustrates an eleventh embodiment of an insulated crate liner 10100. The embodiment shown in FIG. 61 is substantially the same as the tenth embodiment but includes an alternate structure in the lid. As shown in FIG. 61, the lid structure omits the lid gussets 10116*a*, 10116*b*. As shown in FIG. 61, the lid further comprises a second stationary portion 101702 that is attached to the front wall 10104 and covers a portion of the opening of the liner 10100 proximate the front wall 10104, and third and fourth stationary portions 10704 each attached to a portion of the opposing side wall 10108, 10110 and each covering a portion of the opening of the liner 10100. The second stationary portion 10706 and the lid flap portion 10114 each contains a closure mechanism 10702, such as one or more magnets, a hook-and-loop fastener, etc., affixed to the bottom and top, respectively, so as to provide additional insulation and prevent the lid flap portion 10114 from being inadvertently lifted while the liner 10100 is in use.

It is understood that the preceding is merely a detailed description of some examples and embodiments of the present invention and that numerous changes to the disclosed embodiments may be made in accordance with the disclosure made herein without departing from the spirit or scope of the invention. The preceding description, therefore, is not meant to limit the scope of the invention but to provide sufficient disclosure to allow one of ordinary skill in the art to practice the invention without undue burden. It is further understood that the scope of the present invention fully encompasses other embodiments that may become obvious to those skilled in the art and that the scope of the present invention is accordingly limited by nothing other than the appended claims.

What is claimed is:

1. A freezable liner comprising:

a plurality of panels cooperatively assembled to define an interior cavity accessible via an opening, the plurality of panels comprising at least a base panel, a front panel opposing a rear panel, and a pair of opposing side panels;

wherein the liner is configured to fold into a collapsed configuration by folding the front panel and the rear panel into the interior cavity, and folding the base panel towards the opening;

wherein each of said front panel and said rear panel comprises a pair of angled creases wherein the first angled crease extending from proximate a first of said opposing side panels and said base panel to a vertical crease, and the second angled crease extending from proximate a second of said opposing side panels and said base panel to said vertical crease, wherein said base panel comprises a horizontal crease extending from said front panel to said rear panel, and wherein the liner is configured to fold into said collapsed configuration by folding each of said front panel and said rear panel along said respective first angled crease, said respective vertical crease, and said respective second angled crease and folding said base panel along said horizontal crease;

wherein a lid extends from the front panel, rear panel, and opposing side panels, the lid comprising a pair of lid gussets extending from the front and rear panels and front and back lids extending from the opposing side walls such that when the front and back lids are folded over the cavity, the lid gussets collapse into the cavity of the liner and provide support to the front and back lids; and wherein the plurality of panels each comprise an interior layer proximate the cavity and an exterior layer forming the exterior of the liner, the pair of opposing side panels further comprise both a stiffener and a layer of temperature control material therebetween, and the lid gussets each comprise an interior layer proximate the cavity, an insulation layer, a rigid middle layer, a temperature control material, and an exterior layer forming the exterior of the lid gusset.

2. The freezable liner of claim 1, wherein said temperature control material comprises one or more discrete gel packs.

3. The freezable liner of claim 1, wherein said front panel and said rear panel further comprise both a stiffener and a layer of temperature control material between said interior layer and said exterior layer.

4. The freezable liner of claim 3, wherein said front panel, said rear panel, and said pair of opposing side panels further comprises an insulation layer between said stiffener and said layer of temperature control material.

5. The freezable liner of claim 1, wherein said base panel further comprises both a stiffener and a layer of temperature control material between said interior layer and said exterior layer.

6. The freezable liner of claim 5, wherein said base panel and said pair of opposing side panels further comprises an insulation layer between said stiffener and said layer of temperature control material.

7. The freezable liner of claim 1, further comprising an interior flap attached to the base panel configured to be folded proximate one of said opposing side walls when the liner is in said collapsed configuration, and wherein the interior flap comprises an interior layer proximate the cavity and an exterior layer, and a stiffener therebetween.

8. The freezable liner of claim 1, wherein each of a pair of handle straps is attached to a respective one of said front panel and said rear panel.

9. The freezable liner of claim 1, a first lid movably connected to a first of said opposing side panels and configured to move between an open position proximate the first of said opposing side panels and a closed position whereby the opening is partially obstructed, a second lid movably connected to a second of said opposing side panels and configured to move between an open position proximate the second of said opposing side panels and a closed position whereby the opening is partially obstructed, and wherein the liner is configured to fold into a collapsed configuration by placing said first lid and said second lid in their respective open position, folding the front panel and the rear panel into the interior cavity, and folding the base panel towards the opening.

10. A method of providing an temperature controlled rigid container, the method comprising:

folding a liner comprising a base panel, lid, and a peripheral wall;

wherein the peripheral wall comprising a front wall opposing a rear wall and a pair of opposing side walls, each of the front wall and the rear wall comprising one or more creases, each of the opposing side walls comprising one or more discrete gel packs, the peripheral wall extending from the base panel to form a cavity into a collapsed configuration by folding the front wall and the rear wall into the cavity along the one or more creases;

wherein the lid comprising a pair of lid gussets extending from the front wall and rear wall and front and back lids extending from the opposing side walls;

placing the liner in a temperature-controlled environment until the gel packs reach a desired temperature;

removing the liner from the temperature-controlled environment;

unfolding the liner into an expanded configuration by unfolding the front wall and the rear wall; and placing the liner within a crate comprising a base panel and a peripheral wall each of the base panel and the peripheral wall composed of a rigid material.

11. The method of claim 10, wherein the freezable liner further comprises an interior flap attached to the base panel, the method further comprising the step of folding the interior flap proximate the base panel.

12. The method of claim 10, wherein the freezable liner further comprises a first interior flap attached to the base panel and a second interior flap attached to the base panel, the method comprising the additional steps of folding the first interior flap proximate the front wall and folding the second interior flap proximate the rear wall.

13. The method of claim 10, wherein the freezable liner further comprises at least one pair of straps attached respectively to said front wall and said rear wall, the method comprising the additional step of affixing said straps to said crate.

* * * * *